US011499374B2

(12) United States Patent
Macfarlane et al.

(10) Patent No.: US 11,499,374 B2
(45) Date of Patent: Nov. 15, 2022

(54) DOWNHOLE DEVICES AND ASSOCIATED APPARATUS AND METHODS

(71) Applicant: NOV Downhole Eurasia Limited, Stonehouse (GB)

(72) Inventors: Alastair Henry Walter Macfarlane, Letham (GB); Rory McCrae Tulloch, Aberdeen (GB); Matthew Shaw, Inverbervie (GB); Brad Ivie, Conroe, TX (US)

(73) Assignee: NOV Downhole Eurasia Limited

( * ) Notice: Subject to any disclaimer, the term of this patent is extended or adjusted under 35 U.S.C. 154(b) by 41 days.

(21) Appl. No.: 16/772,326

(22) PCT Filed: Dec. 13, 2018

(86) PCT No.: PCT/GB2018/053623
§ 371 (c)(1),
(2) Date: Jun. 12, 2020

(87) PCT Pub. No.: WO2019/116042
PCT Pub. Date: Jun. 20, 2019

(65) Prior Publication Data

US 2021/0087888 A1 Mar. 25, 2021

(30) Foreign Application Priority Data

Dec. 13, 2017 (GB) ..... 1720773

(51) Int. Cl.
*E21B 10/32* (2006.01)
*E21B 10/62* (2006.01)
(Continued)

(52) U.S. Cl.
CPC ..... *E21B 10/322* (2013.01); *E21B 7/061* (2013.01); *E21B 10/62* (2013.01); *E21B 23/0413* (2020.05)

(58) Field of Classification Search
CPC ..... E21B 10/322
See application file for complete search history.

(56) References Cited

U.S. PATENT DOCUMENTS 761,518 A 5/1904 Lykken
1,062,841 A 5/1913 Mitchel
(Continued)

FOREIGN PATENT DOCUMENTS

CA 2880806 2/2014
CN 201513136 U 6/2010
(Continued)

OTHER PUBLICATIONS

Combined_Search_and_Examination_Report for GB Appllication No. 1720773.9 (7 pages).
(Continued)

*Primary Examiner* — Blake Michener
(74) *Attorney, Agent, or Firm* — Conley Rose, P.C.

(57) ABSTRACT

A drill bit for drilling a bore, the drill bit comprising: an outer housing; a primary cutting structure defining a cutting plane of a first diameter; a flow path arranged to let drilling fluid flow through the drill bit; and a deployable blade assembly at least partially located within the outer housing, the deployable blade assembly comprising a cutting structure and being arranged to be axially movable from a first position, in which the deployable cutting structure is recessed with respect to the primary cutting structure, towards the cutting plane, to a second position; wherein when the deployable blade assembly is in the second position, the deployable cutting structure defines a cutting diameter which is less than or equal to the first diameter.

19 Claims, 53 Drawing Sheets

(51) Int. Cl.
*E21B 23/04* (2006.01)
*E21B 7/06* (2006.01)

(56) References Cited

U.S. PATENT DOCUMENTS 1,084,042 A 1/1914 Sessions
1,324,303 A 12/1919 Carmichael
1,435,491 A 11/1922 Mitchell
1,494,274 A 5/1924 Morgan
1,545,039 A 7/1925 Deavers
1,561,418 A 11/1925 Duda
1,569,729 A 1/1926 Duda
1,597,212 A 8/1926 Spengler
1,662,138 A 3/1928 Waldron
1,740,829 A 12/1929 Nichols
1,858,926 A 5/1932 Grau
1,866,736 A 7/1932 Triplett
1,930,825 A 10/1933 Raymond
2,049,450 A 8/1936 Johnson
2,060,352 A 11/1936 Stokes
2,216,895 A 10/1940 Stokes
2,287,714 A 6/1942 Walker
2,324,679 A 7/1943 Cox
2,383,214 A 8/1945 Prout
2,499,630 A 3/1950 Clark
2,586,878 A 2/1952 Staton
2,599,060 A 6/1952 Kammerer
2,602,642 A * 7/1952 Baker ..... E21B 10/322 175/269
2,690,897 A 10/1954 Clark
2,743,087 A 4/1956 Layne
2,814,463 A 11/1957 Kammerer
3,050,122 A 8/1962 Huitt
3,105,562 A * 10/1963 Stone ..... E21B 10/322 175/268
3,126,065 A 3/1964 Chadderdon
3,365,010 A 1/1968 Howell
3,406,769 A 10/1968 Kammerer
3,536,150 A 10/1970 Stebley
3,575,245 A 4/1971 Cordary
3,934,660 A 1/1976 Nelson
4,031,972 A 6/1977 Burg
4,081,042 A 3/1978 Johnson
4,266,621 A 5/1981 Brock
4,354,559 A 10/1982 Johnson
4,565,252 A 1/1986 Campbell
4,589,504 A 5/1986 Simpson
5,090,480 A 2/1992 Pittard
5,141,063 A 8/1992 Quesenbury
5,201,817 A 4/1993 Hailey
5,318,137 A 6/1994 Johnson
5,318,138 A 6/1994 Dewey
5,332,048 A 7/1994 Underwood
5,361,859 A 11/1994 Tibbitts
5,560,440 A 10/1996 Tibbitts
5,771,972 A 6/1998 Dewey
5,979,571 A 11/1999 Scott
6,009,961 A 1/2000 Pietrobelli
6,039,131 A 3/2000 Beaton
6,076,618 A 6/2000 Asberg
6,131,675 A 10/2000 Anderson
6,269,893 B1 8/2001 Beaton
6,289,999 B1 9/2001 Dewey
6,338,390 B1 1/2002 Tibbitts
6,360,831 B1 3/2002 Akesson
6,378,632 B1 4/2002 Dewey
6,425,448 B1 7/2002 Zupanick
6,427,788 B1 8/2002 Rauchenstein
6,607,046 B1 8/2003 Betts
6,612,383 B2 9/2003 Desai
6,648,068 B2 11/2003 Dewey
6,695,056 B2 2/2004 Haugen
6,695,074 B2 2/2004 Nackerud
6,708,769 B2 3/2004 Haugen
6,732,817 B2 5/2004 Dewey
6,886,633 B2 5/2005 Fanuel
6,920,944 B2 7/2005 Eppink
6,953,096 B2 10/2005 Gledhill
6,973,978 B2 12/2005 Cravatte
6,991,046 B2 1/2006 Fielder
7,131,504 B2 11/2006 Odell, II
7,143,847 B2 12/2006 Pia
7,195,085 B2 3/2007 Pia
7,231,975 B2 6/2007 Lavaurre
7,306,056 B2 12/2007 Ballantyne
7,370,710 B2 5/2008 Trueman
7,410,015 B2 8/2008 Denoix
7,487,846 B2 2/2009 Head
7,493,971 B2 2/2009 Nevlud
7,503,403 B2 3/2009 Jogi
7,753,139 B2 7/2010 Dewey
8,056,651 B2 11/2011 Turner
8,122,977 B2 2/2012 Dewey
8,186,458 B2 5/2012 Dewey
8,881,845 B2 11/2014 Dewey
9,279,293 B2 3/2016 Izbinski
2006/0096785 A1* 5/2006 Walter ..... E21B 10/32 175/267
2007/0007043 A1 1/2007 Dewey
2007/0114064 A1 5/2007 Hall
2009/0084555 A1* 4/2009 Lee ..... E21B 10/322 166/319
2009/0173541 A1* 7/2009 Tulloch ..... E21B 23/006 175/45
2009/0272579 A1 11/2009 Sihler et al.
2010/0175928 A1 7/2010 Lee
2010/0181112 A1 7/2010 Radford
2011/0139508 A1 6/2011 Haugvaldstad
2014/0174827 A1 6/2014 Schen
2014/0305703 A1 10/2014 Izbinski
2014/0311801 A1 10/2014 Jain et al.
2015/0300093 A1 10/2015 Diller
2016/0053551 A1 2/2016 Jain
2016/0153244 A1 6/2016 Humphrey et al.
2016/0168916 A1 6/2016 Lakic
2017/0234071 A1 8/2017 Spalz

FOREIGN PATENT DOCUMENTS

EP 0961007 12/1999
EP 2984274 8/2018
GB 2242379 10/1991
GB 2294715 5/1996
GB 2310229 8/1997
GB 2320270 6/1998
GB 2352747 2/2001
SU 1740602 6/1992
WO 0181708 11/2001
WO 03078790 9/2003
WO 2008147071 12/2008
WO 2016057523 4/2016
WO 2016094256 6/2016
WO 2017106344 6/2017
WO 2017146716 8/2017

OTHER PUBLICATIONS

International Search Report for PCT/GB2018/054623 dated Aug. 3, 2019 (5 pages).
Written Opinion for PCT/GB2018/054623 dated Aug. 3, 2019 (6 pages).
Brains Behind the Bit, Upsstream Technology.
Baker Hughes Announces the Industry's First Adaptive Drill Bit.
Terradapt adaptive drill Bit; Baker Hughes.

* cited by examiner

DOWNHOLE DEVICES AND ASSOCIATED APPARATUS AND METHODS

CROSS REFERENCE TO RELATED APPLICATIONS

This application is a 35 U.S.C. § 371 national stage application of PCT/GB2018/053623 filed Dec. 13, 2018 and entitled "Downhole Devices and Associated Apparatus and Methods", which claims priority to United Kingdom Patent Application No. 1720773.9 filed Dec. 13, 2017, each of which is incorporated herein by reference in their entirety for all purposes.

STATEMENT REGARDING FEDERALLY SPONSORED RESEARCH OR DEVELOPMENT

Not applicable.

FIELD OF DISCLOSURE

The present disclosure relates to downhole devices and associated apparatus and methods. In some examples, those devices comprise drill bits, actuation devices, etc.

BACKGROUND OF THE DISCLOSURE

During drilling operations, typically a drill string having a drill bit is deployed in a wellbore from the surface and lowered to a drilling location. The drill bit will typically comprise a primary cutting structure at an end of the drill bit for drilling through formation, casings or other materials encountered during downhole drilling operations. The drill bit is normally connected to surface by the drill string.

During such operations, in some cases the drill bit may need to be removed from the wellbore to be replaced. A drill bit may need to be replaced due to wear or the need for an alternative, specialised, cutting structure to be deployed for the drilling operation to continue in an efficient manner. Typically, to replace the drill bit the entire drill string must be pulled out from the wellbore such that the drill bit can be replaced by operators at surface. The drill string is then deployed back into the wellbore so that drilling can continue.

Similarly, many downhole devices need to be actuated during use in a wellbore. The actuation may be to change the operation mode of a downhole device, or initiate a downhole procedure. Given the environments in which such devices operate, actuation mechanisms are required that are effective and unlikely to be prone to failure. If a downhole device does not correctly actuate in a timely/desired manner, the downhole device/string may have to be removed from the wellbore, which can be time consuming and thus costly.

During downhole operations, and particularly drilling operations, it is desirable to provide a more time and cost effective solution that is convenient and reliable. There is a continued desire to minimise the costs and improve the effectiveness of such drilling operations.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments disclosed herein may or may not address one or more of the background issues.

SUMMARY OF DISCLOSURE

There are described downhole devices and associated apparatus and methods, particularly, in some examples, new and improved drill bits and/or activation mechanisms. The disclosed devices and method may provide better time and cost effective solutions that are convenient and reliable, and may improve the effectiveness of such downhole operations (e.g. drilling operations).

In one example, there is provided a drill bit that may require replacing less frequently than existing drill bits. The drill bit of the present disclosure may allow a drilling operation to be completed with fewer deployments and pull out operations and thus reduce the time required for the drilling operation. The drill bit may have an increased service life such that it needs replacing due to high wear less frequently. The drill bit may be suitable for drilling through multiple different materials or formations, such that it needs replacing for a more optimised drill bit less frequently.

The present disclosure also provides actuation mechanisms that may be more robust, reliable and/or easier to activate than existing solutions. The actuation mechanisms described herein may be operable from the surface and may have a reduced rate of failure compared to existing designs. The actuation mechanisms may therefore reduce the incidence of actuation failure and thus reduce the risk of having to stop operations to withdraw a downhole device or reduce the likelihood of well viability being affected by the failure of a downhole device to actuate.

There is described a drill bit for use in downhole drilling. The drill bit is also suitable for use as part of a combination mill-drill bit, e.g. when kicking off from an original well bore.

The drill bit may have a primary drilling structure and a deployable drilling structure which may be selectively deployed during use. The deployable drilling structure may define a cutting diameter which is not greater than the cutting diameter of the primary drilling structure, such that the drill bit with the deployable drilling structure deployed, can be withdrawn through the entire length of the drilled bore.

The drill bit may define a longitudinal axis which runs longitudinally through the centre of the drill bit and along which axis the drill bit is configured to drill.

The drill bit may have an outer housing and a primary cutting structure. The outer housing may comprise the primary cutting structure. The primary cutting structure may define a first cutting plane and a first cutting diameter.

The primary cutting structure may comprise a plurality of cutting inserts, arranged to cut into a material. The primary cutting structure may comprise a plurality of cutting inserts arranged to cut in an axial direction. The primary cutting structure may comprise a plurality of cutting inserts arranged to cut in a radial direction.

The cutting inserts of the primary cutting structure may define a substantially flat cutting plane; the cutting plane may be parallel to the end face of the drill bit (and hence primary cutting structure). The cutting plane may be an envelope of space to be cut by the primary cutting structure; accordingly, the cutting plane may indicate the material immediately in front of the drill bit which is to be cut. The cutting plane has a diameter determined by the maximum radial cutting reach of the primary cutting structure (e.g. the cutting inserts thereof). Material outside of the cutting plane will not be cut by the drill bit.

The cutting inserts may be arranged so as to ensure that a cut is provided across the entire cutting plane, including the centre of the cutting plane.

The drill bit may also comprise a flow path arranged to let drilling fluid flow through the drill bit. The drilling fluid may flow from an upstream end of the drill bit, towards a downstream end of the drill bit. The primary cutting structure may be on the downstream axial end of the drill bit.

The flow path may have an inlet for allowing fluid to enter the flow path. The inlet may be a single drill bit inlet. The flow path may have an outlet, for allowing fluid to leave the flow path (and the drill bit). The outlet of the flow path may be in an end face of the drill bit, in the primary cutting structure of the drill bit, in a curved side wall of the drill bit. The flow path may connect an inlet of the drill bit to an outlet of the drill bit. The flow path may pass through the deployable blade assembly (or a piston thereof). The flow path may pass around the activation mechanism.

The drill bit may comprise a deployable blade assembly. The deployable blade assembly may be at least partially located within the outer housing. The deployable blade assembly may comprise a cutting structure, which may be referred to as the deployable cutting structure. In some examples, the deployable cutting structure may not be for actively cutting material, but rather for interacting with material during a cutting operation, i.e. the deployable cutting structure may be used to reduce the cutting depth of the primary cutting structure. This may be achieved by the deployable cutting structure being a surface against which the material to be cut abuts during a cutting operation. In such a scenario, the deployable cutting structure may comprise a plurality of ovoid inserts and no cutting inserts.

The deployable blade assembly and hence the deployable cutting structure may be arranged to be axially movable. The (whole of the) deployable blade assembly may (only) move axially and parallel to the longitudinal axis of the drill bit. The deployable blade assembly and hence the deployable cutting structure may be axially movable from a first position to a second position. In the first position, the deployable cutting structure may be (axially) recessed with respect to the primary cutting structure. The deployable blade assembly and deployable cutting structure may be arranged to move towards the primary cutting structure or cutting plane, to the second position. Accordingly, the second position may be closer to the primary cutting structure and cutting plane than the first position.

The first position of the deployable blade assembly may be a retracted position and the second position of the deployable blade assembly may be an extended position, in which the deployable blade assembly is extended with respect to the retracted position.

The deployable blade assembly may be deployed to the second position.

When the deployable blade assembly is in the second position, the deployable cutting structure may define a cutting diameter which is less than or substantially equal to the first diameter (i.e. that defined by the primary cutting structure). The cutting diameter defined by the deployable blade assembly may be the outer diameter of the deployable cutting structure. The cutting diameter defined by the deployable blade assembly may be the maximum diameter bore which can be drilled by the deployable blade assembly. This may not be the same as the maximum diameter bore which can be drilled by the drill bit as a whole.

The deployable cutting structure may define a cutting diameter which is substantially equal to the first diameter. When the deployable blade assembly is in the second position, the deployable cutting structure may define a deployable cutting plane of a second diameter. The second diameter may be less than or equal to the first diameter.

The cutting diameter of the deployable blade assembly may be, or may not be, equal to the diameter of the final bore cut by the drill bit.

When the deployable cutting structure is not configured to provide a cutting action, the diameter of the cut bore is inevitably equal to that defined by the primary cutting structure, since the primary cutting structure is providing the cutting action.

Similarly, when the deployable cutting structure defines a cutting diameter which is less than the first diameter, the diameter of the cut bore is defined by the primary cutting structure. In such an arrangement, the deployable cutting structure may provide an initial cutting action, cutting a bore of a smaller diameter, and the primary cutting structure may provide a final cutting action, which enlarges the bore cut by the deployable cutting structure.

The cutting diameter defined by the deployable cutting structure being equal to or less than the cutting diameter defined by the primary cutting structure ensures that the drill bit, with the deployable blade assembly in the second position, can be withdrawn through the entire length of the drilled bore—including sections with a first bore diameter. If the cutting diameter defined by the deployable cutting structure was greater than that defined by the primary cutting structure, a drill bit would not be able to be withdrawn through the hole section with a first diameter after the deployable blade assembly had been moved to the second position without further steps to modify the drill bit or the first hole section.

Alternatively, the cutting diameter defined by the deployable blade assembly may be defined as the maximum diameter bore which can be drilled by the drill bit when the deployable blade assembly is in the second, deployed, position. In such a case, the cutting diameter defined by the deployable blade assembly may be substantially equal to the first diameter A drill bit for drilling a bore according to the disclosure may comprise:

an outer housing;

a primary cutting structure defining a cutting plane of a first diameter;

a flow path arranged to let drilling fluid flow through the drill bit; and a deployable blade assembly at least partially located within the outer housing, the deployable blade assembly may comprise a cutting structure and may be arranged to be axially movable from a first position, in which the deployable cutting structure is recessed with respect to the primary cutting structure, towards the cutting plane, to a second position;

when the deployable blade assembly is in the second position, the deployable cutting structure may define a cutting diameter which is less than or equal to the first diameter.

There is also described herein an actuation mechanism. The actuation mechanism may be for use in a downhole device (e.g. a drill bit) in a wellbore. The actuation mechanism may be mechanically connected to the surface and operable by a user. The actuation mechanism may be electrically powered and electrically controllable by a user at the surface. The actuation mechanism may be a fluid-activated actuation mechanism. The fluid-activated actuation mechanism may be activated by a change in the flow of fluid through the downhole device. The actuation mechanism for use in a downhole device may be configured to cause a first structure (which, for example may be part of the actuation mechanism or the downhole device) to move from a first position to a second position. The actuation mechanism may comprise a blocking assembly. The blocking assembly may be for blocking, or restricting flow through, a flow path. The blocking assembly may be configured to move from a first arrangement to a second arrangement. In the first arrangement, a flow path through the downhole device may be open such that fluid can flow through the flow path. In the second arrangement, the blocking assembly may be arranged to restrict fluid flow through the flow path. The blocking assembly may be configured to move from the first to the second arrangement in response to a change in the flow of fluid through the downhole device. The first structure may move from the first position to the second position under the action of fluid pressure in response to the blocking assembly moving to the second arrangement.

The drill bit may comprise the actuation mechanism. The actuation mechanism may be configured to cause the deployable blade assembly to move from the first position to the second position.

There is described a downhole tool. The downhole tool may comprise an outer housing. The downhole tool may comprise a first structure configured to move from a first position to a second position. The downhole tool may comprise an actuation mechanism (which may comprise a blocking assembly). The actuation mechanism may be as described anywhere herein. The actuation mechanism may be configured to cause the first structure to move from the first to the second position.

The downhole tool may be a downhole reamer. The first structure may be cutter blades or cutter blocks. The first structure may be at least partially located within an outer housing. The first structure may be arranged to be movable from a first position to a second position. In the first position, the first structure may be recessed or flush with an outer surface of the housing. In the second position, the first structure may protrude from an outer surface of the housing—for example radially.

The downhole device may be a drill bit. The first structure may be the deployable blade assembly. The fluid may be drilling fluid. Discussion relating to any of the drill bit, deployable blade assembly or drilling fluid in relation to the operation of the actuation mechanism applies, where appropriate and adapted as appropriate—to a "downhole device", "first structure" and "fluid" respectively.

The actuation mechanism may be configured to move the deployable blade assembly from the first position to the second position. The actuation mechanism may alternatively be configured to alter the flow of drilling fluid through the drill bit which, in turn, may move the deployable blade assembly from the first position to the second position. The actuation mechanism may be configured to increase the drilling fluid pressure differential across the deployable blade assembly.

The actuation mechanism may comprise a blocking assembly. The actuation mechanism may be a blocking assembly.

The blocking assembly may be a flow passage, or flow path, blocking assembly.

The blocking assembly may be configured to move from a first arrangement, in which the flow path is open and fluid can flow through the flow path, to a second arrangement, in which the blocking assembly is arranged to restrict fluid from flowing through the flow path. The blocking assembly may be configured to move from the first arrangement to the second arrangement in response to a change in the flow of drilling fluid through the drill bit.

The blocking assembly may use the flow of the drilling fluid to move the blocking assembly from the first arrangement to the second arrangement.

When the blocking assembly is in the first arrangement, the flow path may be open such that a fluid could flow through the flow path. In the second arrangement, the blocking assembly may be arranged to at least partially close (or entirely close) the flow path, such that fluid flow through the flow path would be restricted. A blocking assembly may be operable to modify the flow of drilling fluid through the drill bit, for example by blocking a port or a flow path. The blocking assembly may be configured to selectively block a flow path.

The blocking assembly may allow a reduced amount of fluid flow through the flow path and thus restrict fluid flow through the flow path. The blocking assembly may be configured to block the flow path to entirely prevent fluid flow through the flow path when in the second arrangement. Blocking the flow path entirely is included within the use of the term "restrict" when referring to fluid flow through the flow path.

The blocking assembly may move from the first arrangement to the second arrangement when a pressure differential across the blocking assembly reaches a threshold value. The blocking assembly may move from the first arrangement to the second arrangement when a resultant force acting on the blocking assembly, or a part thereof, reaches a threshold value. The resultant force may be in an axial direction, the direction may be from the upstream end of the drill bit to the downstream end of the drill bit. The blocking assembly may define a reduction in the area through which fluid can flow in the drill bit, thus creating a pressure drop and resultant force acting across the blocking assembly.

The change in the flow of drilling fluid through the drill bit may increase a pressure differential (and thus resultant force) across the blocking assembly to a threshold value.

The change in the flow of drilling fluid through the drill bit may increase the pressure of the drilling fluid at the entry to the drill bit, or at an upstream end of the blocking assembly. The change in the flow of drilling fluid through the drill bit may reduce the pressure of the drilling fluid at an outlet of the drill bit or at a downstream end of the blocking assembly and/or the deployable blade assembly.

The change in the flow of drilling fluid through the drill bit may be an increase in the drilling fluid flow rate.

The change in the flow of drilling fluid through the drill bit may be increasing the volumetric flow rate of drilling fluid input into the drill string, and hence drill bit. Increasing the flow rate of the drilling fluid into the drill string and hence the drill bit may increase the pressure drop across flow restrictions in the drill bit. The blocking assembly may comprise a flow restriction for drilling fluid and, as such, the pressure differential across the blocking assembly may increase when the flow rate of drilling fluid into the drill bit increases.

The increase in flow rate suitable for moving the blocking assembly from a first arrangement to a second arrangement may be 20%. This will increase the pressure differential across the blocking assembly by about 44%.

The blocking assembly may be configured to move from the first arrangement to the second arrangement in response to an increase in the pressure differential across the blocking assembly. The percentage pressure differential increase to move the blocking assembly may be of substantially any value which would be achievable in a downhole scenario using known pumps and operating limits. As such, the following ranges are examples. The blocking assembly may be configured to move from the first arrangement to the second arrangement in response to an increase in the pressure differential across the blocking assembly of between 30% and 60%; 35% and 55%; 40% and 50%; or 42% and 46%. A 30% increase in the flow rate will increase the pressure by 69%, a 40% increase in the flow rate will increase the pressure by 96% and a 50% increase in the flow rate will increase the pressure by 125%. The required increase in flow rate for providing these increases in pressure differentials can be obtained by finding the square root of the corresponding pressure differential increase.

As an example for illustration, a flow rate for maintaining the blocking assembly in the first arrangement may be about 60 litres/s (950 US gpm) in a 12¼" drill bit. The change in the flow of drilling fluid through the drill bit may be to increase the flow rate of drilling fluid through the drill bit to 72 litres/s (1141 US gpm).

Increasing the flow of drilling fluid through the drill bit may be implemented at the surface by a user.

The change in the flow of drilling fluid through the drill bit may be to increase or reduce the volumetric flow rate of used drilling fluid taken out of the well bore—i.e. increase or reduce the flow of drilling fluid out of the drill bit.

The blocking assembly may be configured to move from the first arrangement to the second arrangement when a pressure differential across the blocking assembly reaches a threshold value. The threshold value may be selected as substantially any practical pressure value achievable in downhole operations. When selecting the value for the threshold pressure, the desired pressure drop across downstream components of the drill bit must be considered. The following ranges are provided as examples of possible threshold values. The threshold value may be within the range of 0 to 3450 kPa (0 to 500 psi)—although naturally higher values are still possible. The threshold value may be in the range of 690 to 2760 kPa (100 to 400 psi) or 7-27 bar. The threshold value may be within any of the following ranges: 600 to 1800 kPa, 900 to 1800 kPa, 1200 to 1500 kPa, or 1300 to 1450 kPa. The threshold value may be greater than any one of the following: 500, 600, 700, 800, 900, 1000, 1200 and 1400 kPa.

The blocking assembly may be configured to move from the first arrangement to the second arrangement when the pressure differential across the blocking assembly (i.e. from an upstream side to a downstream side) is within any of the above-listed ranges.

As an example, the blocking assembly may be configured to move from the first arrangement to the second arrangement when the pressure drop across the blocking assembly is about 1380 kPa (about 200 psi).

The blocking assembly may alternatively be moved from the first to the second position electrically or mechanically. The blocking assembly may be flow activated or electronically activated.

The deployable blade assembly may move from the first position to the second position in response to a change in the flow of drilling fluid through the drill bit. The deployable blade assembly may be configured to move from the first position to the second position under the action of fluid pressure. The deployable blade assembly may be configured to move from the first position to the second position in response to the blocking assembly moving to the second arrangement. The deployable blade assembly may be configured to move from the first position to the second position in response to the blocking assembly moving to the second arrangement and causing a pressure differential across the deployable blade assembly to increase to a deployment value. The pressure differential may be provided by the flow of drilling fluid through the drill bit.

The deployable blade assembly may be configured to move from the first to the second position when the pressure differential, or pressure drop, across the deployable blade assembly (or a part thereof) reaches a threshold value known as the deployment value. The pressure drop may be from an upstream end of the deployable blade assembly to a downstream end. The pressure differential across the deployable blade assembly may create a resultant axial force acting on the deployable blade assembly and this axial force may move the deployable blade assembly from the first to the second position.

The change in flow of drilling fluid through the drill bit may be, or may cause, the pressure differential across the deployable blade assembly to reach a deployment value (discussed below). A user may increase the flow rate of drilling fluid which may, in turn, increase the pressure gradient across the deployable blade assembly to the deployment value. For example, an example may not include a blocking assembly and may instead increase the flow rate of drilling fluid through the drill bit until the pressure gradient reaches a deployment value, as which point the deployable blade assembly is moved from the first to the second position. As with embodiments described below, the deployable blade assembly may be restrained in the first position by a shear ring, for example, which may be configured to break at a specific value which defines the deployment value.

The deployable blade assembly may be configured to move from the first position to the second position under the action of fluid pressure in response to the change in the flow of drilling fluid through the drill bit. Such an arrangement may remove the necessity for having a blocking assembly which blocks a flow path through the device, thus reducing the pressure rise associated with such an embodiment.

All of the comments below relating to the change in the flow of drilling fluid through the drill bit apply equally to when the change in flow through the drill bit effects the movement of the blocking assembly from the first to the second arrangement, and the movement of the deployable blade assembly from the first to the second position. Equally, all of the comments below relating to the restraint, release, subsequent movement and locking of the deployable blade assembly apply regardless of whether a blocking assembly (or actuation mechanism) is present.

The blocking assembly moving to the second arrangement may create an increase in the pressure differential across the deployable blade assembly (or a part thereof). The blocking assembly moving to the second arrangement may therefore cause the resultant force acting on the deployable blade assembly to increase to a threshold value for the deployable blade assembly—the deployment value, moving the deployable blade assembly from the first to the second position. It should be noted that the threshold value for the deployable blade assembly is referred to herein as the deployment value in order to avoid confusion with the threshold value for moving the blocking assembly from the first to the second position (which is referred to herein as the threshold value).

The deployable blade assembly may be configured to move from the first position to the second position when a pressure differential across the deployable blade assembly reaches a deployment value. The deployment value may be selected as substantially any practical pressure value achievable in downhole operations. When selecting the value for the deployment pressure differential, the desired pressure drop across upstream and downstream components of the drill bit must be considered. The following ranges, relating to the deployment value and the increase in pressure gradient caused by the movement of the blocking assembly to the second arrangement are provided as examples of possible deployment values.

The deployment value may be in the range of 3450 to 10350 kPa (500-1500 psi)—although naturally higher values are still possible. The deployment value may be within any of the following ranges: 3000 to 7000 kPa; 4000 to 6000 kPa; 4500 to 5500 kPa; 4950 to 8850 kPa, 5500 to 8300 kPa, 6200 to 7600 kPa, or 6800 to 7000 kPa.

The increase in the pressure differential across the deployable blade assembly caused by the blocking assembly moving to the second arrangement may be within the range of 1400 to 8300 kPa (200 to 1200 psi) or within any of the above-mentioned ranges. The increase in the pressure differential across the deployable blade assembly caused by the blocking assembly moving to the second arrangement may be within any one of the following ranges: 3000 to 4600 kPa; 3350 to 4250 kPa; or 3700 to 3900 kPa.

The deployable blade assembly may be configured to move from the first position to the second position when a pressure differential across the deployable blade assembly is greater than a value equal to any one of the following: 2000 kPa, 2500 kPa, 3000 kPa, 3500 kPa, 4000 kPa, 4500 kPa, 5000 kPa, 5500 kPa, 6000 kPa, 6500 kPa, 7000 kPa, 8000 kPa, 9000 kPa or 10000 kPa.

The deployable blade assembly may be configured to move from the first position to the second position when the pressure differential across the deployable blade assembly is within any one of the above-stated ranges.

The deployment value may refer to a pressure differential across the piston (see below) of the deployable blade assembly. Accordingly, the deployable blade assembly may be configured to move from the first position to the second position when a pressure differential across the piston reaches a deployment value. The above comments relating to exemplar values for the deployment value may apply equally when the pressure drop is measured across the piston, rather than the entire deployable blade assembly.

The blocking assembly and/or deployable blade assembly may be configured such that once the deployable blade assembly starts moving from the first position to the second position, the pressure differential across the deployable blade assembly starts to decrease. That is, the blocking assembly and/or deployable blade assembly may be configured such that fluid flow through the flow path is only restricted for a short period of time. In an example, the blocking assembly may only restrict fluid flow through a flow path when the deployable blade assembly is in the first position. When the deployable blade assembly moves from the first position, fluid flow through the flow path may no longer be restricted.

The drill bit may comprise a drilling fluid inlet at an upstream end of the drill bit.

The inlet may comprise an internal bore of the drill bit and may be connected to a further downhole assembly component. The drill bit may comprise a plurality of drilling fluid inlets.

The drill bit may comprise a plurality of drilling fluid outlets located downstream of the inlet.

Fluid outlets may be located on the end face of the drill bit (e.g. on the end face of the outer housing), on a curved side wall of the drill bit (e.g. the outer housing), or both. Fluid outlets may be located in, on, or as part of, the primary cutting structure (which may be located on an end face of the drill bit). Fluid outlet(s) may be arranged in the primary or deployable cutting structure. Fluid outlet(s) may be arranged upstream of the primary and/or deployable cutting structure. Fluid outlet(s) may be arranged between the blocking assembly and the deployable blade assembly; that is downstream of the blocking assembly and upstream of the deployable blade assembly.

Including fluid outlets at a location remote from a drilling surface (e.g. on a curved side wall of the drill bit) may increase the maximum operating flow rate of drilling fluid, both before and after the deployable blade assembly has been deployed.

An (or each) outlet may comprise a valve or nozzle, for controlling flow of drilling fluid through the outlet. A valve may throttle fluid flow through the outlet. Valves may be fixed relative to the outer housing or the deployable blade assembly, depending on where the outlet is located. Including a valve in an outlet may allow the pressure on the inlet-side of the valve to be controlled and may thus allow an increased pressure to be maintained on the inlet-side of a specific outlet.

Throughout the present disclosure, a nozzle may be used in place of a valve and discussion relating to a valve applies equally to a nozzle.

The flow path may connect the inlet to an outlet.

The drill bit may comprise a plurality of flow paths, each connecting the (or an) inlet to an outlet. The blocking assembly may be configured to restrict flow through only one, or a plurality of, the flow paths, but not all flow paths through the drill bit.

The drill bit may comprise a ratchet. The ratchet may be a ratchet sub-assembly. The ratchet may be a ratchet ring sub-assembly. The ratchet may be a body lock ring. The ratchet may be located between the outer housing and the deployable blade assembly. The ratchet may be configured to allow movement of the deployable blade assembly towards the second position. The ratchet may be configured to resist movement of the deployable blade assembly away from the second position towards the first position.

The ratchet may be configured to only allow movement of the deployable blade assembly in one direction. That direction may be towards the primary cutting structure or cutting plane.

The ratchet may be integral or connected to the outer housing. The ratchet may be integral or connected to the deployable blade assembly.

The ratchet may assist in holding the deployable blade assembly in the second position, or in a position that is towards the second position. The ratchet may act as a back-up, or supporting, locking mechanism, in order to assist a lock in holding the deployable blade assembly in the second position. If the deployable blade assembly is not able to fully deploy to the second position, due to a blockage for example, the ratchet may be used to hold the deployable blade assembly in a partially deployed state. Alternatively, the ratchet may be used to control vibrations of the deployable blade structure in an axial direction.

The ratchet may comprise a first sleeve fixed relative to the outer housing and comprising a serrated internal surface. The ratchet may further comprise a second sleeve fixed relative to the deployable blade assembly comprising a serrated external surface. The second sleeve may be arranged to engage with the internal surface of the first sleeve.

The ratchet may comprise two engaging serrated sleeves. The serrations may be shaped so as to allow respective movement in one direction, but not the other. That is, the two serrated surfaces may be able to slide over one another in one direction, but not the other.

The serrations may have a saw-tooth profile with a straight face and an angled face. The straight edge may be perpendicular to the axis of the drill bit. The angled edge may be arranged at an oblique angle to the axis of the drill bit. The following geometries are provided as examples for the saw-tooth profile. The angle between the drill bit and the angled edge may be between 0 and 45 degrees; 15 and 75 degrees; 25 and 65 degrees; 20 to 55 degrees; or 40 and 50 degrees. The angled edge may be arranged at about 30 or 45 degrees to the axis of the drill bit.

The serrations may have a flat top—that is, the straight edge and angled edge may not meet at a point.

The serrations may be formed by a series of circular grooves formed in the respective surfaces of the sleeves. The serrations may alternatively be formed by a single helical groove formed in the respective surfaces of the sleeves.

One of the first and second sleeves may comprise an axial split permitting deformation of the sleeve. The axial split may facilitate easier relative movement of the two sleeves in the permitted direction, as one of the sleeves can deform in order to "move over/under" the other sleeve.

The first and second sleeves may comprise between 1 and 10, 20, 30, 40 or 50 serrations. The first and second sleeves may comprise between 10 and 50, 20 and 40 or 20 to 30 serrations along their length.

The drill bit may further comprise a deformable release arranged between the outer housing and the deployable blade assembly. The deformable release may form part of the actuation mechanism and/or the deployable blade assembly. A first part of the deformable release may be fixed with respect to the outer housing and a second part of the deformable release may be fixed with respect to the deployable blade assembly. The deformable release may engage both the outer housing and the deployable blade assembly. The deformable release may restrain the deployable blade assembly in the first position. The deformable release may be configured to deform (e.g. break between the first and second parts) such that the deployable blade assembly can move with respect to the outer housing when a pressure differential across the deployable blade assembly reaches the deployment value. The deformable release may be configured to deform and release the deployable blade assembly with respect to the outer housing when a pressure differential across the deployable blade assembly reaches a deployment value.

In order to facilitate movement of the deployable blade assembly at a certain time (e.g. when the pressure gradient/resultant force reaches the deployment value) but not before, the drill bit may comprise a deformable release to hold the deployable blade assembly in the first position and then release the deployable blade assembly when the necessary condition is met.

In the present disclosure the term deform is used to describe bending, shrinking, expanding, tearing, shearing or any other form of breaking.

The deformable release may retain its structural integrity up until the point that the pressure differential across the deployable blade assembly (or piston thereof, for example) reaches the deployment value, at which point the resultant stresses in the deformable release cause the deformable release to break, shear or bend, releasing the deployable blade assembly.

The deformable release may be a shearable or breakable member, for example a shear pin, shear ring, or a frangible screen or member. The deformable release may determine the deployment value—that is, the pressure drop at which the deployable blade assembly leaves the first position.

The deformable release may be a shearable screw (e.g. a bolt configured to break when exposed to a certain tensile loads). The deformable release may be a threaded connector configured to break at a predetermined tensile load. The shearable screw may be arranged axially within the drill bit (or actuation mechanism of which it forms a part). The shearable screw may be arranged offset from the centre axis of the drill bit or actuation mechanism.

A first part of the shearable screw (e.g. the head) may be fixed relative to the outer housing by being inserted through a hole which is fixed relative to the outer housing. A second part of the shearable screw (e.g. the tip) may be fixed relative to the deployable blade assembly (e.g. the piston) by being screwed into a threaded hole formed therein.

The tool, e.g. drill bit, may comprise a support cylinder fixed with respect to the outer housing. A shearable screw may be inserted through a hole in the support cylinder axially and screwed into a threaded hole in the piston of the deployable blade assembly. The shearable screw may be arranged to hold the deployable blade assembly in the first position (against the action of fluid flowing through the tool), until the pressure gradient (and thus resultant force) across the deployable blade assembly reaches a threshold value, at which the screw breaks and the deployable blade assembly is free to move to the second position.

The deformable release may be made from any material which deforms at a suitable load for use with the drill bit. Example materials may include metals, alloys or polymers such as plastics.

The deformable release may be a shear ring. The shear ring may comprise a first ring fixed with respect to the outer housing. The first ring may be connected by a breakable region to a second ring, which may be fixed with respect to the deployable blade assembly. The shear ring may be arranged such that, as the pressure differential across the deployable blade assembly increases, axial stresses in the breakable region increase.

The shear ring may be configured such that the breakable region breaks, separating the first and second rings, when the pressure differential across the deployable blade assembly reaches a deployment value. At this point, the axial stresses in the axial stresses in the breakable region may have reaches the fracture strength of the material.

The pressure differential across the deployable blade assembly reaching a deployment value may therefore cause the force across the breakable region to reach a breaking force. The material, size and shape of the shear ring (e.g. the diameter and thickness of the breakable region) may be selected such that the axial stresses in the breakable region reach the level required for the material to deform—e.g. break—as the pressure differential reaches the deployment value.

The breakable region may be a band of material connecting the first and second rings with a thickness smaller than that of the rings. The shear ring may be arranged such that the breakable region comprises a tube of material extending in an axial direction, located between the outer housing and the deployable blade assembly, such that a pressure drop across the deployable blade assembly results in axial forces in the tubular breakable region.

A drill bit may comprise a lock arranged to hold the deployable blade assembly in the second position. A downhole tool or actuation mechanism according to the disclosure may comprise a lock arranged to hold the first structure in the second position.

Once the deployable blade assembly is in the second position, the deployable cutting structure may be engaging a material to be cut. Cutting a material, for example a formation, results in a lot of axial and torsional dynamic forces being applied to the cutting structure. Accordingly, the drill bit may comprise a lock to hold the deployable cutting structure in the second position and prevent it from being forced away from the second position, towards the first position, by cutting forces.

The lock may comprise an engagement member in one of the outer housing and the deployable blade assembly. The engagement member may be biased towards the other of the outer housing and the deployable blade assembly. The lock may further comprise a recess arranged on the other of the outer housing and the deployable blade assembly. The recess may be arranged to receive the engagement member (e.g. a part thereof) when the deployable blade assembly is in the second position.

The lock may comprise a member arranged to engage both the outer housing and deployable blade assembly when the deployable blade assembly is in the second position. The member may engage a recess or a detent in each of the outer housing and the deployable blade assembly. Biasing the engagement member towards an engaged position will allow the lock to automatically engage once the deployable blade assembly reaches the second position.

The lock may comprise a pin. The pin may be housed in the outer housing and biased towards the deployable blade assembly. The deployable blade assembly may comprise a recess, arranged to receive the end of the pin when the deployable blade assembly is in the second position, such that the pin spans the interface between the outer housing and the deployable blade assembly and extends into both, preventing relative axial movement thereof.

The deployable blade assembly may comprise a piston. The piston may be located within the outer housing.

The piston may be arranged to move axially within the outer housing. A seal, or a plurality of seals, may be located between the piston and the outer housing to prevent fluid from passing between the piston and the outer housing.

The piston may comprise a plurality of fluid outlets. A, or a plurality of, fluid outlets may be located in an axial end face of the piston or a curved side face of the piston. The piston may comprise a plurality of passageways or flow paths therethrough. One, or a plurality, of these flow paths may be the flow path that is blocked by the blocking assembly.

The deployable blade assembly may comprise valves or nozzles for outputting drilling fluid from the drill bit. A valve may be located in an, or each, outlet. The valves may be arranged in flow paths. The valves may be arranged to output drilling fluid of an axially-facing end face of the drill bit, or from a radially-facing side face of the drill bit. The valves may be arranged to output drilling fluid axially or radially from the drill bit.

The drill bit may comprise valves or nozzles in outlets in the primary and or deployable cutting structures. The drill bit may comprise valves or nozzles in outlets which are located upstream of the primary and/or deployable cutting structures.

The piston may comprise a central region for receiving drilling fluid from the drill bit inlet. The central region may be a cavity. The central region may comprise a plurality of openings leading to flow paths through the piston.

The deployable blade assembly, or the piston thereof, may comprise, or define, an occluding member seat for receiving an occluding member (see below). The seat may be located in the flow path, the flow through which is restricted by the blocking assembly. The seat may be located in the cavity. The occluding member seat may be arranged in the flow path for supporting the occluding member in the second arrangement. The deployable blade assembly may comprise a flow path opening and the seat may be located in the flow path opening. The seat may be arranged upstream of an opening in the piston to the flow path blocked by the blocking assembly. The seat may be arranged downstream of other passageways or flow paths leading to outlets, such that drilling fluid may flow through these outlets, regardless of whether the occluding member is located in the seat and restricting flow through the respective flow path.

The seat may be arranged such that, when the occluding member is located in the seat, the flow through only one of the flow paths from the inlet to an outlet is affected.

The deployable blade assembly may comprise a blade. The blade may be connected to the piston. The deployable blade assembly may comprise a plurality of blades.

It should be noted that where singular language is used to refer to a feature of which there may be a plurality in the drill bit, it is to be understood that the comments apply equally to one, the, some of, or each, of the feature. For example, when a feature is described in relation to "the blade", the feature also applies equally to "one of" the blades, "some of" the blades and "each of" the blades.

The blade may be substantially cuboidal, with a thin depth and a much larger width and length (which is arranged parallel to the axis of the drill bit). The blades may comprise, or be made out of, AISI 4330V steel at 1030000 kPa (150,000 psi) Yield Strength, for example.

The blade may be substantially 'L'-shaped when viewed along the longitudinal axis of the drill bit.

The blade may be connected to the piston by means of a retention pin. The retention pin may be arranged to prevent the blade moving axially, or radially, with respect to the rest of the deployable blade assembly. The blade and blade retention pins may be configured to withstand all of the drilling forces arising from use of the deployable cutting structure to drill. The pins may be made of metal or a metal alloy, for example steel or a steel alloy.

The blade retention pins may comprise or be made from AISI 4330V with about 1030000 kPa (150 000 psi) Yield Strength in order to withstand all of the forces experienced during drilling. The retention pins may be configured to have clearance between the pins and the blades and/or rest of the deployable blade assembly such that no axial forces are applied to the pins from the blades under weight-on-bit or axial compression. The pins may however stop the blades being pulled out of the body under tensile drag, for example.

The blade and piston may be arranged to move axially with respect to the outer housing.

The deployable blade assembly may be arranged to move parallel to a longitudinal axis of the drill bit.

The piston and blade of the deployable blade assembly may be arranged to move parallel to a longitudinal axis of the drill bit from the first position to the second position. The piston and blade of the deployable blade assembly may be arranged to only move parallel to the axis of the drill bit.

The (longitudinal) axis may extend along the centreline of the drill bit. The longitudinal axis may be substantially perpendicular to the cutting plane.

The piston and/or blade(s) may (only) move parallel to the longitudinal axis of the drill bit. This means that the blade does not move radially. As such, the cutting diameter defined by the deployable cutting structure may not expand as the deployable blade assembly moves from the first to the second position and the cutting diameter defined by the drill bit may be same before and after the deployable blade assembly moves from the first to the second position.

The blade may be arranged substantially radially when viewed along the longitudinal axis of the drill bit.

The deployable blade assembly may normally comprise any number of blades from 1 to 12 (for example 3, 4, 5 or 6 blades). The deployable blade assembly may comprise 4 blades which may be arranged rotationally from each other such that they extend substantially radially when viewed along the longitudinal axis of the drill bit.

The blade may comprise a key, protruding from a surface of the blade. The key may be arranged to restrict the blade to axial movements with respect to the outer housing, parallel to the longitudinal axis of the drill bit.

The key may comprise an elongated bump or ridge along an axially-extending surface of the key. Alternatively, the key may comprise a groove or slot. The key may be arranged to engage a complementary groove or ridge in the outer housing or other component of the drill bit.

The blade may be located within an axially-extending slot which is fixed with respect to the outer housing. The blade may be arranged to move axially within the slot from a first position to a second position.

The slot and blade (or, for example, a key on a blade) may be arranged to prevent radial movement of the blade.

The deployable cutting structure may be level with, or extend out from, the primary cutting structure in an axial direction when the deployable blade assembly is in the second position.

The primary and deployable cutting structures may comprise a plurality of cutting inserts. The cutting inserts may be for cutting rock, steel casing or other downhole materials. A blade may comprise a plurality of cutting inserts.

The cutting inserts on both the primary and deployable cutting structures may be arranged so as to cut across the entire diameter of the cutting structures. That is, cutting inserts may be located on the cutting structures extending from the centre of the cutting surface to the outer radius of the cutting structure.

Alternatively, cutting inserts on the deployable cutting structure may be located only towards the outside of the axial face of the cutting structure—for example on the outer half, third or quarter of the cutting structure, towards the outer circumference of the cutting structure (the axial face is a face substantially perpendicular to the axis of the drill bit). The deployable cutting structure may comprise a ring of cutting inserts located spaced from the axis of the drill bit. The deployable cutting structure may comprise a centre circle located around the axis of the drill bit in which in which no cutting inserts are located.

During use, as the drill bit is rotating, the cutting inserts located at larger radiuses from the axis of the drill bit move faster than those towards the centre (located at smaller radiuses). Accordingly, they may wear down faster. A deployable cutting structure may therefore be for replacing worn cutting inserts and may therefore only be needed towards the outside of the cutting structure, as the cutting inserts towards the centre may not be worn to the same degree.

When the deployable blade assembly is in the second position, the deployable cutting inserts and/or the deployable cutting structure may be level with, or protrude/extend from, the primary cutting inserts and/or the primary cutting structure, respectively, in an axial direction of the drill bit.

The deployable blade assembly, deployable cutting structure and/or the plurality of cutting inserts forming the deployable cutting structure may define a deployable cutting plane. When the deployable blade assembly is in the second position, the deployable cutting plane may be coplanar with, or extend out from (i.e. further from the centre of mass of the drill bit than) the cutting plane of the primary cutting structure.

The term extending out from refers to a location which is axially displaced in a direction away from the centre of mass of the drill bit.

The blades may be arranged to radiate or extend out from the centre of the drill bit—i.e. the centre of the deployable cutting structure. The deployable cutting inserts may be arranged in rows to radiate out from the centre of the drill bit—i.e. the centre of the deployable cutting structure. The cutting inserts may be arranged to have a positive or negative rake angle.

The deployable cutting structure may be a cut-depth reduction surface. The deployable cutting structure may be recessed with respect to the primary cutting structure in an axial direction when the deployable blade assembly is in the second position.

The deployable cutting structure may comprise a plurality of ovoid inserts. The ovoid inserts may be smooth protrusions configured to abut rock or downhole material, rather than cut it. Ovoid inserts may be used in place of cutting inserts when the deployable cutting structure is used as a cut-depth reduction surface. The ovoid inserts may be domed inserts. The domed inserts which may be non-cutting and deployment could result in reducing the depth of cut of the primary cutting structure when the tips of the domes are located in an axial direction between the tips of the primary cutters and the base material in which they are located when the moveable structure is deployed.

The deployable cutting structure may be configured to move closer to the primary cutting structure when moving from the first to the second position, such that the cut depth of the primary cutting structure is reduced when the deployable blade assembly is in the second position compared to when the deployable blade assembly is in the first position.

The primary cutting structure may comprise a first profile. The deployable cutting structure may comprise a second profile. The primary cutting structure may define a first profile when viewed in a cross-section parallel or perpendicular to the axis of the drill bit. The deployable cutting structure may comprise a second shape when viewed in a cross-section parallel or perpendicular to the axis of the drill bit. The two different shapes of the cutting structures may provide different cutting characteristics and may be optimised for cutting different materials, or at different speeds, or with different torques.

The blocking assembly may comprise an occluding member. The blocking assembly may comprise a restraint. The restraint may be configured to hold the occluding member in the first arrangement. The restraint may be configured to release the occluding member in response to the change in the flow of drilling fluid through the drill bit. The restraint may be configured to release the occluding member in response to the change in the flow of drilling fluid through the drill bit such that the occluding member can move from a non-occluding position in the first arrangement to an occluding position in the second arrangement. In the occluding position, the occluding member may restrict flow through the flow path (e.g. prevent fluid from flowing through the flow path).

The occluding member may be configured to move from a non-occluding to an occluding position. In the occluding position, the occluding member may be arranged to restrict (e.g. prevent) flow of drilling fluid through the flow path.

The occluding member may be configured to be moved by the flow of drilling fluid from the first to the second arrangement.

The restraint may be fixed with respect to the outer housing and may be configured to hold the occluding member in a non-occluding position (i.e. the first arrangement).

The blocking assembly (e.g. the occluding member thereof) may be located across a flow path or passageway through the drill bit when in the first arrangement. There may be a plurality of flow paths or passageways through the drill bit and the blocking assembly (e.g. the occluding member thereof) may be located across one of these flow paths or passageways such that a pressure drop is created across the blocking assembly. Although the blocking assembly or occluding member thereof may be located across a flow path when in the first arrangement, it is to be understood that this does not correspond to an occluding position, as flow through the flow path which is later blocked is not restricted. The pressure differential across the blocking assembly may apply a force to the restraint and/or occluding member. The force may be in a direction from the first arrangement to the second arrangement.

The restraint may be configured to resist the force applied to the occluding member/restraint/blocking assembly and hold the occluding member in the non-occluding position until the flow of drilling fluid through the drill bit is changed (e.g. until the pressure differential across the blocking assembly reaches the threshold value), at which time the restraint may be configured to release the occluding member such that it can move to the occluding position under the action of fluid flow.

The restraint may be electrically operated, such that it can be selectively engaged and disengaged to hold and release the occluding member, respectively. A downhole or topside electrical system, connected to the restraint, may be required to facilitate such operation. The downhole electronic assembly may include a power supply, a processor, memory, at least one motion sensor (e.g. accelerometers). The memory (e.g. a storage unit) may store instructions (e.g. a firmware programme). The programme may be configured, when executed by the processor, to move the blocking assembly to a blocking arrangement when a certain signal is received. The signal may comprise or be triggered by a certain sequence of different drill-string rotational speeds (e.g. including 0 rpm) sensed by the motion sensor. This type of electronic design may not require any wires running back to surface.

At least one of the restraint and the occluding member may be configured to deform in response to the change in the flow of drilling fluid through the drill bit, such that the occluding member is released. The restraint or the occluding member may be configured to deform in order for the restraint to release the occluding member.

The restraint (or a part thereof) may be configured to deform either by bending, expanding or breaking, such that the occluding member is no longer held in the first position.

When the restraint deforms, it may move from a position in which the occluding member is held in the first arrangement to a position in which the occluding member is no longer held in the first arrangement. The restraint may therefore deform from a restraining arrangement to a non-restraining arrangement.

The restraint may comprise, for example, a deformable fastener. The restraint may comprise a breakable fastener. Examples of such fasteners may include shear pins, shear bolts and shear rings. The deformable fastener may be configured to deform (e.g. break) in response to the change in the flow of drilling fluid through the drill bit, releasing the occluding member. Once deformed, the fastener may no longer hold the occluding member in the first arrangement. The restraint may be a threaded connector configured to break at a predetermined tensile load.

A first part of the restraint may be fixed with respect to the outer housing. A second part of the restraint may be fixed with respect to the occluding member. The restraint may be configured to break in response to a change in the flow of drilling fluid through the drill bit. The restraint may be arranged axially within the actuation mechanism or drill bit.

A first part of the shearable screw (e.g. the head) may be fixed relative to the occluding member by being inserted through a hole in the occluding member. A second part of the shearable screw (e.g. the tip) may be fixed relative to the outer housing by being screwed into a threaded hole in the outer housing or a support cylinder which is fixed relative to the outer housing.

The occluding member may be arranged to move axially within the drill bit from the first arrangement to the second arrangement. Axial movements refer to movements which are parallel to the axis of the drill bit. The occluding member may be restricted to axial movement within the outer housing.

The drill bit may comprise a guide. The guide may be arranged parallel to the axis of the drill bit. The blocking assembly (or restraint) may comprise a guide. The guide may comprise a track. The guide may be in the form of an elongate member, for example a pin, screw, bar and tube.

The occluding member may be arranged to be movable (e.g. to translate, or slide) within the outer housing, along the guide. The occluding member may be arranged to move axially from the first arrangement to the second arrangement, along the guide.

The occluding member may slidingly engage one of the outer housing or deployable blade assembly such that the occluding member is arranged to move axially (e.g. along the axis of the drill bit) from the first arrangement to the second arrangement. The occluding member may slidingly engage a guide of one of the outer housing or deployable blade assembly.

The occluding member may be an occluding rod. The rod may be arranged to extend along the axis of the drill bit within the outer housing. The rod may comprise a shoulder which defines a transition from a first to a second diameter. The shoulder may be defined by a radially extended circumferential protrusion or disc, for example a piston head. The occluding member may define a plurality of shoulders. The shoulder(s) may be configured to restrict the flow of fluid through a flow path when the blocking assembly moves to the second arrangement.

The flow path may be arranged to pass through the deployable blade assembly and may comprise a tapered section or section of reduced diameter. The tapered section may define the occluding member seat. The rod may be configured to move from a first arrangement to a second arrangement, in which the shoulder of the rod abuts the tapered section to restrict flow through the flow path.

The flow path may comprise a cylindrical section arranged parallel to the axis of the drill bit. The tapered section may lead to the cylindrical section. The occluding rod may comprise a support arm which is arranged in sliding engagement with the cylindrical section such that the occluding rod is movable along the axis of the cylindrical section, parallel to the axis of the drill bit, from the first to the second arrangement. The occluding rod may comprise a first and second support arm, each of which may be arranged in a sliding engagement with a cylindrical section of the flow path, deployable blade assembly or outer housing, such that the occluding rod is movable along the axis of the cylindrical section, parallel to the axis of the drill bit, from the first to the second arrangement.

An opening in the cylindrical section may allow fluid to pass from the cylindrical section towards the outlet. The occluding rod may comprise a neck section of smaller outer diameter than the cylindrical section, such that fluid can flow past the occluding rod and out of the opening when the occluding rod is in the first arrangement.

The deformable fastener may pass through the occluding rod, or be attached thereto. The deformable faster may also be fixed with respect to the outer housing. The deformable fastener may pass through a tab of the occluding rod and extend into a hole which is fixed with respect to the outer housing.

When the flow of fluid through the drill bit changes, the deformable fastener may break, releasing the occluding rod. The occluding rod, under the action of fluid flow through the drill bit and restricted to axial movement by the engagement of the support arm and cylindrical section may move axially within the outer housing from the first arrangement to the second arrangement. In the second arrangement, the occluding rod may be arranged within the cylindrical section such that the shoulder of the rod abuts the tapered section and restricts fluid flow through the tapered section and the cylindrical section.

When in the second arrangement (the occluding position) the occluding member may move with the deployable blade assembly when the deployable blade assembly moves from the first to the second position. The occluding member may be in an occluding position (and thus restrict flow through, or prevent flow through the flow path) while it moves with the deployable blade assembly, and may stay in an occluding position once the deployable blade assembly is in the second position.

Alternatively, the occluding member may not move with the deployable blade assembly. As such, the occluding member (and blocking assembly in general) may stay in a second arrangement while the deployable blade assembly moves to the second position. This may allow a flow path through which fluid was restricted by the blocking assembly to again open up, such that fluid flow therethrough is again unrestricted when the deployable blade assembly is in the second position.

The drill bit (or the blocking assembly or deployable blade assembly thereof) may comprise an abutment. The abutment may be arranged as a detent, and may be arranged to abut or engage the occluding member as it moves with the deployable blade assembly from the first position of the deployable blade assembly to the second position of the deployable blade assembly. The abutment may stop the occluding member. The abutment may engage and restrain the occluding member when the deployable blade assembly moves from the first to the second position. The abutment may be arranged to contact a shoulder of the occluding member.

The abutment may be arranged to prevent the occluding member from moving with the deployable blade assembly as the deployable blade assembly moves from the first to the second position. The abutment may be arranged to prevent the occluding member from being in an occluding position when the deployable blade assembly is in the second position.

The abutment may be arranged to abut the occluding member shortly after the deployable blade assembly and occluding member being moving. The abutment may be arranged to abut the occluding member after it has moved about 6, 12 or 25 mm with the deployable blade assembly.

The abutment may be arranged such that the flow of drilling fluid through the drill bit holds the occluding member against the abutment during subsequent operation of the drill bit.

The drill bit or actuation mechanism may comprise a guide cylinder. The guide cylinder may be arranged concentrically within and fixed with respect to a support cylinder or the outer housing. The guide cylinder may be arranged concentrically around the occluding member. The guide cylinder may guide the axial movement of the occluding member. The guide cylinder may define the abutment, which may be arranged to restrict the axial movement of the occluding member. The abutment may comprise a radially inward projecting flange. The abutment may be arranged to abut a shoulder of the occluding member when, or shortly after, the blocking assembly moves to the second arrangement.

The occluding member may comprise a ridge, protrusion or shoulder. The abutment may comprise a ridge, protrusion or shoulder which is arranged to abut the ridge, protrusion or shoulder of the occluding member during movement of the occluding member, as discussed above. The abutment may be a pin.

The occluding member may be a ball. The occluding member may comprise metal, a metal alloy, or a polymer such as a plastic. The occluding member may comprise steel or a polymer such as PEEK.

The restraint may comprise a gate arranged to hold the occluding member in the non-occluding position when in the first arrangement. The restraint may further comprise a fastener configured to hold the gate in the first arrangement. The fastener may be configured to deform in response to a change in the flow of drilling fluid through the drill bit, releasing the gate and occluding member to move to the second arrangement.

The gate may be a hinged gate, fixed with respect to the outer housing by means of a hinge. The gate may be arranged to be rotatable about the hinge.

The gate may be arranged to move longitudinally within the drill bit. The gate may slidingly engage one of the outer housing or deployable blade assembly such that the gate is arranged to move axially (e.g. along the axis of the drill bit) from the first arrangement to the second arrangement.

The gate may be arranged to be movable (e.g. to translate, or slide) within the outer housing, along the guide. The guide may be arranged parallel to the axis of the drill bit. The fastener may be a breakable fastener configured to break in response to the change in the flow of drilling fluid through the drill bit. The gate may be arranged to move from the first arrangement to the second arrangement, along the guide, to release the occluding member, when the fastener breaks.

The gate may be arranged to close off a passageway/flow path through a part of the drill bit. The ball may be located on the upstream side of the passageway/flow path and be unable to move downstream. The fastener may be arranged to hold the gate in a closed arrangement. The fastener may be fixed with respect to both the gate and the outer housing.

The gate may be arranged to move from the first arrangement to the second arrangement under the action of fluid flowing through the drill bit.

The gate may be in the form of a door, panel or a plug, arranged to restrict fluid flowing through a passageway or a portion thereof of the drill bit.

The fastener may be configured to break in response to a change in the flow of drilling fluid through the drill bit. The fastener may comprise a breakable member, such as a shear pin, a shear bolt, a shear screw or a shear ring. The fastener may be configured to snap, bend or shear when the pressure differential across the occluding position reaches the threshold value, releasing the gate, which is then free to move or rotate, which in turn may release the occluding member to move to the occluding position under the action of the flow.

The fastener may comprise a metal or a polymer.

The fastener may be fixed with respect to both the outer housing and the gate. The fastener may be fixed by means of a mechanical attachment and/or a chemical adhesive, such as a thread and a chemical adhesive to stop the thread backing out with vibration.

The blocking assembly may be configured to move from the first arrangement to the second arrangement when the pressure differential across the blocking assembly is within a range of about 690 to 2760 kPa (100 to 400 psi), for example about 1380 kPa (200 psi).

As an example arrangement, for a passageway bore of about 70 mm (2.75 inches) which is blocked by a gate which is rotatable about a hinge: the area is 3832.25 $mm^2$ (5.94 sq. ins). For a pressure differential of about 1380 kPa (200 psi) when the blocking assembly moves from the first to the second arrangement, the force on the gate is about 539 kg (1188 lbs). If the hinge of the gate is about 73 mm (2.875 inches) from the centre and the fastener is about 54 mm (2.125 inches) from the centre, the fastener failure load is about 310.7 kg (0.577×1188=685 lbs). For a fastener with an ultimate tensile strength of about 345000 kPa (50,000 psi), the diameter of the fastener should be about 3.35 mm (0.132 inches).

The drill bit may further comprise a latch to hold the gate in the second arrangement.

The latch may be configured to receive and maintain the gate in the second arrangement—that is when the gate is open and the occluding member has been released. The latch may be fixed with respect to the outer housing. The latch may comprise a first part on the gate and a second part on an inside surface of the outer housing.

The latch may comprise a magnet, or a magnetic material, fixed with respect to the outer housing, arranged to abut a further magnet or magnetic material located on the gate when the blocking assembly (including the gate) is in the second arrangement.

The latch may comprise a mechanical latch, for example comprising a collet and collet receiver—one fixed with respect to each of the gate and the housing.

The restraint may comprise a deformable screen arranged to hold the occluding member in the non-occluding position when in the first arrangement and to rupture in response to the change in the flow of drilling fluid through the drill bit, releasing the occluding member to move to the second arrangement. The deformable screen may be a frangible screen.

The restraint may comprise a deformable screen arranged to prevent the occluding member from passing through a passageway when in the first arrangement. The deformable screen may span a passageway or a part thereof and may be arranged to prevent the occluding member from moving downstream with the flow of the drilling fluid.

When the flow of drilling fluid through the drill bit changes—for example increasing the flow rate to increase a pressure differential across the blocking assembly—the force exerted by the drilling fluid and/or the occluding member on the screen may cause the frangible screen to deform, for example by bending, dissolving or breaking. Once deformed, the screen may release the occluding member to move to a second arrangement in which it blocks the flow path.

The frangible screen may be made of a polymer, such as PEEK.

The restraint may comprise a support defining an open internal diameter less than an external dimension of the occluding member. The support may be arranged to restrict the maximum diameter of a flow path or passageway in order to capture an occluding member. In a first arrangement, the support may be arranged to prevent the occluding member from passing through the support. The support and/or occluding member may be configured to deform in response to the change in the flow of drilling fluid through the drill bit such that the occluding member can pass through the support.

The support may be arranged to reduce or constrict a diameter of a passageway for drilling fluid. The support may restrict the diameter of the passageway such that an occluding member is unable to pass through the restriction and is held in a first arrangement by the support. A pressure differential across the blocking assembly may act on the occluding member and provide a force on the occluding member to move through the support to the second arrangement. The interference between the support and the occluding member may prevent the occluding member from moving therethrough.

At least one of the support and the occluding member may be configured to deform when a pressure differential across the blocking assembly reaches a threshold value. A pressure differential across the blocking assembly may cause a resultant force acting on the occluding member in the direction of flow of drilling fluid through the drill bit. This force may act to try to move the occluding member through the support, to the second arrangement. When the pressure differential reaches a threshold value, the force may be such that at least one of the occluding member and the support deforms sufficiently to let the occluding member pass through the support to the second arrangement.

The support may be an annular ring.

The support may be a plurality of protrusions protruding from an inside of the outer housing, arranged to restrict the maximum diameter of a flow path or passageway in order to capture an occluding member.

The support may be made from a metal, metal alloy or a polymer, e.g. plastic. Example materials suitable for use as the support may include steel, PTFE, Torlon and PEEK.

The restraint and occluding member may comprise the same material.

The restraint and occluding member may be made of the same material in order to reduce increased/reduced interference caused by temperature changes. Using the same material for both the restraint and occluding member may eliminate any changes in the amount of interference between the parts due to temperature fluctuations and so may make the release of the occluding member from the support more reliable in a range of environments.

The occluding member may be a ball.

The occluding member may be a solid or hollow ball. The ball may be spherical.

The blocking assembly may comprise an electronically activated system configured to be electronically activated and electrically powered to move from the first arrangement to the second arrangement. An electronically activated system may need to be sealed against the ingress of drilling fluid and may need to withstand the pressures experienced in the well bore. The electronics and power supply chamber may be air filled and sealed to resist 138000 to 172000 kPa (20000 to 25000 psi) of hydrostatic external pressure.

Further according to the disclosure is a method of operating a downhole device (e.g. a drill bit). The method may be for operating a drill bit as described anywhere herein. The method may comprise steps as described anywhere herein. The method may comprise operating the drill bit with the deployable blade assembly in the first position. When the drill bit is operated with the deployable blade assembly in the first position, the primary cutting structure may define a cutting plane with a first diameter. Operating the drill bit with the deployable blade assembly in the first position may drill a bore with a first diameter. The method may further comprise moving the deployable blade assembly to a second position. The deployable blade assembly may be moved to a second position as described anywhere herein. Moving the deployable blade assembly to a second position may comprise deploying the deployable blade assembly, the blades, the deployable cutting structure. The method may further comprise operating the drill bit with the deployable blade assembly in the second position. When the drill bit is operated with the deployable blade assembly in the second position, the deployable cutting structure may define a cutting plane with a diameter equal to or less than the first diameter. Operating the drill bit with the deployable blade assembly in the second position may drill a bore with a diameter equal to or less than the first diameter. If the deployable cutting structure defines a cutting diameter which is less than the first diameter, the hole which is drilled may be of the first diameter and the central section of the bore may be drilled by the deployable cutting structure and the outer radial area of the bore may be drilled by the first cutting structure.

The method may further comprise changing the flow of drilling fluid through the drill bit to move the blocking assembly from a first position (e.g. arrangement) to the second position (e.g. arrangement). Operating the drill bit with the deployable blade assembly in the first position may comprise using the primary cutting structure to drill. Changing the flow of drilling fluid through the drill bit may comprise increasing the flow rate of drilling fluid through the drill bit. Operating the drill bit with the deployable blade assembly in the second position may comprise using the deployable cutting structure to drill.

Further according to the disclosure is a whipstock milling system. The whipstock milling system may comprise a whipstock. The whipstock may be for diverting the drill bit from the original trajectory of the well bore. The whipstock milling system may comprise an anchor-packer. The anchor-packer may be for radially and axially locating the whipstock milling system in a well bore by expanding parts of the anchor-packer (e.g. dies) to grip the walls of the well bore or casing therein. The whipstock milling system may comprise a drill bit as described herein. A primary cutting structure of the drill bit may be used to drill through steel casing in the well bore. A deployable cutting structure may be used to subsequently drill through formation outside of the steel casing.

The whipstock milling system may further comprise a hose connecting a drilling fluid outlet of the drill bit to the anchor-packer. The drill bit and hose may be used to activate the anchor-packer by injecting drilling fluid, released from the outlet and guided through the hose, into the anchor-packer, which subsequently expands in order to grip a portion of the well bore.

BRIEF DESCRIPTION OF THE DRAWINGS

Examples of the present disclosure will now be described, purely by way of example, in the below figures, in which.

DETAILED DESCRIPTION OF THE DISCLOSED EXEMPLARY EMBODIMENTS

Figure 1:
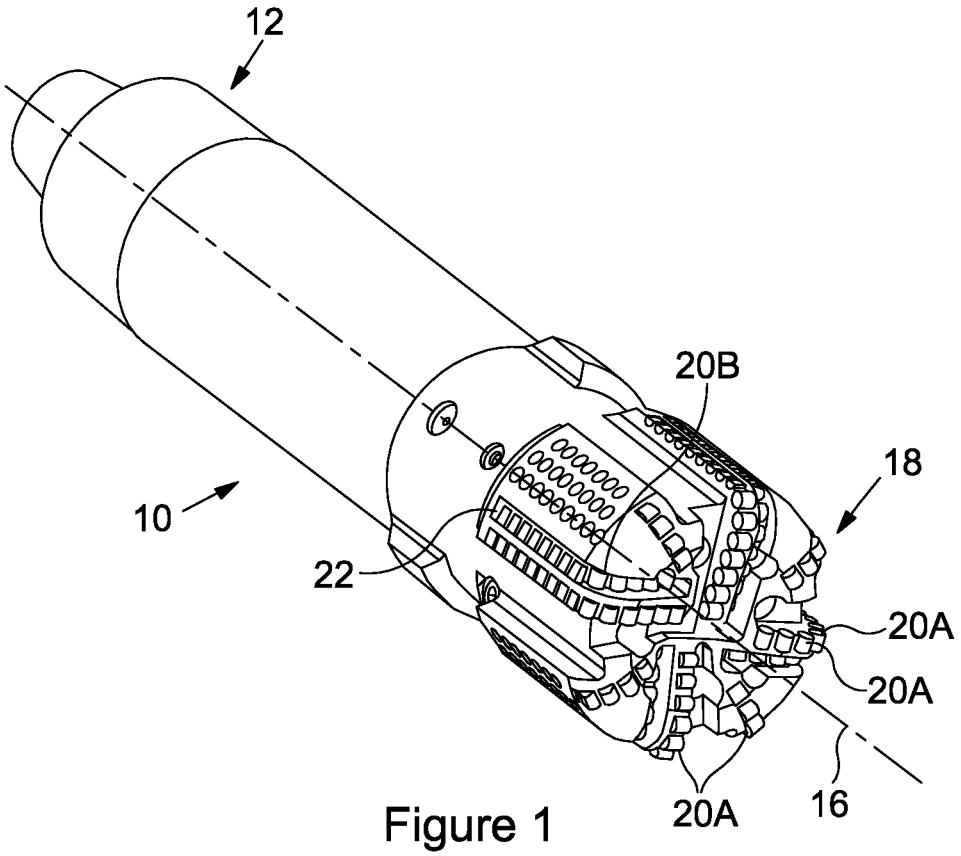
FIG. 1 is a perspective view of a drill bit according to the disclosure in a first arrangement.

In the following description, the same reference numerals will be used to refer to corresponding features in different embodiments according to the disclosure. The corresponding features need not be identical. Furthermore, it is to be understood that, unless it is explicitly stated to the contrary, features from a first embodiment of the disclosure can be combined with features of a second embodiment of the disclosure. This applies for drill bits of different diameters and different lengths—the features described as part of the present disclosure are applicable to drill bits of all sizes.

Typically, the embodiments described below are either 215.9 mm (8.5 inch) drill bits or 311.15 mm (12.25 inch) drill bits. However, drill bits with diameters other than those above may be made according to this disclosure.

The length of the 215.9 mm (8.5 inch) and 311.15 mm (12.25 inch) drill bits described with reference to FIGS. 1 to 43 are typically about 914.4 mm (36 inches). Using a drill bit of this length provides a highly steerable drill bit and thus drill string, as the short length of the drill bit allows tighter turning to be achieved.

In a 311.15 mm (12.25 inch) drill bit for use as part of a whipstock milling system as described with reference to FIGS. 48 to 61, the length may be about 1676.4 mm (66 inches).

FIG. 1 illustrates a drill bit 10. The drill bit 10 is suitable for attaching to the end of a drill string and being used to drill or mill through media located in a well bore. The drill bit 10 is substantially cylindrical and has a longitudinal axis 16 running along its central axis.

In order to facilitate drilling, the drill bit 10 is configured to allow drilling fluid to flow through at least part of the drill bit 10 and to exit through ports located on the end face and/or the outer curved surface of the drill bit. The drill bit 10 therefore can be considered to have an upstream end 12 (top left in FIG. 1) and a downstream end 14 (bottom right in FIG. 1) and drilling fluid flows from the upstream end 12 towards the downstream end 14 along at least a portion of the length of the drill bit 10.

A primary cutting structure 18 is located on the downstream axial end 14 of the drill bit and is used to drill or mill through material at the beginning of a drilling operation. The primary cutting structure 18 comprises a plurality of rows of cutting inserts 20 for cutting into material as the drill bit 10 is rotated. In the present drill bit, the cutting inserts 20A extend from the end surface of the drill bit 10 as well as from the curved side wall of the drill bit 10 in the vicinity of the downstream end 14. The primary cutting structure 18 therefore cuts a front face and the side walls of a bore.

The drill bit 10 also has a plurality of deployable blades 22, each comprising a row of cutting inserts 20B. In FIG. 1, the deployable blades 22 are in a retracted position (i.e. a first arrangement) and the cutting inserts 20B on the deployable blades 22 do not extend from the primary cutting structure 18 and do not interfere with the material being cut by the drill bit 10.

Figure 2:
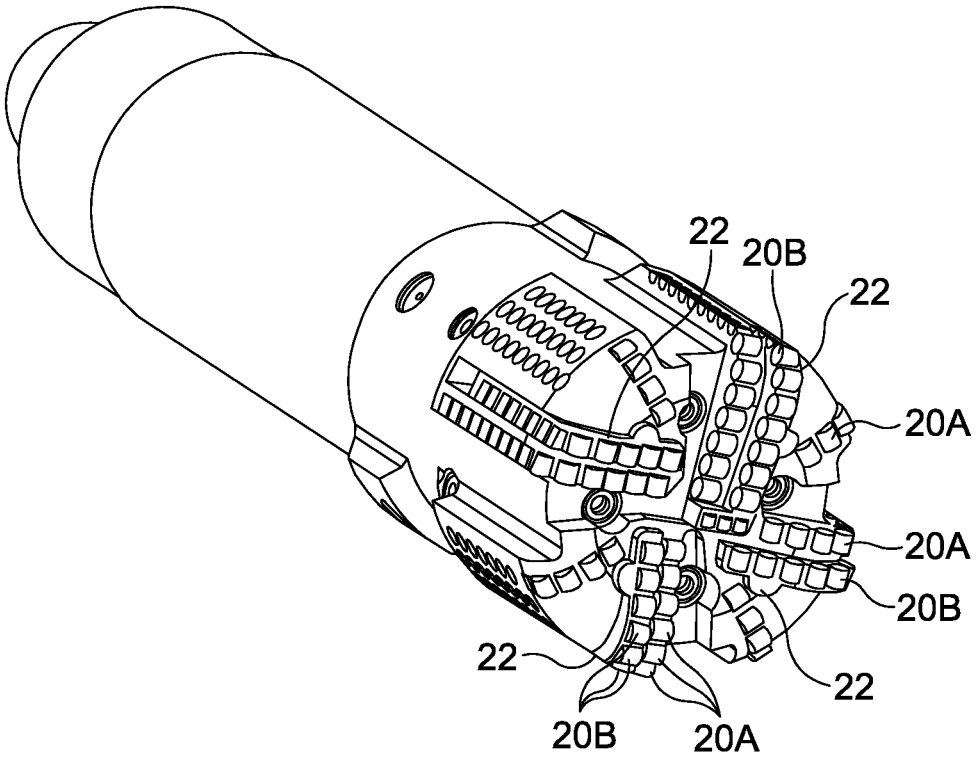
FIG. 2 is a perspective view of the drill bit of FIG. 1 in a second arrangement.

FIG. 2 shows the drill bit 10 of FIG. 1 in a second arrangement, in which the deployable blades 22 have moved towards the downstream end 14 of the drill bit 10 and are protruding from the primary cutting structure 18, forming a new, deployable, cutting structure. With the deployable blades 22 in the second arrangement, the cutting inserts 20B on the deployable blades 22 contact any material to be cut first and provide the main cutting function of the drill bit 10. Accordingly, the drill bit 10 is configured to provide two cutting structures, a first, primary cutting structure 18, and a second, deployable cutting structure, which can be selectively presented at the option of a user.

The ability to effectively have a drill bit 10 with two cutting structures enables a drill bit 10 having different cutting characteristics with the deployable blades 22 in the second arrangement compared to the first arrangement and thus being geared towards cutting different materials, or cutting the same material with a different cut depth or bore profile. Alternatively, the cutting characteristics of the two cutting structures can be substantially the same and the deployable cutting structure can be engaged when the cutting inserts 20A of the primary cutting structure 18 are worn, in order to extend the service life of the drill bit 10.

In order to provide different cutting characteristics, the cutting inserts 20A 20B on the primary cutting structure 18 and deployable blades 22, respectively, can be specifically selected to provide two different cutting functions. Thus the size, shape and material of the cutting inserts 20A 20B can be selected to be geared towards a specific use. Alternatively, the cutting inserts 20A 20B on the primary cutting structure 18 and deployable blades 22 can be the same type of cutting insert and the deployable blades 22 can be engaged and moved to the second arrangement when the cutting inserts 20A on the primary cutting structure 18 are worn, in order to extend the service life of the drill bit 10.

Figure 3:
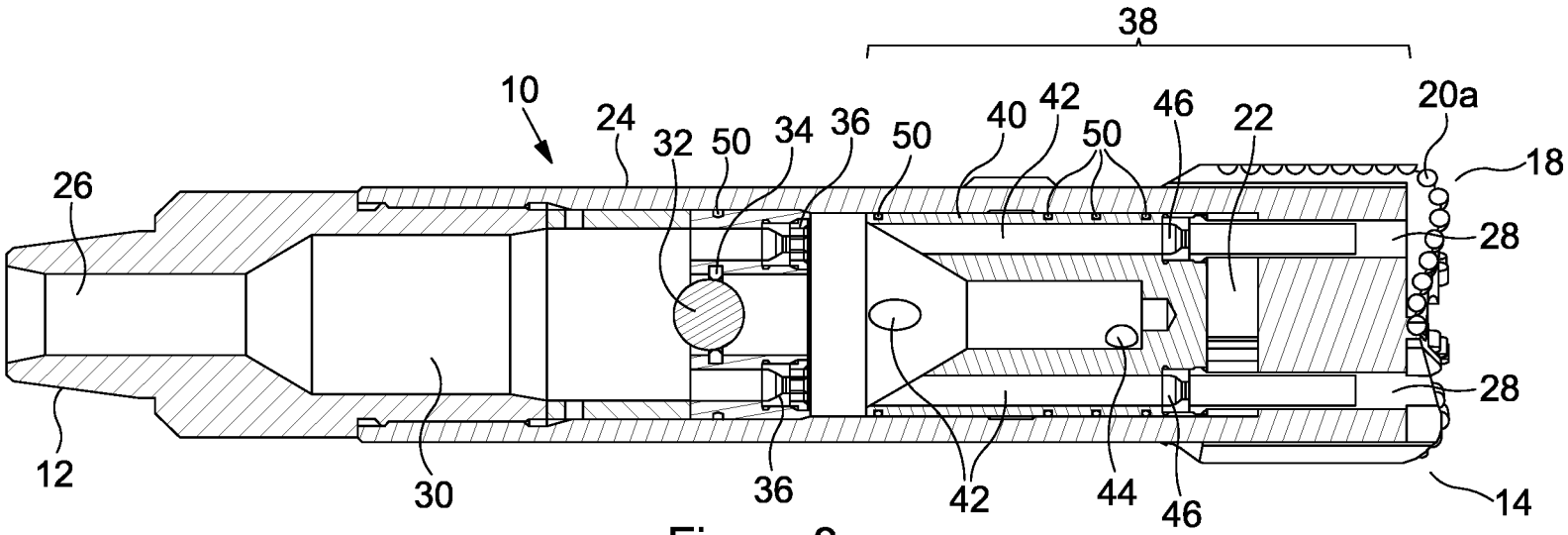
FIG. 3 is a cross-section of a drill bit according to the disclosure in a first arrangement.

Turning now to FIG. 3, a cross-section of a drill bit 10 in a first arrangement is shown. The drill bit 10 has an outer housing 24 substantially tubular in shape. The drill bit is a 215.9 mm (8.5 inch) drill bit. At the upstream end 12 of the drill bit 10, a drilling fluid inlet 26 can be seen. Drilling fluid—which flows down the drill string from the surface—enters the drill bit 10 through the drilling fluid inlet 26, flows through the outer housing 24 of the drill bit 10 and flows out through outlets 28 located downstream of the fluid inlet 26. In the drill bit 10 of FIG. 3, the outlets 28 are located on the end face of the downstream end 14 of the drill bit 10—that is, the outlets 28 are located in the primary cutting structure 18.

After entering the drill bit 10 through the fluid inlet 26, the drilling fluid flows through a chamber 30 defined by the housing 25. At the end of the chamber 30 is a ball 32 located in a restraint. The restraint and ball 32 collectively form a blocking assembly, which is part of the actuation mechanism of the drill bit (discussed in more detail below).

In the drill bit 10 of FIG. 3, the restraint is a support in the form of an annular ring 34 for supporting the ball 32. The inner diameter of the annular ring 34 is slightly smaller than the outer diameter of the ball 32. As such, the ball 32 is unable to pass through the annular ring 34 when the blocking assembly is in a first arrangement.

The restraint and ball 32 are located in, and block off, a passage in the outer housing 24 through which drilling fluid could otherwise flow. Instead, the drilling fluid flows around the blocking assembly, through circumferentially-located nozzles 36. The restriction in the flow of the fluid around the ball 32 and annular ring 34 causes a pressure differential across the ball 32, which urges the ball 32 towards the annular ring 34 (i.e. in a downstream direction).

After passing through the nozzles 36, the drilling fluid enters a deployable blade assembly 38 comprising a piston 40 and blades 22. The piston 40 is housed within the outer housing 24. The blades 22 are connected to the piston 40.

A number of flow paths 42 44 are defined through the piston 40 which allow the drilling fluid to exit the drill bit 10 at the primary cutting structure 18 or through the outer housing 24, via nozzles 46 located in or adjacent the outlets 28.

At a certain point during the drilling operation, a user may decide that they wish to use the deployable cutting structure—i.e. to move the blades 22 to a second position such that the second set of cutting inserts 20B are engaged.

Figure 4:
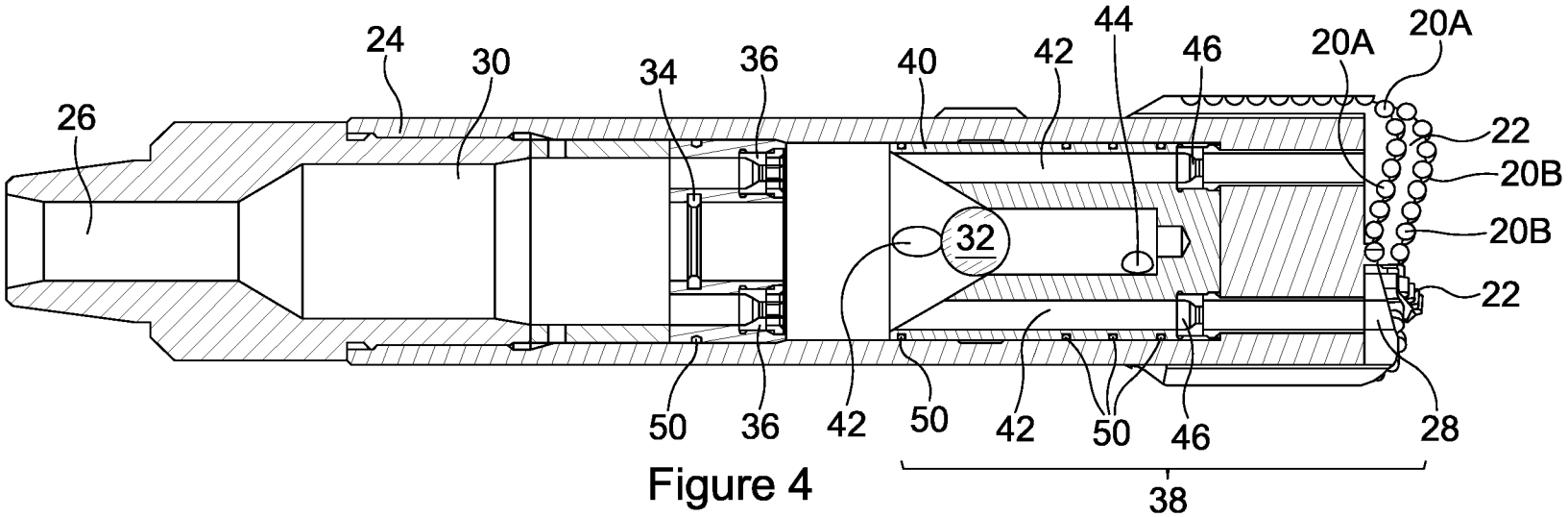
FIG. 4 is a cross-section of the drill bit of FIG. 3 in a second arrangement.

FIG. 4 shows the drill bit 10 of FIG. 3 in the second arrangement, with the deployable blade assembly 38 extended—having moved towards the downstream end of the drill bit 10 such that the end of the blades 22 and the cutting inserts 20B protrude out from the primary cutting structure 18 to form a deployable cutting structure.

To move the drill bit 10 from the first arrangement to the second arrangement, a user increases the flow rate of drilling fluid through the drill bit 10. This increase in flow rate increases the pressure differential across the ball 32 to a threshold value. At the threshold value, the ball 32, the annular ring 34, or both deform sufficiently to let the ball 32 pass through the annular ring 34. At this point the blocking assembly moves from a first arrangement towards a second arrangement. This method of activation is very easy for a user to control. It is also robust and reliable, as fluid is constantly flowing through the drill string and it does not rely on a mechanical device deployed into the drill string (which can often get blocked on the way down) or an electrical connection (which can often be damaged due to the harsh environment in which such a device may be operating).

In order to move the blocking assembly from the first to the second arrangement, for a 215.9 mm (8.5 inch) drill bit, the pressure drop across the blocking assembly may increase from about 689.5 kPa (100 psi) at a flow rate of 30.3 litres per second (400 gpm) to about 1550 kPa (225 psi) at a flow rate of 45.4 litres per second (600 gpm).

Once the ball 32 has passed through the annular ring, the flow of drilling fluid through the drill bit 10 carries the ball 32 towards the downstream end 14 of the drill bit. The piston 40 comprises a tapered section comprising a seat 48 for holding the ball 32. Fluid flow through the piston 40 locates and holds the ball 32 in the seat 48. The seat 48 is arranged to be a constriction in, and thus form part of, one of the flow paths 44. It will typically take less than a second for the ball 32 to move from the first arrangement (supported by the annular ring 34) to the second arrangement (supported in the seat 48).

When the ball 32 is located in the seat 48, one of the flow paths 44 through the piston 40 is blocked off by the ball 32, preventing drilling fluid from flowing therethrough; accordingly, the pressure differential across the piston 40 (and deployable blade assembly 38 as a whole) increases. The pressure differential across the piston 40 reaches a deployment value. When the pressure differential across the deployable blade assembly 38 reaches the deployment value, the deployable blade assembly 38 moves from a first position in which the cutting inserts 20B on the blades 22 are recessed with respect to the primary cutting structure 18, to a second position in which the cutting inserts 20B on the blades 22 protrude from the primary cutting structure 18, forming a deployable cutting structure. FIG. 4 shows the drill bit 10 in a second arrangement, with the deployable blade assembly 38 in a second position.

In the 215.9 mm (8.5 inch) drill bit described, the deployable blade assembly 38 moves about 35 mm (1.375 inches) when moving from the first to the second position. However, other drill bits may move more or less than this amount.

The cavity at the downstream end of the drill bit—located between the piston and the primary cutting structure—is allowed to fill with low pressure drilling fluid at all times. However, as the gaps around the blades are very small when the deployable blade assembly 38 is in the first position a lot of cuttings debris should not be able to get into these large cavities under the piston. When the deployable blade assembly 38 travels to the second position, a large gap will be created on the upstream ends of the blades (behind the piston) will allow the of ingress large debris, but this will not affect operation of the drill bit.

The primary cutting structure 18 defines a bore with a first diameter. The deployable cutting structure defines a bore with the same diameter as the primary cutting structure 18. This is achieved by the deployable cutting assembly 38 (i.e. the deployable blades 22 and the cutting inserts 20B themselves) having a profile of the same diameter as the primary cutting structure 18 when viewed along the axis 16, and the deployable cutting assembly 38 (i.e. deployable blades 22) being arranged to only move parallel to the longitudinal axis 16 of the drill bit 10 when moving from the first to the second position.

Providing two different cutting structures with the same bore diameter provides a number of benefits. Importantly, it provides continuity along the length of the hole. This simplifies later usage, as a change in bore diameter does not need to be considered when determining downhole components. Use of a constant bore diameter ensures that the drill bit itself can be easily extracted from the bore once drilling is complete. If a drill bit has a larger diameter in the second arrangement—i.e. the cutting inserts 20B on the blades 22 define a bore diameter which is larger than that of the primary cutting structure 18 when in the second position—it may be difficult to extract the drill bit from the completed bore as its final diameter will be larger than the diameter of the first section of the hole.

In order to prevent leakages reducing the efficacy of the drill bit, a number of seals 50 are located between the outer housing 24 and internal components (e.g. the piston 40 and blocking assembly) to prevent drilling fluid from passing between components and thus reducing pressure differentials. Only one seal is used if all the flow nozzles are on the face of the primary cutting structure. Three seals are needed (as shown) if one or more nozzles are located on the outside diameter of the drill bit (as in this variant) which may have to be used if there is not enough space to locate enough flow ports on the face of a bit.

Figure 5:
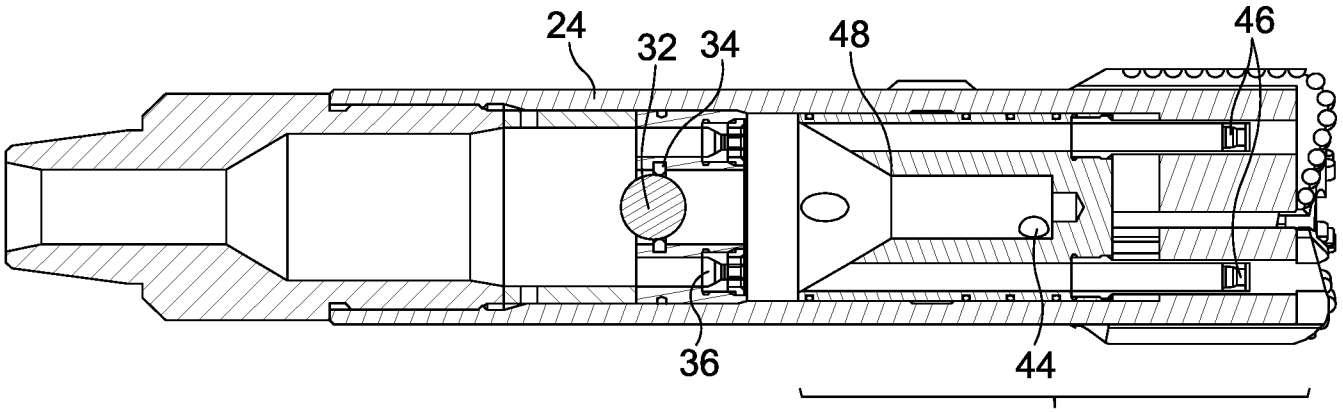
FIG. 5 is a cross-section of a further drill bit according to the disclosure in a first arrangement.
Figure 6B:
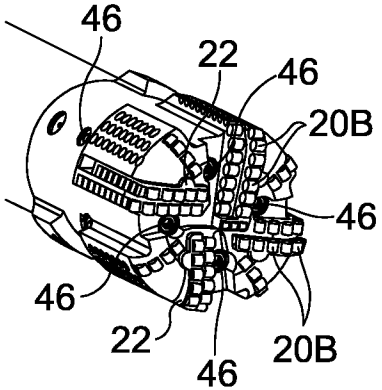
FIG. 6B is a perspective view of the drill bit of FIG. 5 in a second arrangement.
Figure 6A:
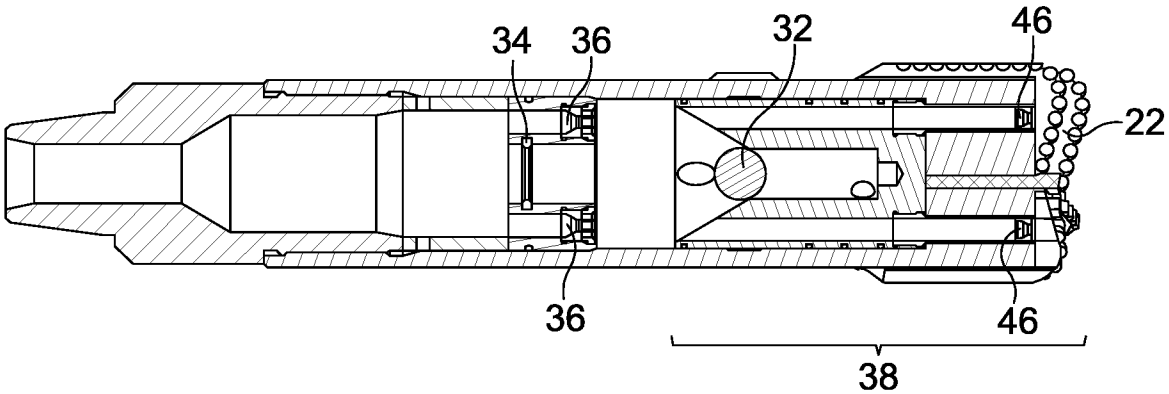
FIG. 6A is a cross-section of the drill bit of FIG. 5 in a second arrangement.

FIGS. 5 and 6A illustrate a drill bit similar to that of FIGS. 3 and 4, except with the nozzles 46 of the deployable blade assembly 38 being located at a more downstream location—that is, the nozzles 46 are located much closer to the primary cutting structure 18 than in the drill bit of FIGS. 3 and 4. As with the drill bit of FIG. 3, the primary cutting structure 18 and deployable cutting structure define a bore with the same diameter.

FIG. 6B is a perspective of the downstream end 14 of the drill bit in the second arrangement and the nozzles 46 can be seen, located between rows of cutting inserts 20A 20B, for ejecting drilling fluid straight into the drilling zone for facilitating cutting, in a known manner. A nozzle 46 can also be seen on the curved surface of the outer housing 24, which will be discussed further with reference to FIGS. 7 and 8.

Figure 7:
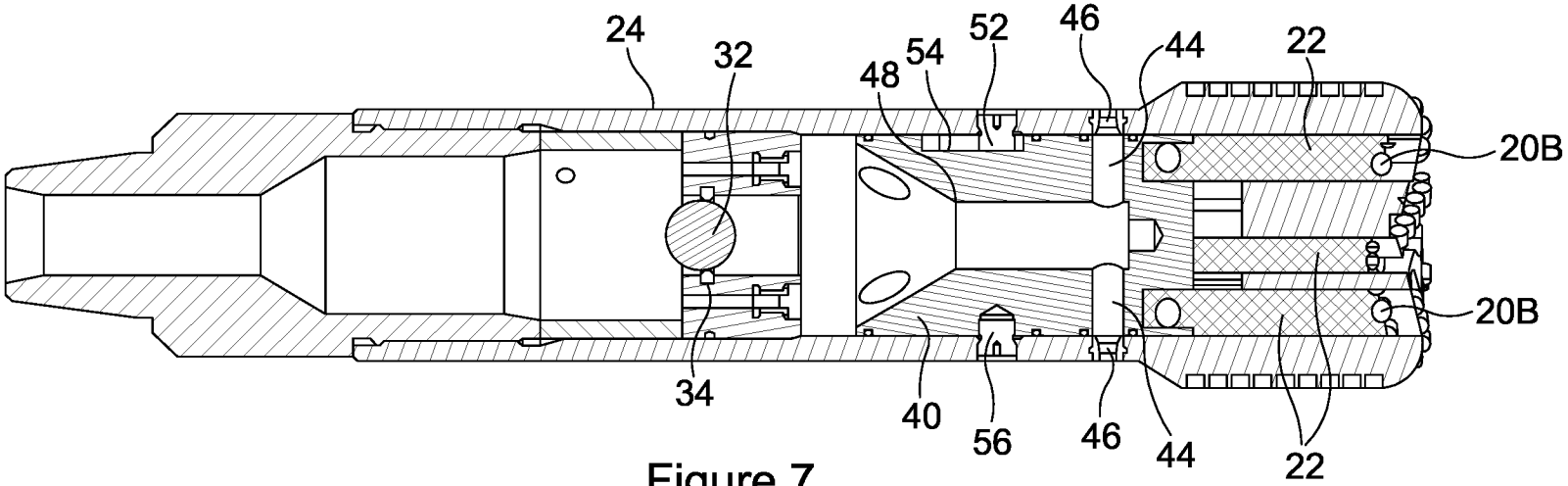
FIG. 7 is a further cross-section of the drill bit of FIG. 5 in a first arrangement.
Figure 8:
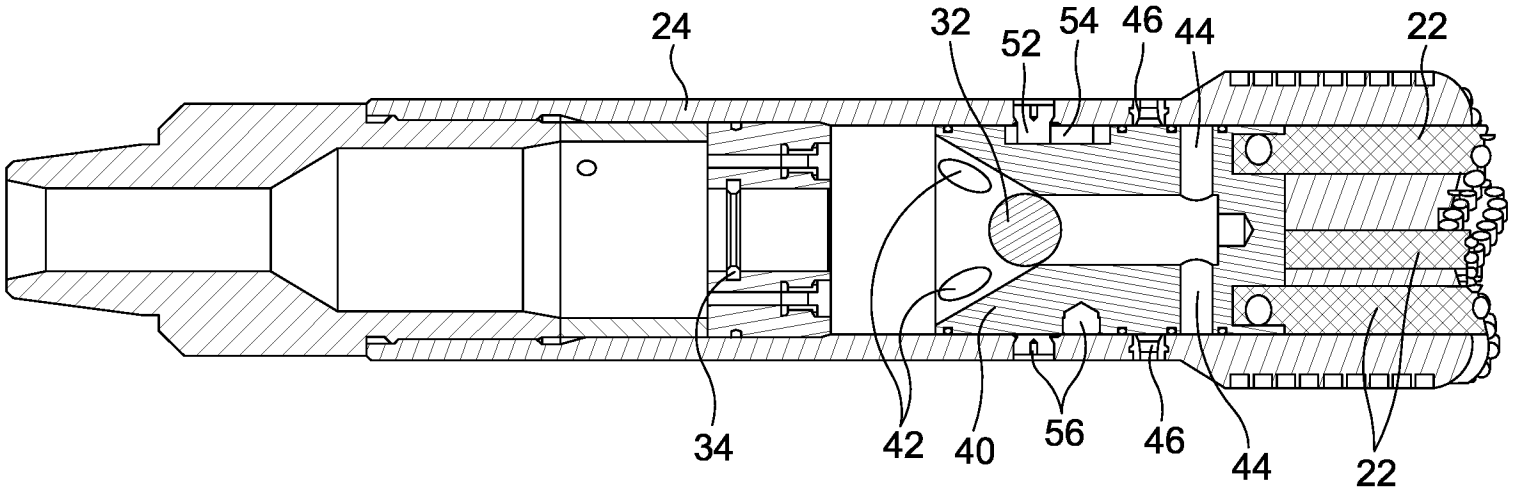
FIG. 8 is a further cross-section of the drill bit of FIG. 5 in a second arrangement.

FIGS. 7 and 8 show the drill bit of FIGS. 5 and 6 rotated by approximately 45 degrees with respect to the view in FIGS. 5 and 6. FIGS. 7 and 8 show further details of the flow path 44 blocked by the ball 32 when the drill bit is in the second arrangement. This flow path 44 splits at a location downstream of the seat 48, but still within the piston 40, into two paths separated by 180 degrees. The two paths are located radially and nozzles 46 in the side wall of the outer housing 24 connect the paths to the outside and thus facilitate the radial ejection of drilling fluid. The nozzles 46 are fixed with respect to the outer housing 24.

The number and location of outlets provided in a drill bit 10 can be selected to determine optimal use parameters. Reducing the number of available outlets may increase the pressure differential across the drill bit. Locating outlets upstream of the deployable blade assembly 38 may allow a higher drilling fluid input flow rate to be utilised while maintaining within certain pressure gradient parameters across the deployable blade assembly 38. Likewise, arranging a larger number of the available outlets to form part of the flow path 44 blocked by the ball 32 will maximise the increase in pressure differential across the deployable blade assembly 38 when the ball 32 moves into the second arrangement.

Referring back to FIGS. 7 and 8, blades 22 can be seen located in slots of the outer housing, the slots being arranged axially to ensure the blades 22 extend axially, parallel to the longitudinal axis of the drill bit.

FIGS. 7 and 8 also depict a guide pin 52 fixed with respect to the outer housing 24. The guide pin 52 extends from an internal face of the outer housing 24, into an elongated recess 54 located in the outer surface of the piston 40. The recess 54 is axially elongated, that is in a direction parallel to the longitudinal axis 16 of the drill bit. The guide pin 52 and recess 54 are arranged to help guide the piston 40 and hence the deployable blade assembly 38 as it moves from the first position to the second position. Accordingly, the elongated recess 54 has a length substantially equal to the distance between the first and second positions of the piston 40 and the guide pin 52 travels along the recess 54 from a downstream end elongated recess 54 to an upstream end of the elongated recess 54 as the piston moves from the first to the second position.

FIGS. 7 and 8 also depict a shear pin 56, arranged to hold the piston 40 (and hence deployable blade assembly 38) in the first position. When the drill bit is in the first arrangement, the shear pin 56 is located in the outer housing 24 of the drill bit and extends into a receiving hole in the piston 40. Accordingly, the shear pin 56 spans the interface between the outer housing 24 and the deployable blade assembly 38 and holds the piston 40 and hence the deployable blade assembly 38 in the first position. As the flow rate of drilling fluid through the drill bit increases and the ball 32 moves through the annular ring 34 and into the seat 48 of the piston 40, the pressure differential across the piston 40 (and hence deployable blade assembly 38) increases which in turn increases the force exerted on the deployable blade assembly 38 by the drilling fluid, towards the downstream end of the drill bit. Initially, the shear pin 56 resists this movement and hence holds the piston 40 in the first position. However, when the pressure differential across the deployable blade assembly 38 reaches a deployment value, the shear pin 56 can no longer withstand the force exerted on it by the piston 40 and the shear pin 56 shears at the interface between the outer housing 24 and the piston 40. As the deployable blade assembly 38 is no longer held in the first position by the shear pin 56, the deployable blade assembly 38 moves to the second position. Accordingly, the breakage strength of the shear pin 56 determines the deployment value at which the deployable blade assembly 38 moves from the first to the second position. FIG. 8 illustrates the deployable blade assembly 38 in the second position, with the shear pin 56 broken in two parts—half in the outer housing 24 and half in the piston 40.

Figure 9:
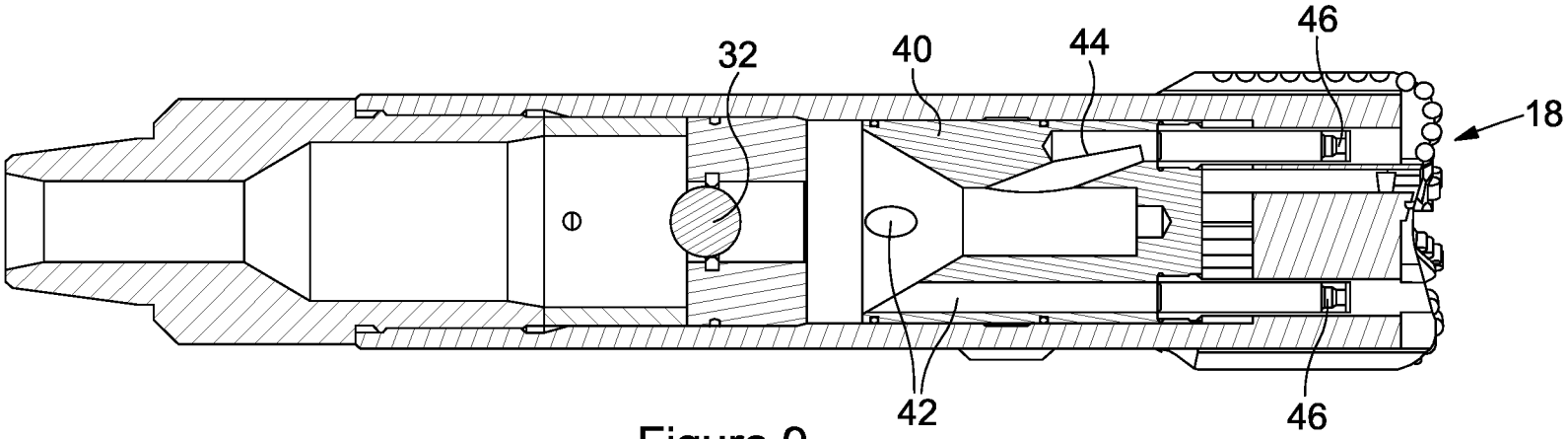
FIG. 9 is a cross-section of a further drill bit according to the disclosure in a first arrangement.
Figure 10:
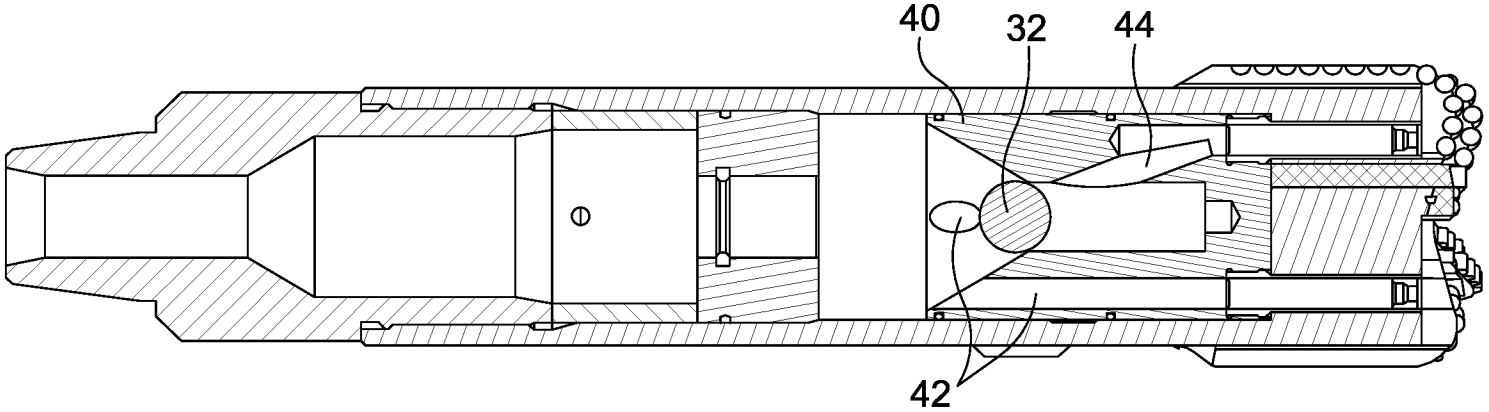
FIG. 10 is a cross-section of the drill bit of FIG. 9 in a second arrangement.

FIGS. 9 and 10 illustrate a drill bit with an alternative arrangement for the flow path 44 which is blocked by the ball 32 when in the drill bit is in the second arrangement. The majority of the drill bit of FIGS. 9 and 10 is similar to that of FIG. 5; however, the flow path 44 which is blocked by the ball 32 when the drill bit is in the second arrangement is arranged to have an outlet in the downstream end of the drill bit—that is in the primary cutting structure 18. Such an arrangement may provide more flow out of the primary cutting structure 18 when the drill bit is in the first arrangement, as none of the flow is being directed out of the sides of the outer housing 24. The choice of where to output the drilling fluid flow may be made based on the desired cutting characteristics and environment of the specific drill bit and on the space available to locate nozzles within the passageways/flow paths of the bit face of the primary cutting structure.

Figure 11:
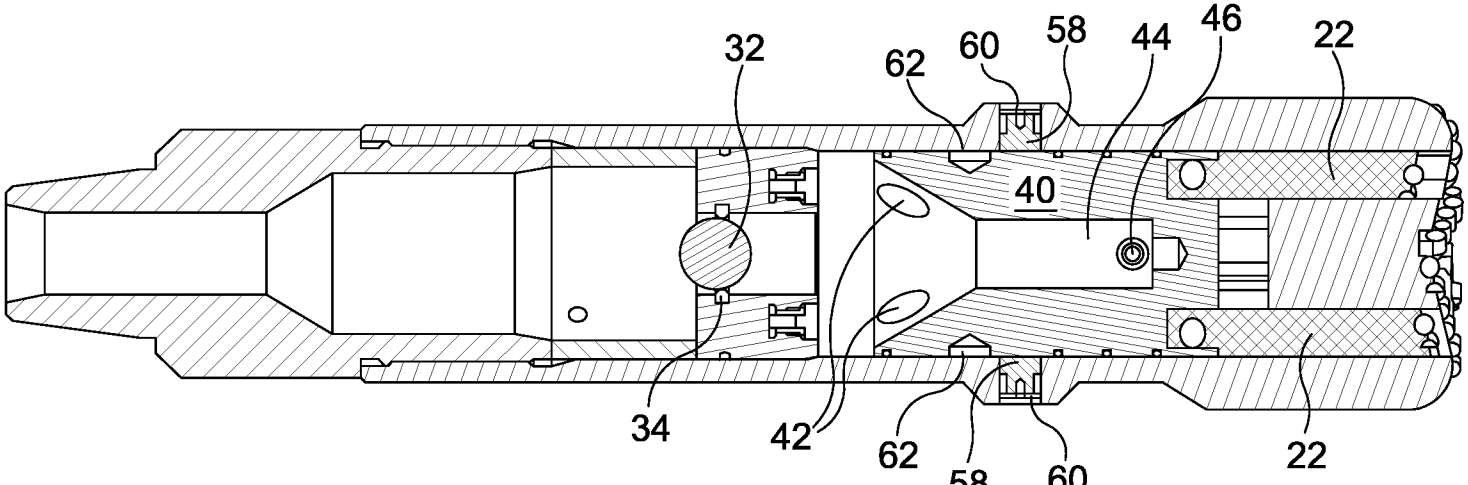
FIG. 11 is a further cross-section of the drill bit of FIG. 5 in a first arrangement.
Figure 12:
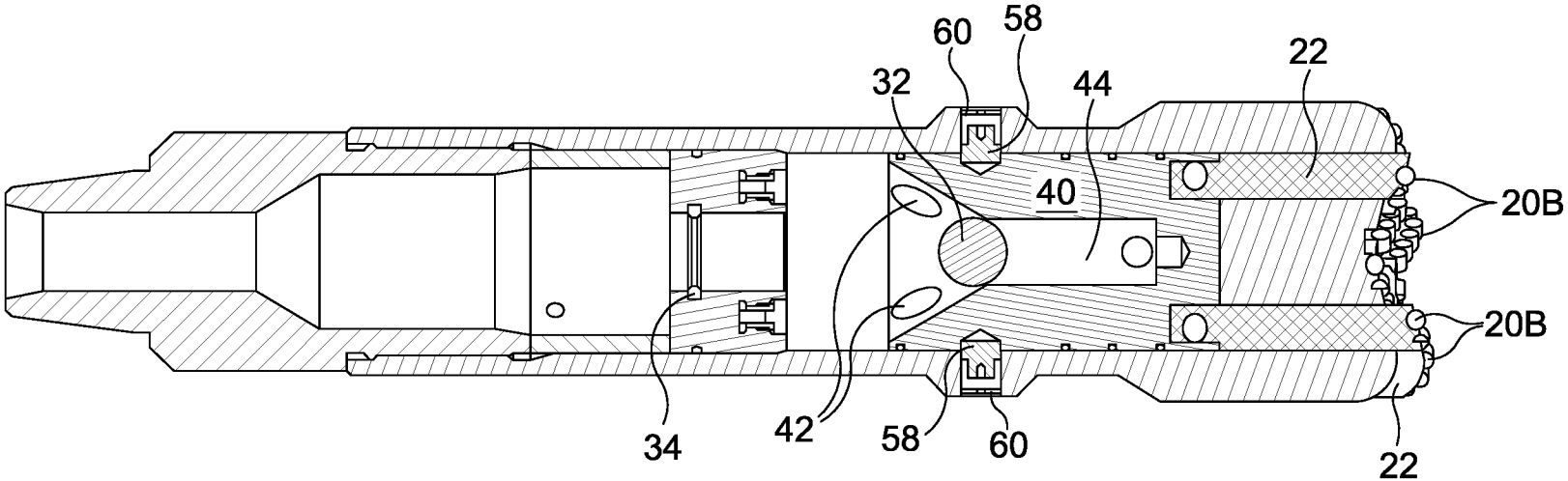
FIG. 12 is a further cross-section of the drill bit of FIG. 5 in a second arrangement.

FIGS. 11 and 12 show the drill bit of FIGS. 5 and 6 rotated by approximately 90 degrees with respect to the view shown in FIGS. 7 and 8. Lock pins 58 are visible in FIGS. 11 and 12, for securing the piston 40 and hence holding the deployable blade assembly 38 in the second position. The lock pins 58 are located in the outer housing 24 of the drill bit and are biased inwardly—towards the centre of the drill bit. A spring 60 is located radially outwardly with respect to the lock pin and is held in place by a cap. Thus the spring 60 pushes the lock pin 58 towards the piston.

Locking recesses 62 are located on the outer surface of the piston 40, arranged to receive the lock pins 58 when the deployable blade assembly 38 is in the second position.

When the deployable blade assembly 38 is in the first position, the lock pins 58 abut the outer surface of the piston 40 and so are held in an outward location—entirely located within the outer housing 24. As the deployable blade assembly 38 moves from the first position to the second position, lock pins 58 slide along the outer surface of the piston 40 and, when the deployable blade assembly 38 reaches the second position and the locking recesses 62 are aligned with the lock pins 58, the lock pins 58 pop out of the inner surface of the outer housing to locate in the locking recesses 62 of the piston 40. Thus the lock pins 58 span the interface between the outer housing 24 and the piston 40 and therefore lock the piston 40 (and hence the deployable blade assembly 38) in position with respect to the outer housing 24. The lock pins 58 therefore act to hold the blades 22 and the cutting inserts 22B on the blades in position and to counter any drilling forces acting on the blades 22 which would otherwise force the deployable blade assembly 38 to move out of the second position towards the first position.

Figure 13:
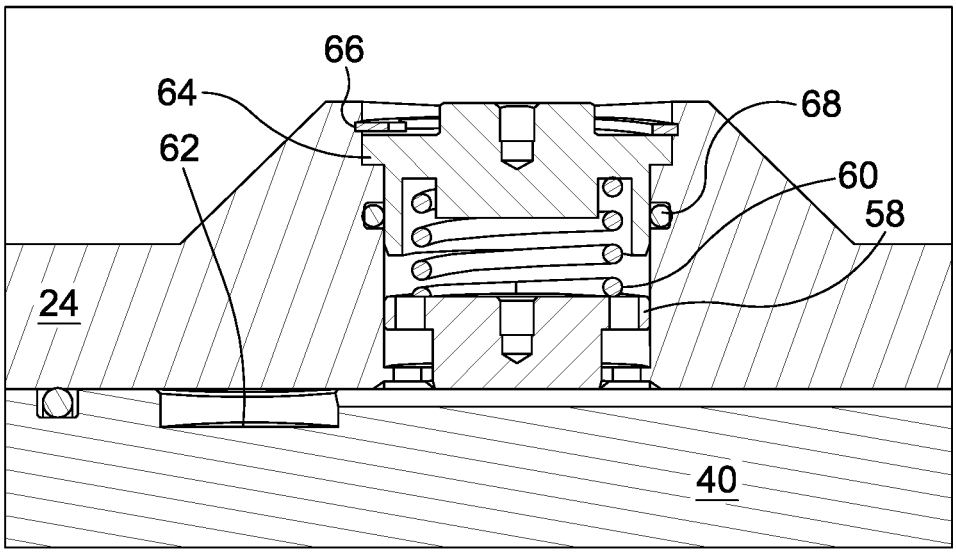
FIG. 13 is a cross-section of a lock pin in an unlocked arrangement.
Figure 14:
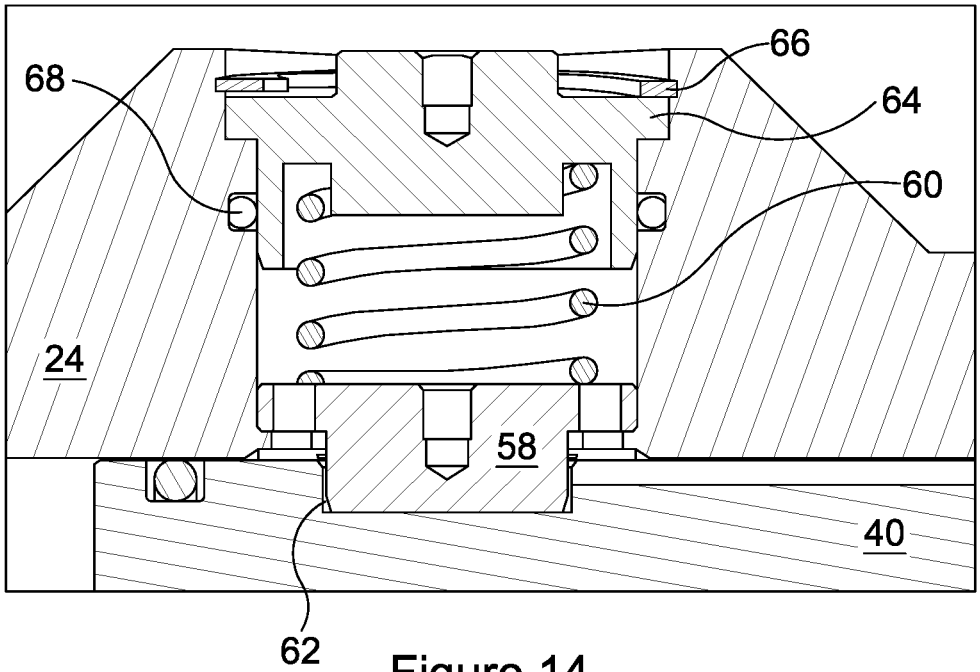
FIG. 14 is a cross-section of a lock pin in a locking arrangement.

FIGS. 13 and 14 show an alternative example of lock pin systems for use with any drill bit according to the disclosure in a locked and unlocked arrangement, respectively. The example of FIGS. 13 and 14 are located in holes through the outer housing 24 and comprise lock pins 58, biased by springs 60 out from the outer housing 24 towards the piston 40. The springs 60 are held in place by plugs 64 which are in turn held in place by circlips 66. A seal 68 surrounds the plug 64 and in combination with the circlip 66 prevents fluid and wellbore debris from entering or leaving the drill bit via these holes.

Figure 15:
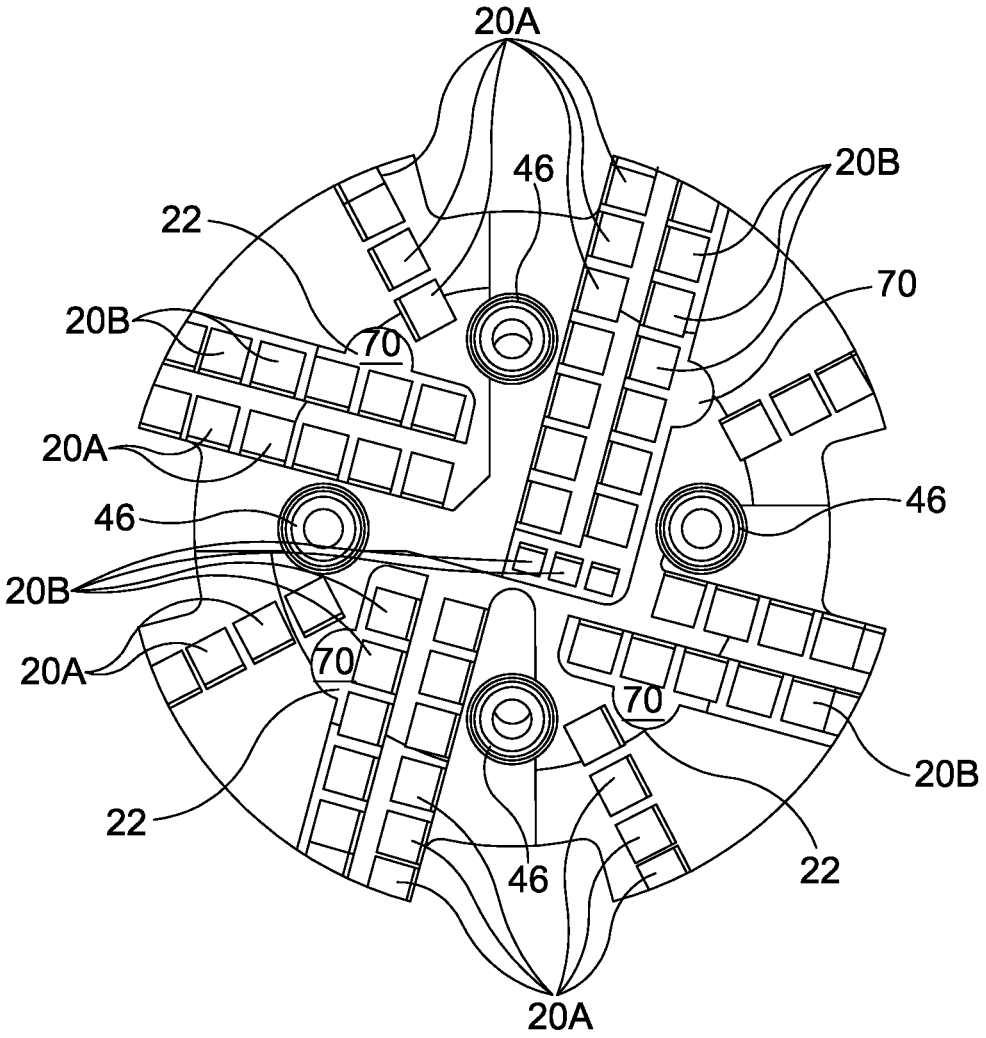
FIG. 15 is an end view of a drill bit according to the disclosure.
Figure 16:
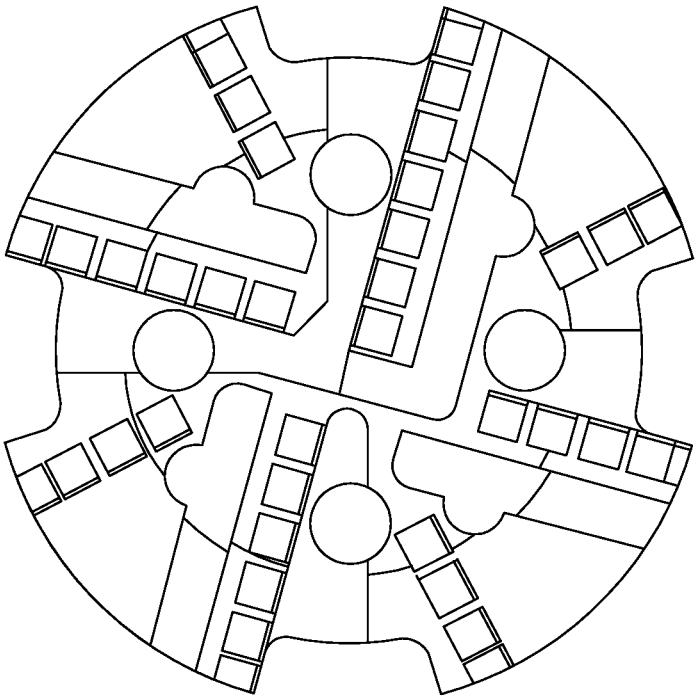
FIGS. 16 and 17 are opposing end views of a component of a drill-bit according to the disclosure.
Figure 17:
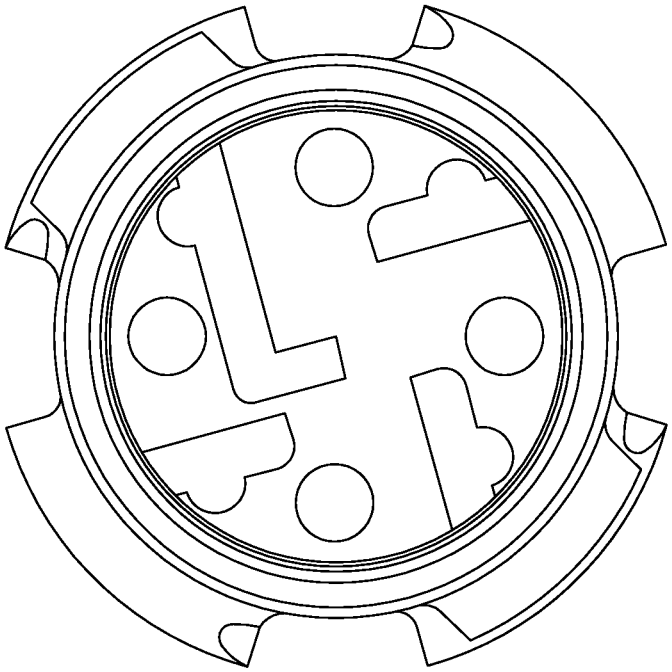

FIGS. 15 and 16 show the downstream end 14 of a drill bit. FIG. 17 shows the internal bore of the body from the upstream end without other parts fitted.

FIG. 15 shows an example arrangement of cutting inserts 20A of the primary cutting structure 18 and an example arrangement of blades 22 and cutting inserts 20B which form a deployable cutting structure. The cutting inserts 20A of the primary cutting structure can be seen to be arranged in 8 substantially radial rows with between 3 and 7 cutting inserts 20A being visible in each row. Nozzles 46 are arranged amongst the cutting inserts such that drilling fluid can be output onto the cutting structure during drilling. Blades 22 are arranged in between rows of fixed cutting inserts 20A. Each blade 22 comprises between 6 and 10 cutting inserts 20B visible from the view in FIG. 16. Three of the blades 22 comprises only a single row of cutting inserts 20B when viewed axially from the downstream end of the drill bit. One of the blades 22 is substantially L-shaped and comprises two rows of cutting inserts 20B when viewed axially from the downstream end of the drill bit. The two rows of cutting inserts are arranged substantially at 90 degrees to each other. The purpose of having such a blade 22 is to ensure that the deployable cutting structure has cutting inserts 20B provided across the entire diameter of the surface—i.e. to ensure that cutting inserts 20B are present to cut rock located substantially at the centre of the bore. The cutting inserts along one side of the L-shaped blade may be smaller than the cutting inserts along the other side of the L-shaped blade.

In other embodiments (not illustrated) the deployable cutting structure may only have cutting inserts 20B located towards the outside of the drill bit face. That is, the deployable drilling structure may not provide cutting inserts 20B towards the centre of the drill bit face as shown in FIG. 15. This is because the cutting inserts 20A of the primary cutting structure located towards the outside of the drilling face (that is a larger distance from the axis 16) move much faster than those at the centre and thus wear down much quicker. Accordingly, the deployable cutting structure may be employed to replace the worn cutting inserts 20A located at large radiuses from the axis 16, rather than to provide an entirely new cutting surface.

Each blade 22 comprises a key 70 in the form of an axial, semi-circular protrusion running along the length of one side of the blade 22. Each key 70 is located in a keyway formed in the housing. Each key 70 slides along its respective keyway, which ensures that each blade 22 can only move axially (i.e. parallel to the longitudinal axis of the drill bit) and not radially.

In FIG. 15 the cutters 20B of the blades 22 are located behind the cutters 20A of the primary cutting structure with respect to a rotation/cutting direction. The drill bit will be rotating anti-clockwise as shown in FIG. 15 i.e. looking uphole, but clockwise looking downhole, as is normal. The cutters 20B of the deployable cutting structure are thus generally located behind corresponding cutters 20A of the primary cutting structure when viewed in terms of oncoming material to be cut. In other examples, the cutters 20B of the deployable cutting structure may be generally located behind corresponding cutters 20A of the primary cutting structure when viewed in terms of oncoming material to be cut. All blade cutter rows radiate to the centre of the bit and are designed as such if enough space is available. In the embodiment of FIG. 15, however, with 4 blades there is not enough room for the moveable blades to radiate to the centre axis (in this specific embodiment). The cutters 20B of the deployable cutting structure are generally radially-staggered compared to adjacent cutters 20A of the primary cutting structure. Furthermore, the cutters 20B of the deployable cutting structure may have an equal angular spacing.

The external surface of the drill bit is hard faced in order to toughen exterior surfaces of the drill bit which may contact the formation or casing.

FIG. 16 is an axial view in an upstream direction of part of the drill bit housing with the deployable blade assembly 38 removed. The profile of the slots for the blades 22 and the holes for the nozzles 46 are illustrated. FIG. 17 is a view of the component of FIG. 16 in the opposite direction (a downstream direction).

Figure 18:
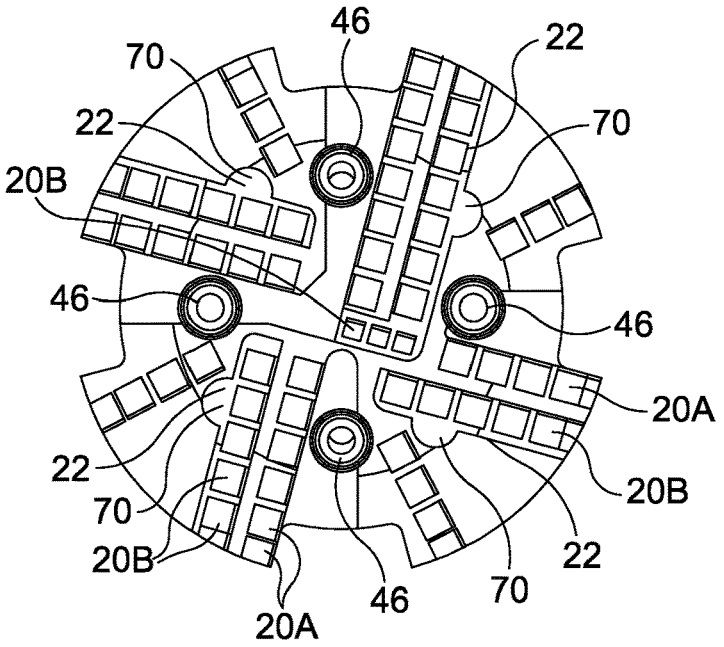
FIGS. 18 and 19 are end views of drill bits according to the disclosure.
Figure 19:
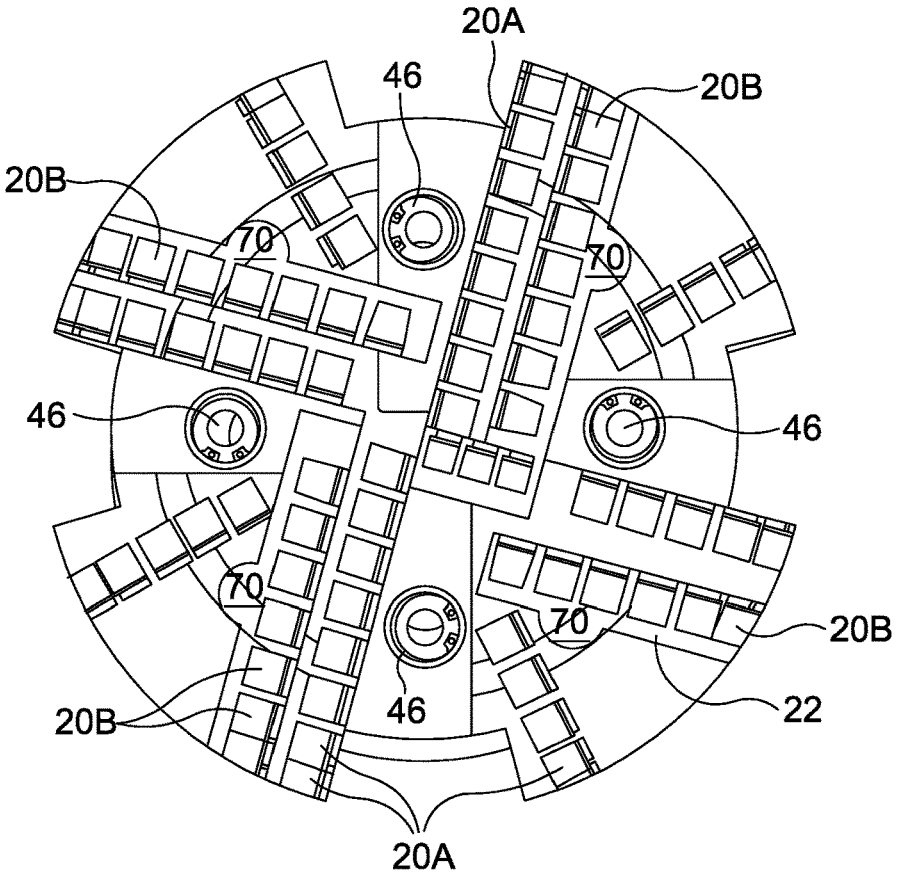

FIGS. 18 and 19 depict alternative cutting structure arrangements, for example being suitable for different diameter drill bits. Similarly to with FIG. 15, FIGS. 18 and 19 depict the cutting insert 20A arrangement for the primary cutting structure 18 and the cutting inserts 20B on the blades 22 which form the deployable cutting structure. FIGS. 18 and 19 depict the cutting structures for drill bits with different diameters to that of FIG. 15. However, corresponding features are visible and corresponding comments apply.

Figure 20:
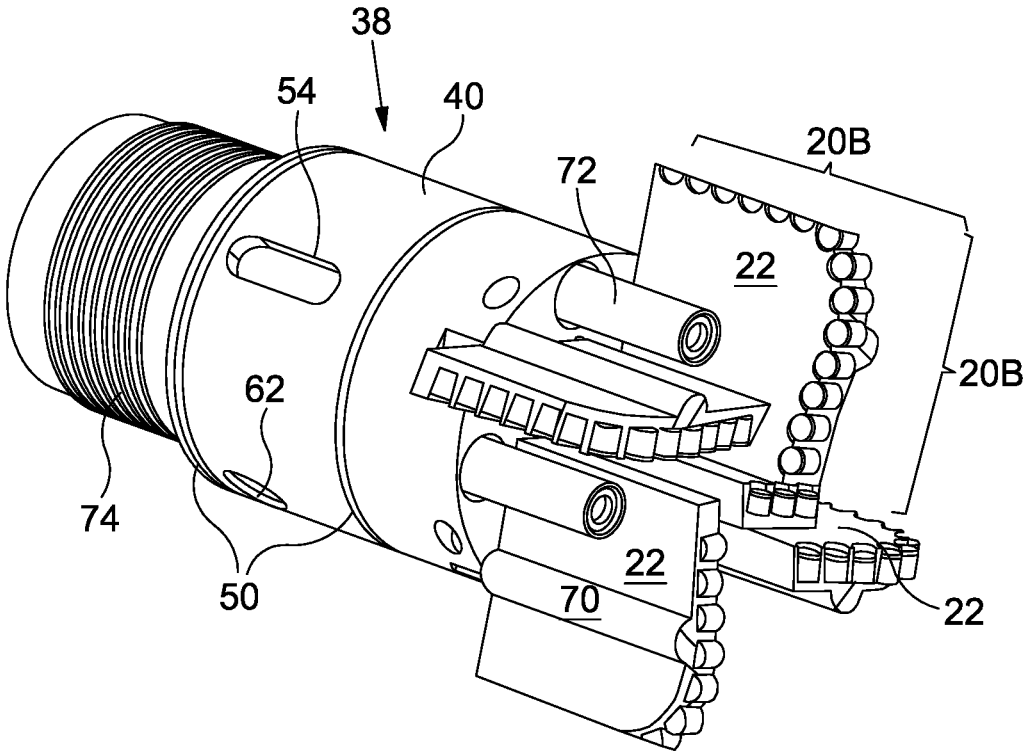
FIG. 20 is a perspective view of a deployable blade assembly.

FIG. 20 shows a deployable blade assembly 38 for use with a drill bit. The deployable blade assembly 38 is located generally within the outer housing 24 of the drill bit and is arranged to move axially with respect to the outer housing, and hence drill bit.

As described above, the deployable blade assembly 38 has a piston 40 to which four blades 22 are attached. Each blade 22 has a plurality of cutting inserts 20B located on its outer edge(s) and which form the cutting structure, or cutting structure, of the drill when the deployable blade assembly 38 is in the second position. The outer profile of the blades 22 and cutting inserts 20B determine the profile of the deployable cutting structure. As such, the shape of the blades 22 may vary depending on the material to be cut and the use for which the drill bit is designed.

In between the blades 22 are four piston tubes 72 which connect the nozzles 46 for outputting drilling fluid to the respective flow paths 42. Also visible is the elongated recess 54 for receiving a guide pin 52 and a lock-pin receiving recess 62. Seals 50 are located in circumferential grooves on the piston in order to provide a seal between the piston 40 and the outer housing 24 to prevent drilling fluid leak. Also visible in FIG. 20 as part of the deployable blade assembly 38 is a serrated sleeve 74, for use in a ratchet locking system described in more detail below.

Figure 21:
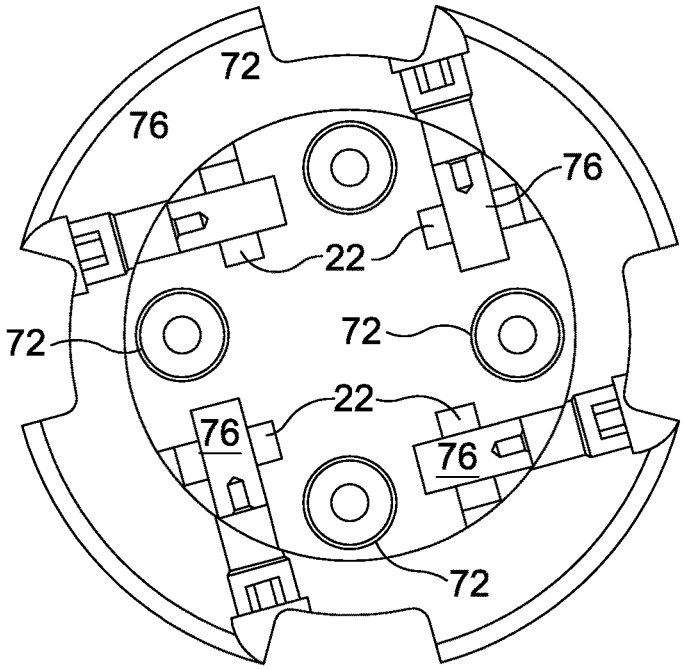
FIG. 21 is a cross-section of a drill bit according to the disclosure.
Figure 22:
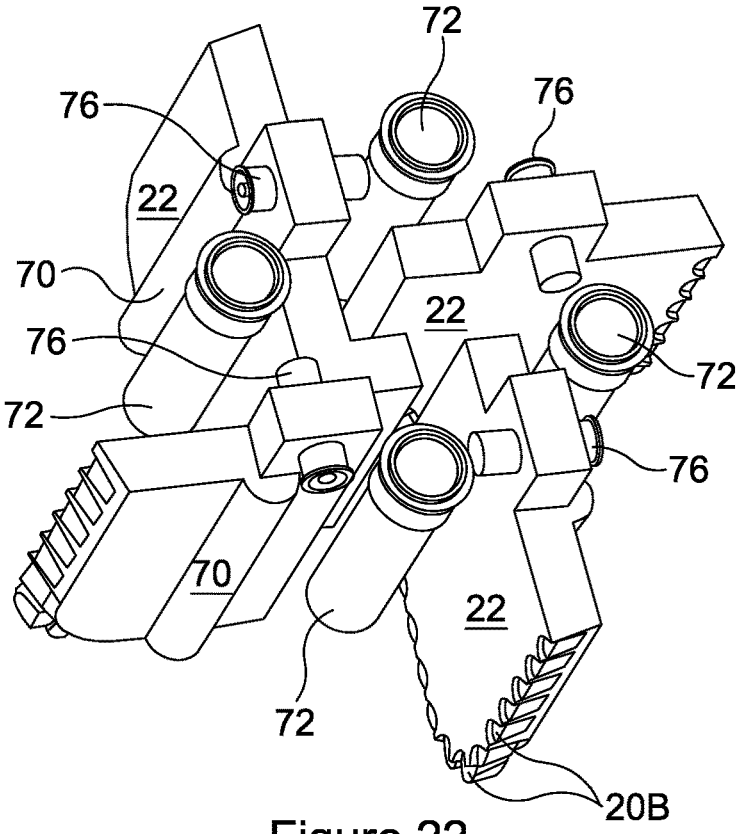
FIG. 22 is a perspective view of blades and nozzles.

FIG. 21 is a cross-section perpendicular to the longitudinal axis of the drill bit through the deployable blade assembly 38 and illustrates a pin 76 threaded through a hole near the base of each blade 22 to attach the blade to the piston 40. The hole projects to an outer surface of the housing 24 to provide access to the pins 76. FIG. 22 shows the arrangement of the blades 22, the pins 76 used to attach the blades and the tubes 72 which house the nozzles 46.

Figure 23:
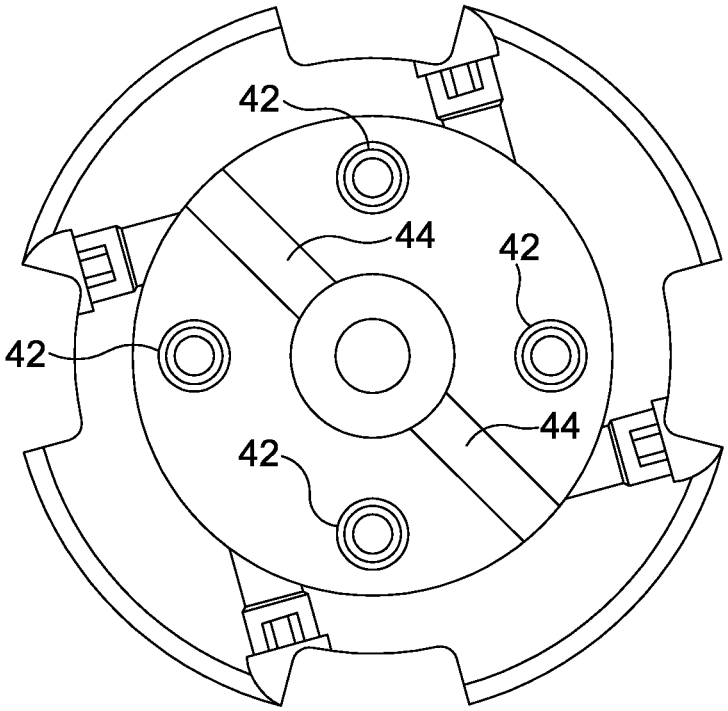
FIG. 23 is a cross-section of a drill bit according to the disclosure.

FIG. 23 is a cross-section perpendicular to the longitudinal axis of the drill bit through the outer housing 24 and deployable blade assembly at the level of the outlets from the flow path 44 which is blocked by the ball 32, when in the deployable blade assembly 38 is in the second position. The flow path 44 and outlets blockable by the ball 32 can be seen to extend between the flow paths 42 which run axially within the drill bit 10 and have outlets on the cutting structure of the drill bit 10.

Figure 24:
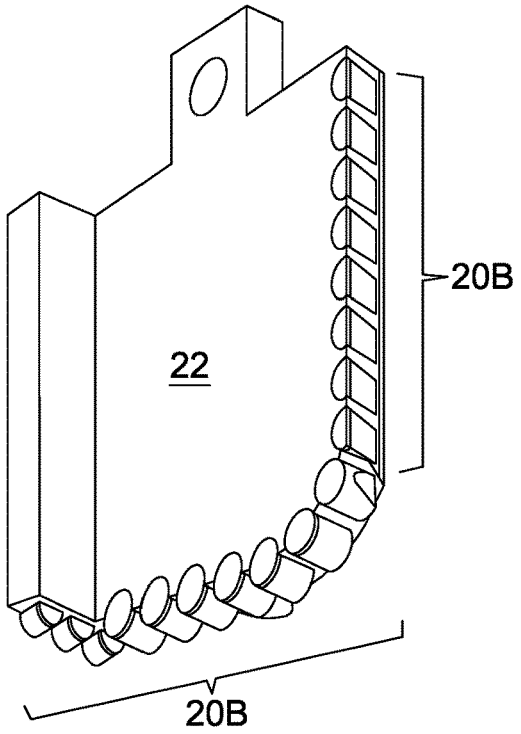
FIGS. 24 and 25 are perspective views of blades.
Figure 25:
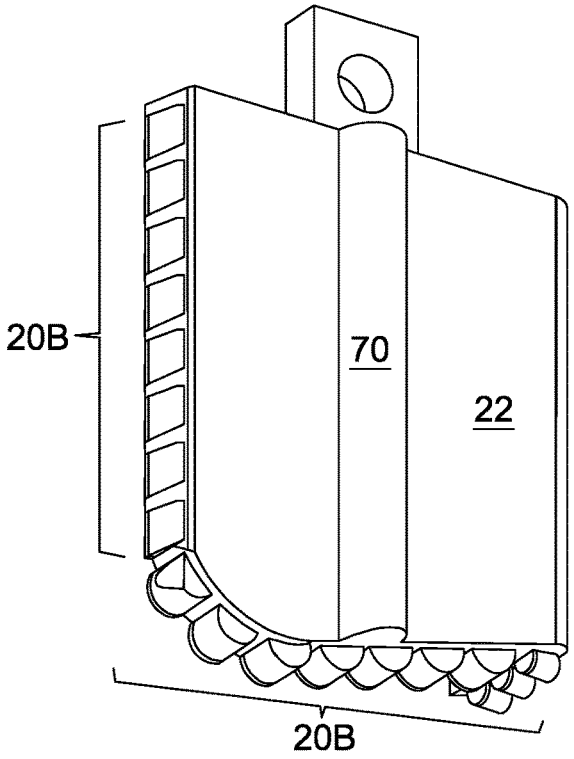

FIGS. 24 and 25 are perspective views of a blade 22 for use with a drill bit.

Figure 26:
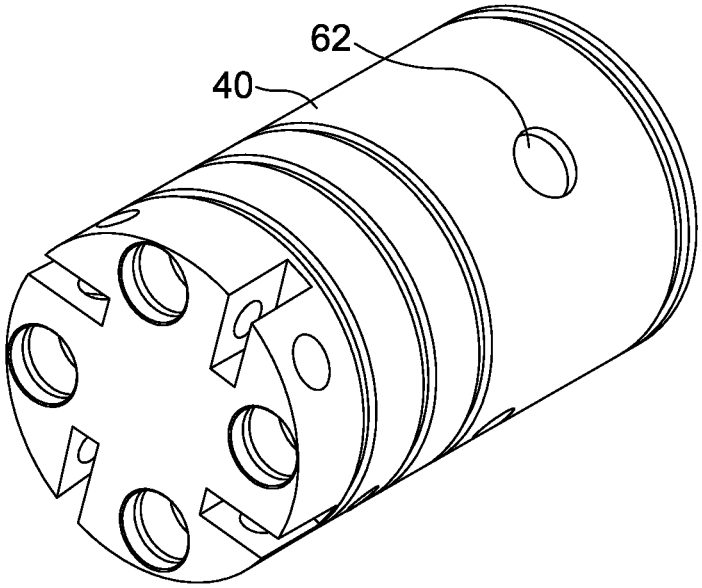
FIG. 26 is a perspective view of a piston.

FIG. 26 is a perspective view of a piston 40 for use with a drill bit. The grooves, slots and holes for receiving the seals 50, blades 22 and tubes 72 are visible.

FIGS. 27 to 32 show a further drill bit according to the present disclosure. The drill bit of FIGS. 27 to 32 is a 311.15 mm (12.25 inch) drill bit. The majority of the features of the drill bit of FIGS. 27 to 30 correspond to those of FIG. 5, albeit with slightly different dimensions and arrangements. As such, it should be assumed that features not explicitly described as being different to those of FIG. 5 operate in a corresponding manner to those of FIG. 5.

Figure 27:
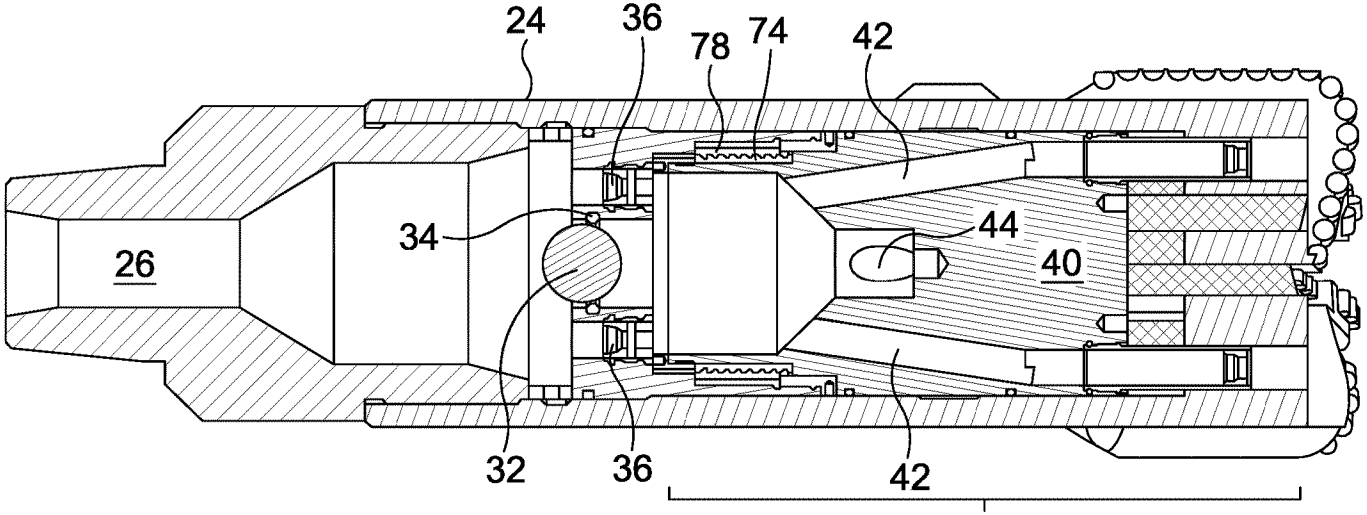
FIG. 27 is a cross-section of a further drill bit according to the disclosure in a first arrangement.
Figure 28:
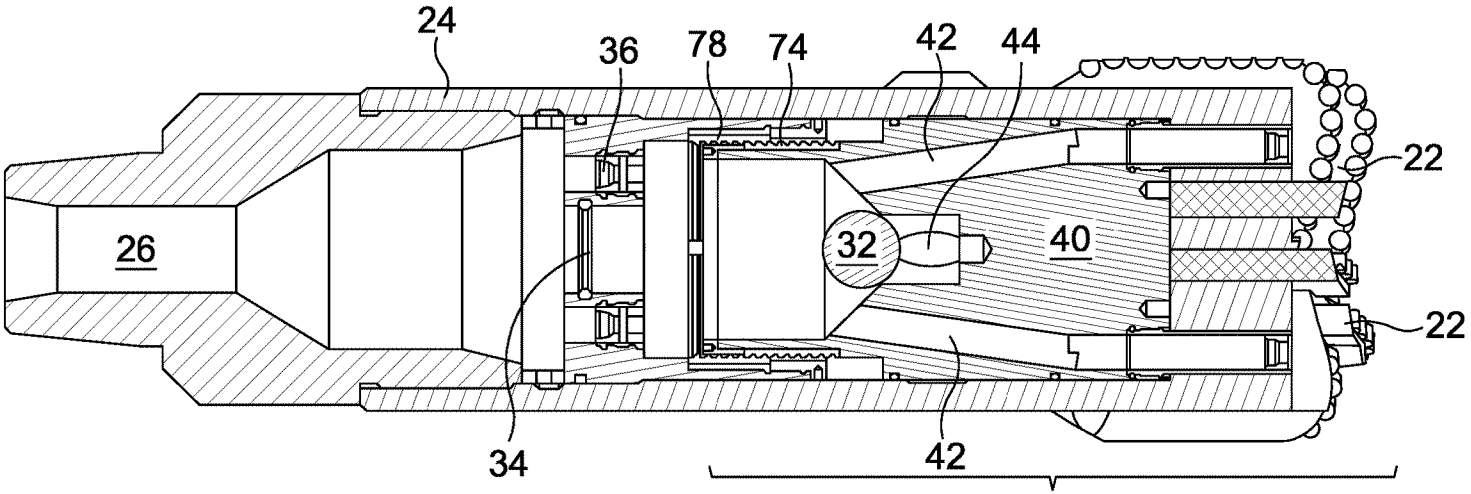
FIG. 28 is a cross-section of the drill bit of FIG. 27 in a second arrangement.
Figure 29:
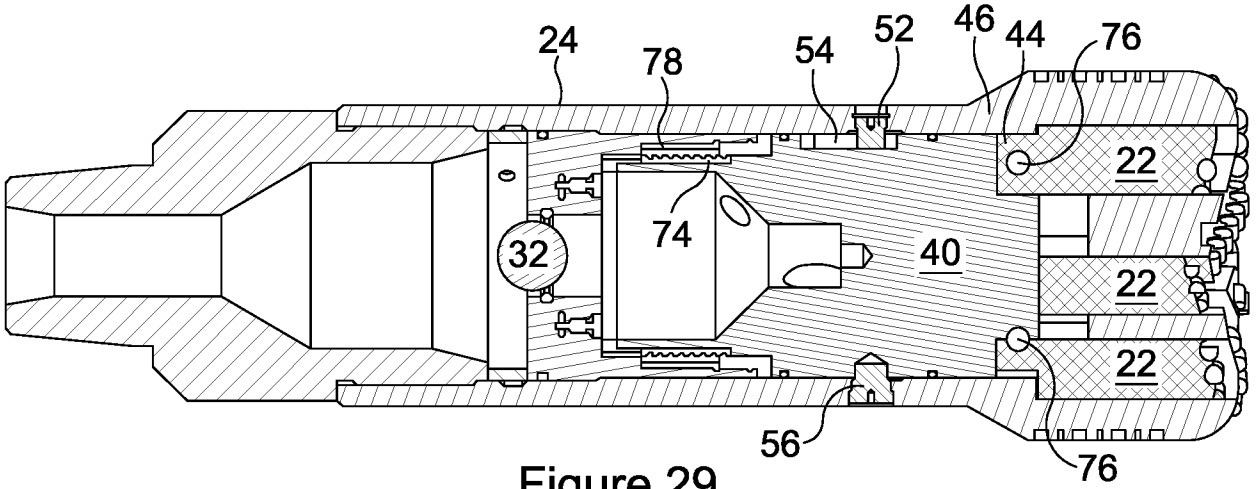
FIG. 29 is a further cross-section of the drill bit of FIG. 27 in a first arrangement.
Figure 30:
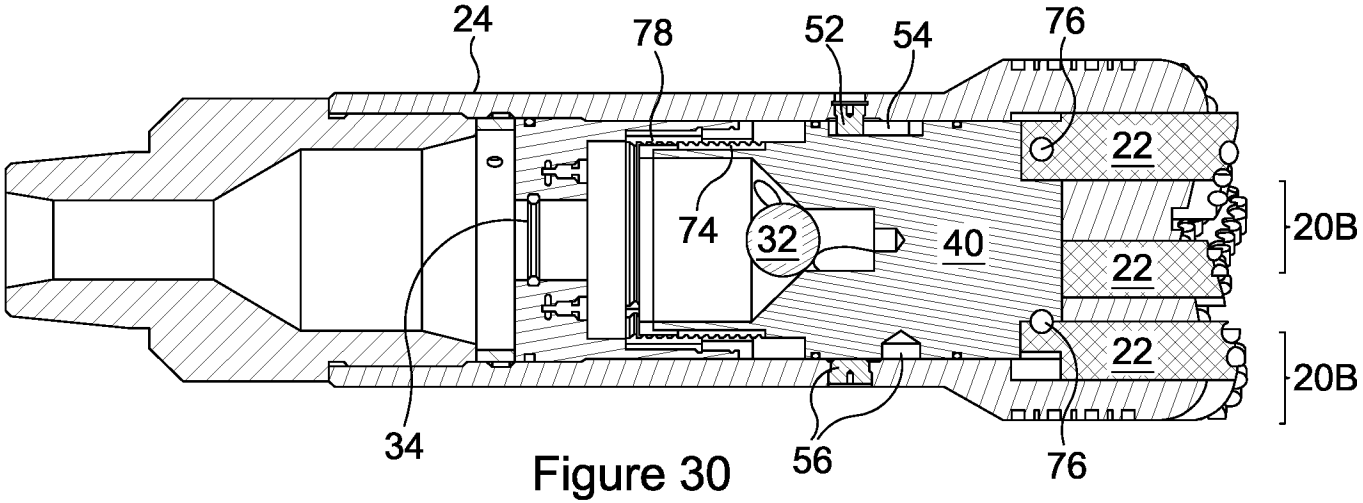
FIG. 30 is a further cross-section of the drill bit of FIG. 27 in a second arrangement.
Figure 31:
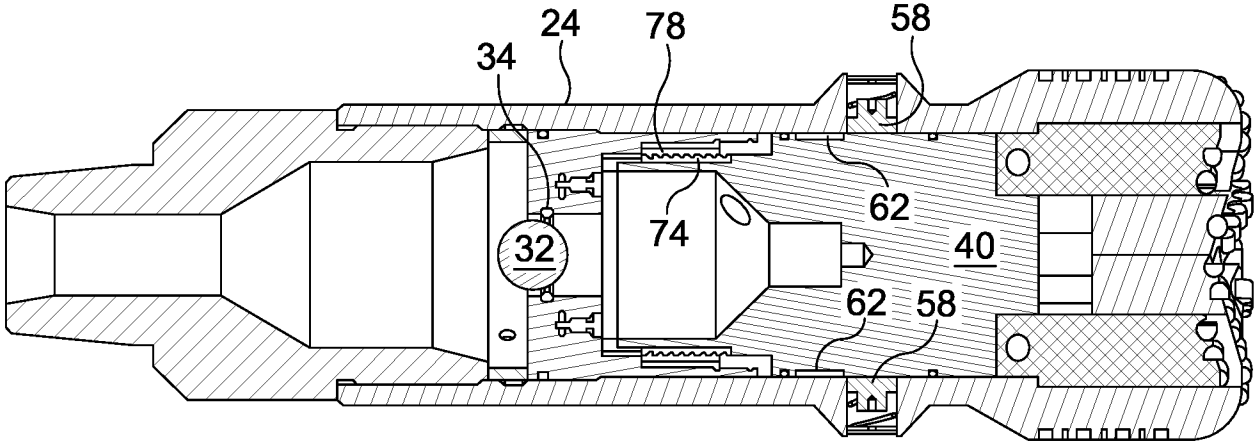
FIG. 31 is a further cross-section of the drill bit of FIG. 27 in a first arrangement.
Figure 32:
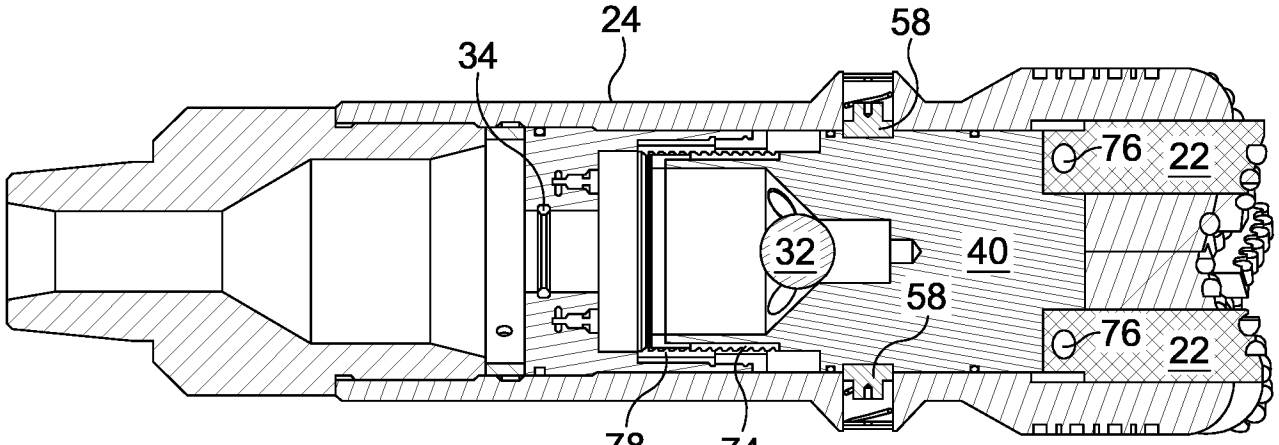
FIG. 32 is a further cross-section of the drill bit of FIG. 27 in a second arrangement.

With regard to the drill bit of FIG. 27, the blocking assembly and deployable blade assembly 38 operate in largely similar manners to those of FIG. 5. Drilling fluid enters the drill bit by means of drilling fluid inlet 26 and, when in the first arrangement, flows around the outside of the blocking assembly comprising a ball 32 and annular ring 34 using nozzles 36. The drilling fluid then flows through the piston 40 and out of the drill bit by means of the flow paths 42 44.

When the flow rate increases a pressure gradient across the ball 32 reaches a threshold value and the ball 32 moves through the annular ring 34 and locates on the seat 48 in the piston 40, thus blocking off a flow path 44. This then causes an increase in pressure gradient across the deployable blade assembly 38 and, once the pressure differential reaches a deployment value, a shear pin 56 is broken (see FIGS. 29 and 30) and the deployable blade assembly 38 moves from the first to the second position causing the cutting inserts 20B on the edges of blades 22 to protrude from the primary cutting structure 18 and thus providing a second, deployable cutting structure. As with the drill bit of FIG. 5, a guide pin 52 assists in guiding the movement of the piston 40 and a pair of locking pins 58 engage locking recesses 62 in the piston 40 when the piston 40 is in the second position (see FIGS. 31 and 32).

In order to move the blocking assembly from the first to the second arrangement, for a 311.15 mm (12.25 inch) drill bit, the pressure drop across the blocking assembly may increase from about 689.5 kPa (100 psi) at a flow rate of 54.6 litres per second (720 gpm) to about 1550 kPa (225 psi) at a flow rate of 81.8 litres per second (1080 gpm).

In the 311.15 mm (12.25 inch) drill bit described, the deployable blade assembly 38 moves about 44.5 mm (1.75 inches). However, other drill bits may move more or less than this amount.

The drill bit of FIG. 27 also comprises a split ratchet ring. The split ratchet ring is located between the outer housing and the deployable blade assembly 38, namely the piston 40. The split ratchet ring is configured to allow movement of the deployable blade assembly 38 towards the second position and prevent movement of the deployable blade assembly 38 away from the second position—that is the split ratchet ring is configured to only allow movement of the piston 40 towards the right in FIGS. 27 to 32.

In the drill bit of FIG. 27, the ratchet ring sub-assembly comprises an inner 74 and outer serrated sleeve 78. The inner serrated sleeve 74 is fixed relative to the piston 40 with the serrations facing outwards. The outer serrated sleeve 78 is fixed relative to the outer housing 24 with the serrations facing inwards. The inner and outer serrated sleeves 74 78 are arranged such that the serrations engage when the piston 40 is located inside the outer housing 24. The inner ring has no split while the outer ring has to be split to allow it to expand when the inner ring moves downwards.

In the drill bit of FIG. 27, the serrations have a first face at an oblique angle (e.g. about 45 degrees) to the longitudinal axis of the drill bit and a second face substantially perpendicular to the longitudinal axis of the drill bit. When the deployable blade assembly 38 is moving from the first position to the second position (that is, to the right in FIGS. 27 to 32), the angled surfaces of the two sleeves 74 78 engage and the inner sleeve 74 is able to slide relative to the outer sleeve 78. When the deployable blade assembly 38 is trying to move towards the first position from the second position (that is, to the left in FIGS. 27 to 32), the perpendicular faces ("straight faces") of the two sleeves 74 78 abut and prevent movement of inner sleeve 74 relative to the outer sleeve 78 and hence prevent movement of the movably blade assembly 38 towards the first position.

FIGS. 33 to 39 depict a drill bit similar to that of FIG. 27. A difference between the drill bit of FIGS. 33 to 39 and the drill bit of FIG. 27 is that the blocking assembly and the surrounding passageway arrangement is slightly modified—it can be seen that in the embodiment of FIG. 33, the ball 32 and annular ring 34 are housed in a defined central passageway, separated from the surrounding passageway(s) leading to the nozzles 36. Given that drilling fluid cannot pass through the annular ring 34 while the ball 32 is in the position shown in FIG. 33, there will be no flow of fluid in the length of passage 82 leading to the ball 32 and, as such, the ball 32 will feel a static fluid pressure. Only once the ball 32 has been released from the annular ring 34 will drilling fluid flow through the central passageway.

Figure 40:
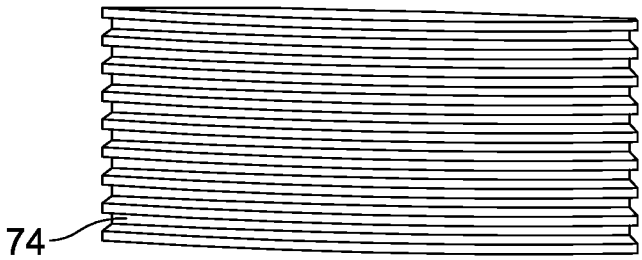
FIGS. 40 and 41 are sleeves for use as a ratchet in a drill bit according to the disclosure.
Figure 41:
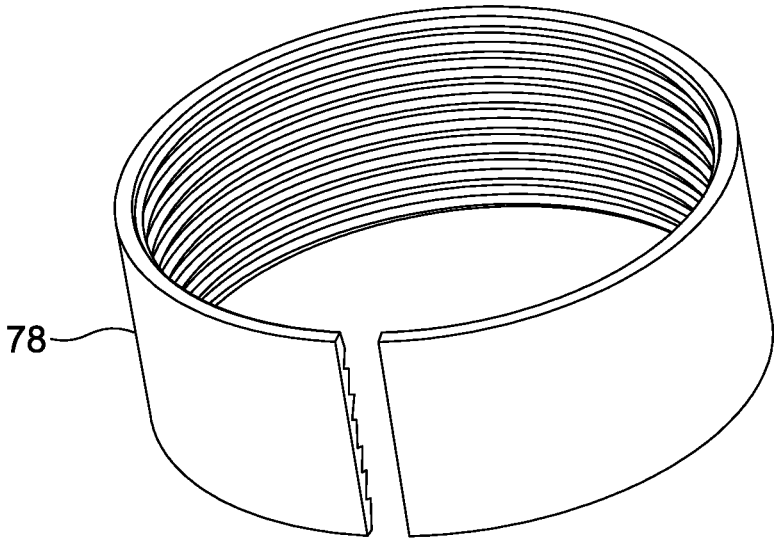

FIGS. 40 and 41 illustrate the internal serrated sleeve 74 and external serrated sleeve 78, respectively. It can be seen that the external-facing serrations of the internal serrated sleeve 74 are arranged to engage the internal-facing serrations of the external serrated sleeve 78. On both the internal 74 and external 78 serrated sleeve the serrations are in the form of a row of equi-spaced grooves of a helix. The profile of the serrations can be seen in FIG. 40. The profile is a saw tooth with a flattened top section. The profile of the serrations may be the same in both the internal 74 and external serrated sleeve 78 (although reversed in order to engage). The external serrated sleeve 78 has an axial split in order to allow the external serrated sleeve 78 to radially expand and contract as required for installation purposes and to more easily allow it to ride over the serrations of the internal sleeve 74 when the deployable blade assembly 38 is moving from the first to the second position.

Figure 33:
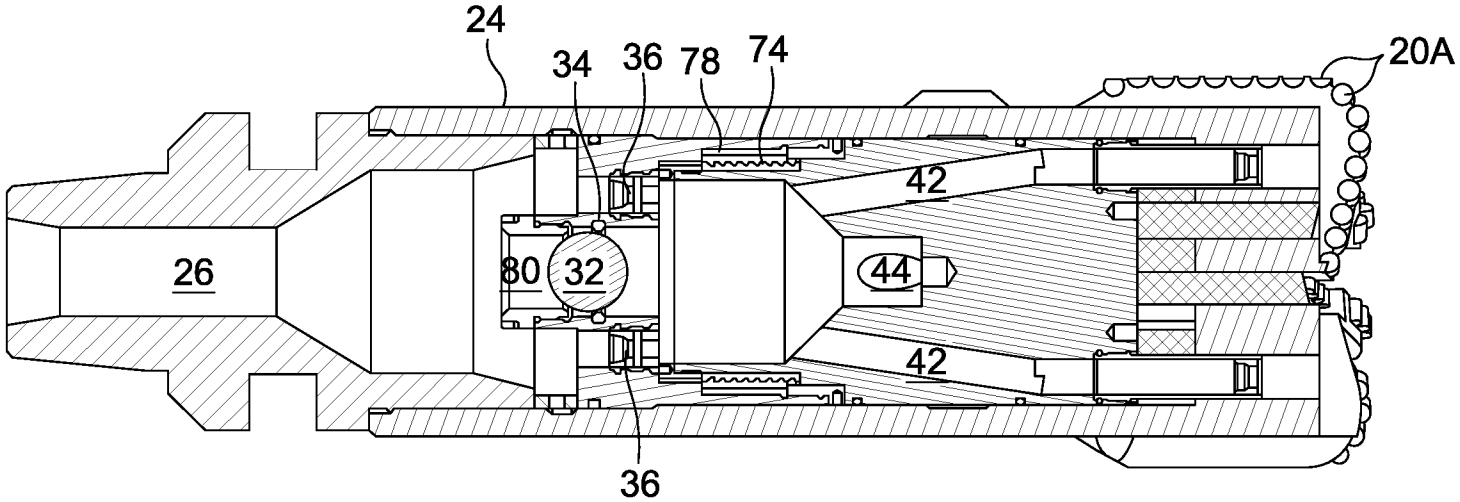
FIG. 33 is a cross-section of a further drill bit according to the disclosure in a first arrangement.
Figure 34:
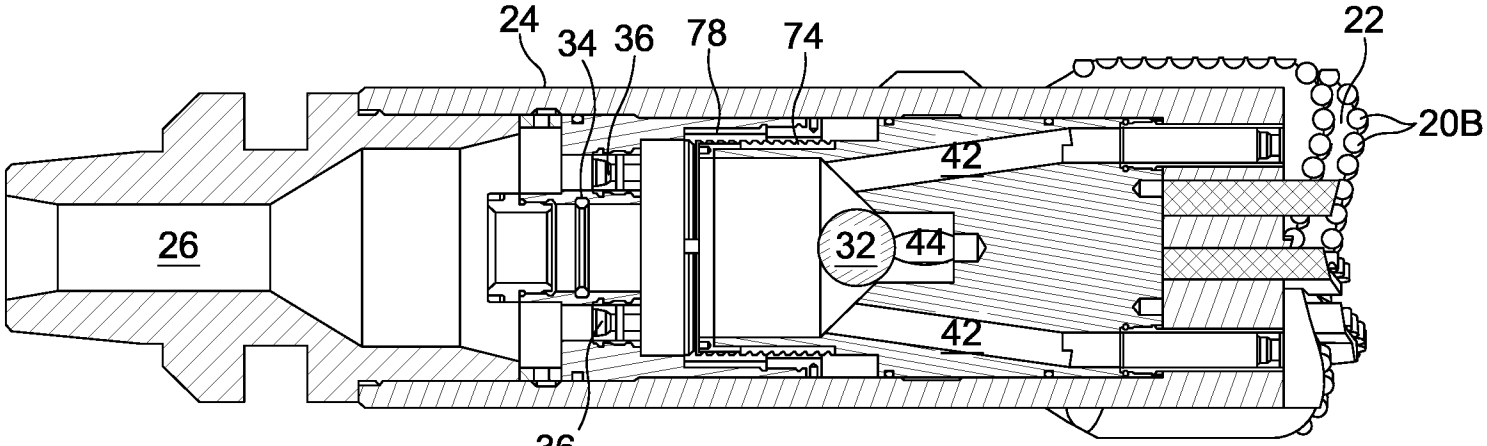
FIGS. 34 and 35 are cross-sections of the drill bit of FIG. 33 in a second arrangement.
Figure 35:
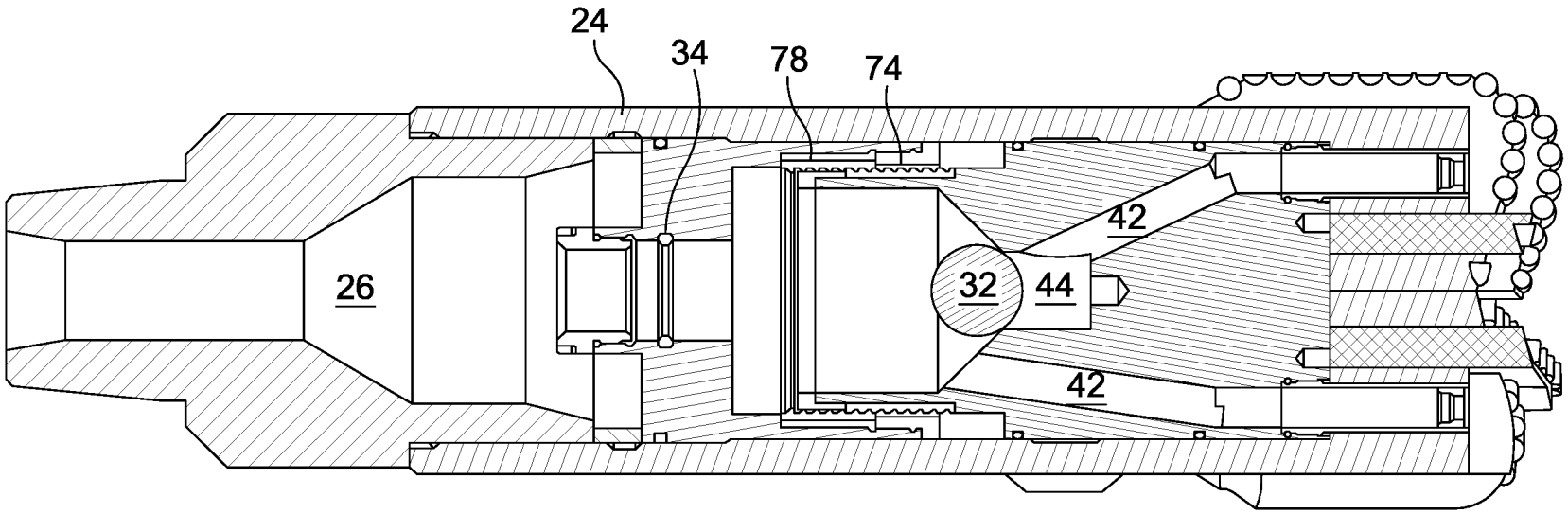
Figure 36:
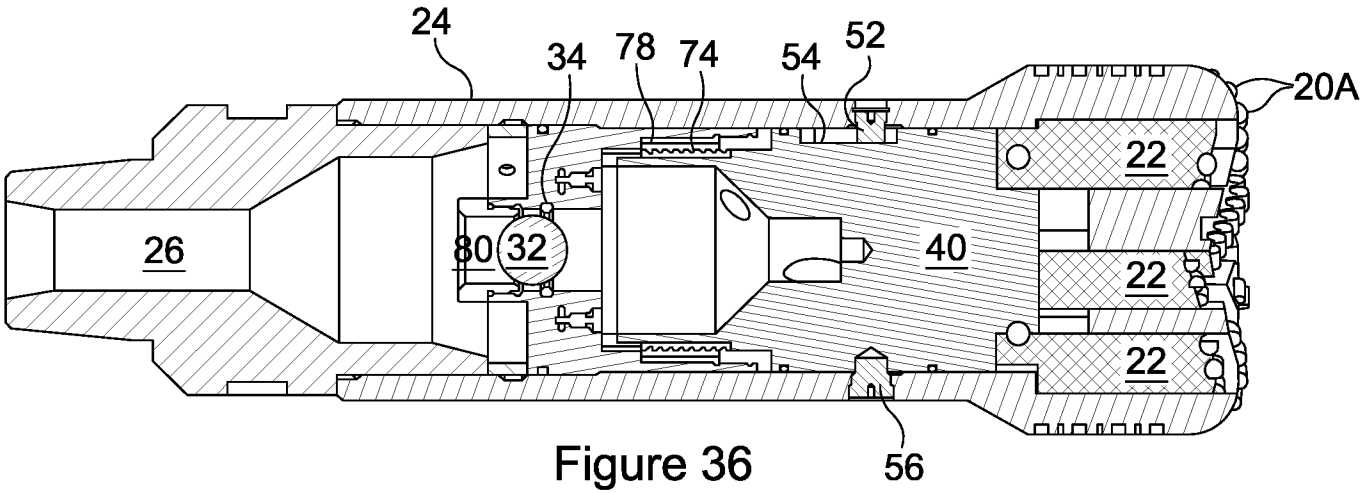
FIG. 36 is a further cross-section of the drill bit of FIG. 33 in a first arrangement.
Figure 37:
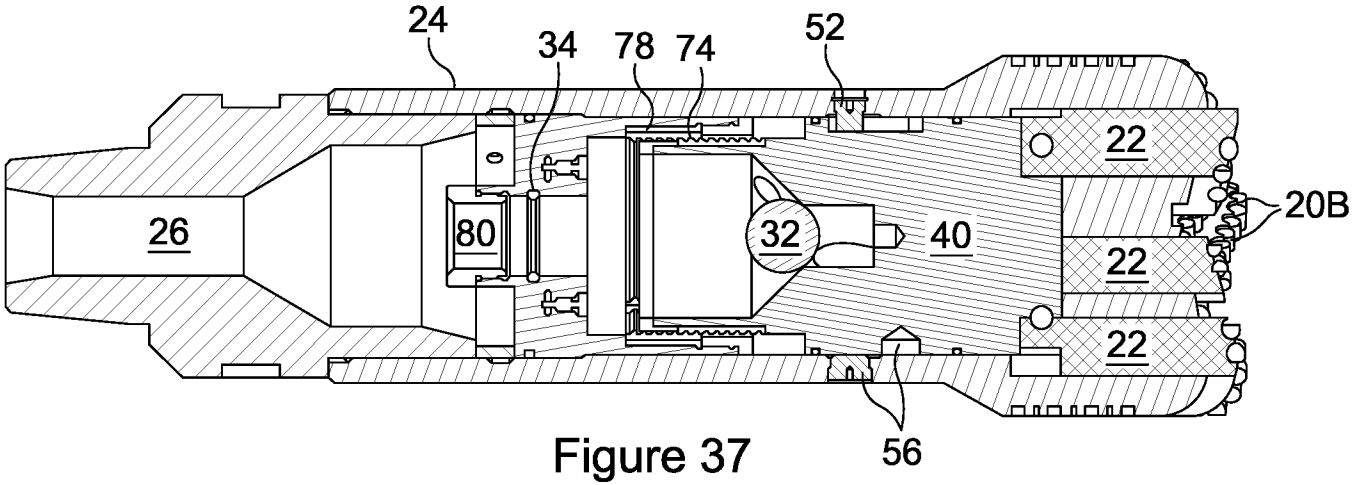
FIG. 37 is a further cross-section of the drill bit of FIG. 33 in a second arrangement.
Figure 38:
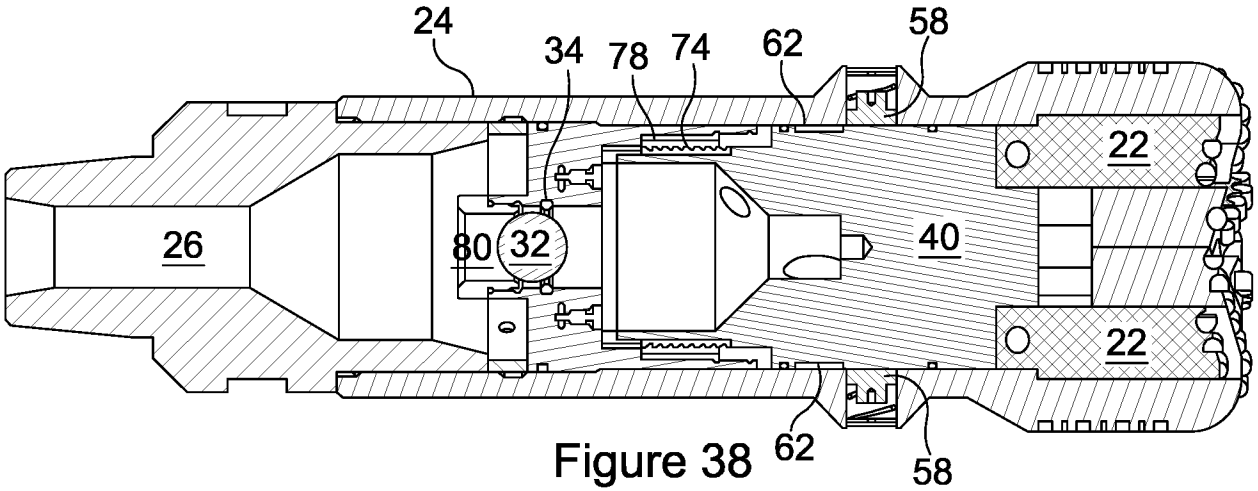
FIG. 38 is a further cross-section of the drill bit of FIG. 33 in a first arrangement.
Figure 39:
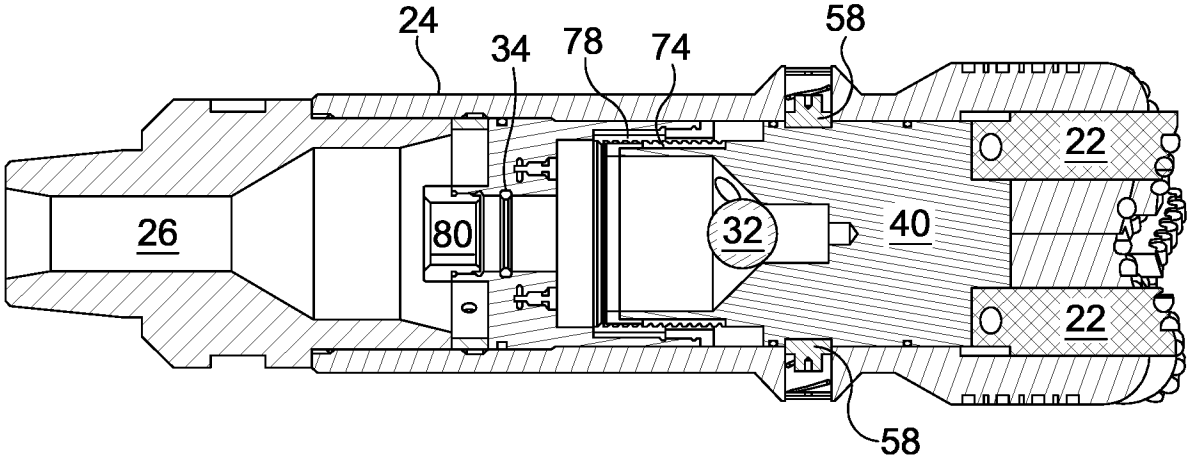
FIG. 39 is a further cross-section of the drill bit of FIG. 33 in a second arrangement.
Figure 42:
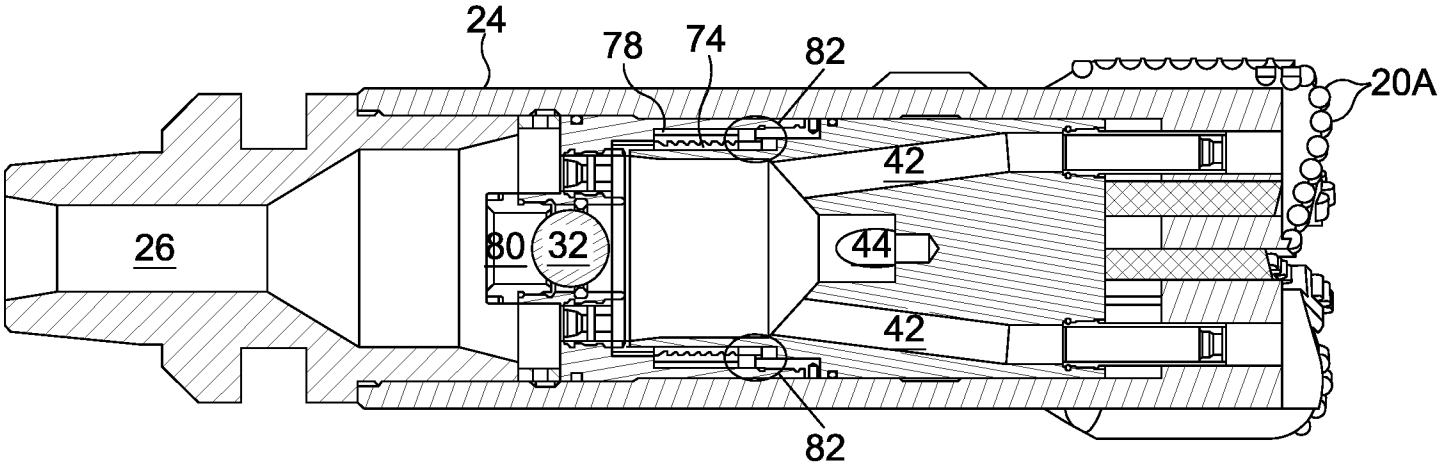
FIG. 42 is a cross-section of a further drill bit according to the disclosure in a first arrangement.
Figure 43:
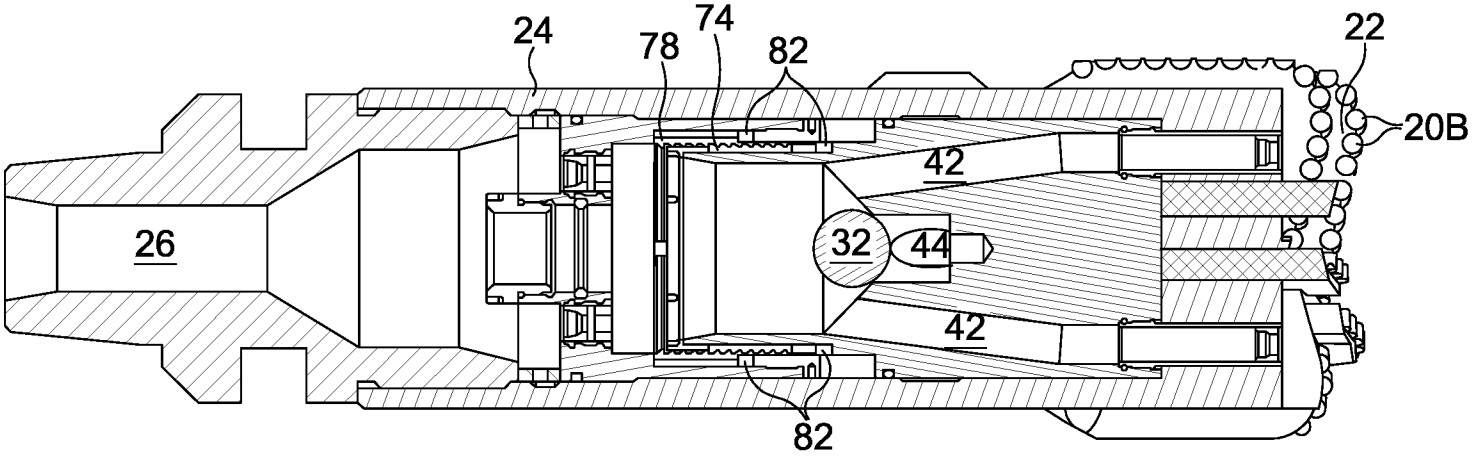
FIG. 43 is a cross-section of the drill bit of FIG. 42 in a second arrangement.

FIGS. 42 and 43 illustrate a drill bit largely similar to that of FIG. 33. A difference between the drill bit of FIG. 42 and that of FIG. 33 is that the deployable blade assembly 38 is held in the first position by a shear ring 82 rather than a shear pin 56. The shear ring 82 is located between the outer housing 24 and the piston 40 of the deployable blade assembly 38. One part of the shear ring 82 is fixed with respect to the outer housing 24 and another part is attached to the piston 40 such that, as the pressure differential across the deployable blade assembly 38 increases and the deployable blade assembly 38 is urged to the right of FIG. 42, the force exerted on the shear ring 82 increases. When the force in the shear ring 82 reaches a certain value, the shear ring 82 breaks, releasing the piston 40 with respect to the outer housing 24. The shear ring 82 therefore defines a threshold pressure differential at which the deployable blade assembly 38 moves from the first to the second position, referred to herein as the deployment value.

As a numerical example relating to the failure of the shear ring—when the ball 32 moves to the second arrangement and closes off one of the four flow paths through the piston, the pressure may jump up by 78% from about 4960 kPa to 8800 kPa (720 to 1280 psi). The failure pressure of the shear ring could be anywhere between 4960 kPa to 8800 kPa (720 to 1280 psi) but to give a good safety factor on the shear ring, about 6900 kPa (1000 psi) is chosen in this specific example. If the piston seal diameter is about 206 mm (8.125 inches), the piston area is about 0.033 $m^2$ (51.85 sq. inches). The load to the shear ring will be about 23500 kg (1000 psi×51.85=51849 lbs). If the ultimate tensile strength of the shear ring is about 827400 kPa (120000 psi), the area of the breakable region needed is about 279 $mm^2$ (0.432 sq inches). As the shear ring neck outer diameter is about 174 mm (6.85 inches), the inner diameter needed is about 173 mm (6.810 inches), to provide about a 0.5 mm (0.020 inch) wall section.

Figure 45:
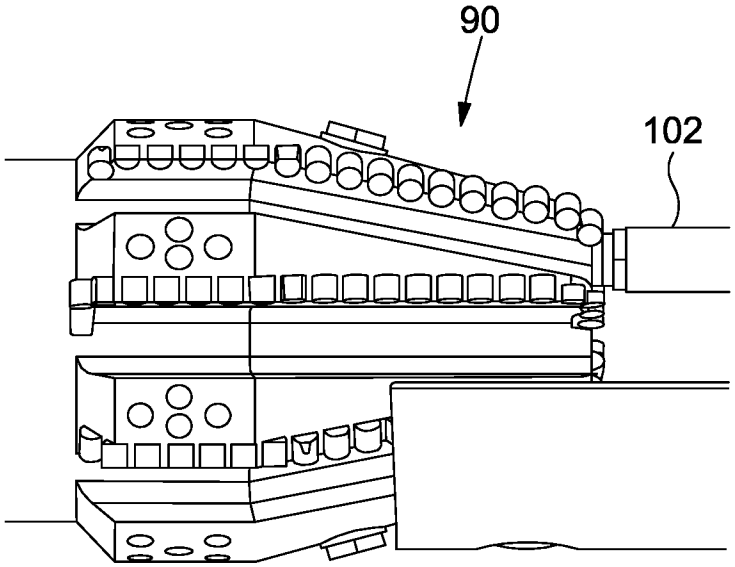
FIGS. 44 to 46 show a conventional whipstock milling system.
Figure 44:
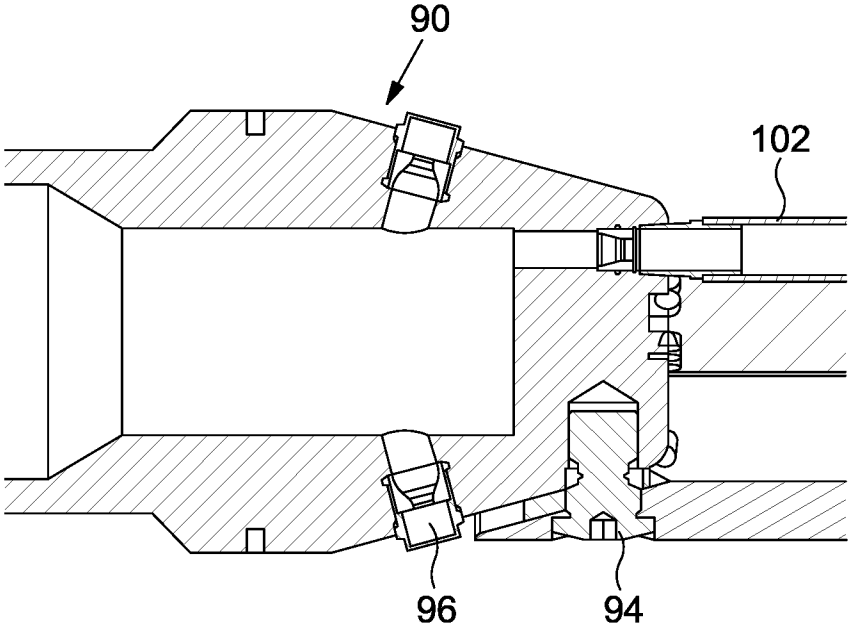
Figure 46:
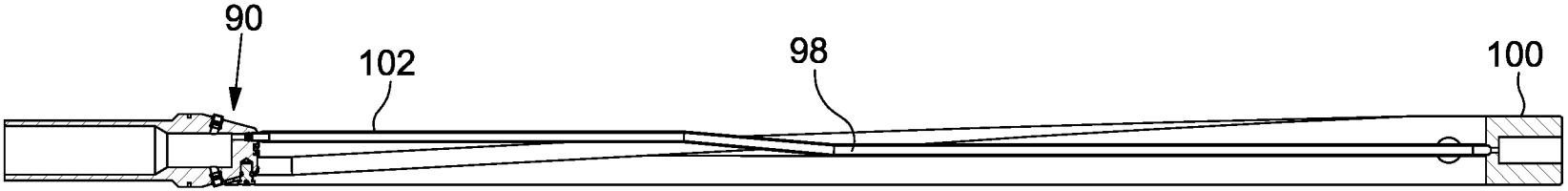

FIGS. 44 to 46 depict a known whipstock milling system comprising a drill bit 90 connected to a whipstock 92 by means of a shear bolt 94. All but one of the drilling fluid outlets in the drill bit 90 are sealed by knock-off plugs 96. The one outlet that is not sealed by a knock-off plug 96 is connected to a hose 102, the far end of which is threaded through a hole in the whipstock 98 and connected to a top of anchor-packer 100 such that the flow of drilling fluid can be used to activate the anchor-packer 100 using drilling fluid at a pressure of up to about 20684 kPa (3000 psi). When the whipstock milling system reaches the desired depth in the well bore, drilling fluid is pumped through the drill string. The drilling fluid flows through the one fluid outlet which is not sealed by a knock-off plug, through the hose 102 and into the anchor packer 100. The high-pressure drilling fluid activates the anchor-packer 100 which anchors the whipstock milling system within the wellbore.

Once the anchor-packer 100 sets the whipstock 92, upwards movement of the drill-string and so drill bit 90 causes the shear bolt 94 and the shearable connection between the hose 102 and the drill bit 90 to shear. The knock-off plugs 94 are knocked off once the drill bit 90 starts drilling operations.

Figure 47:
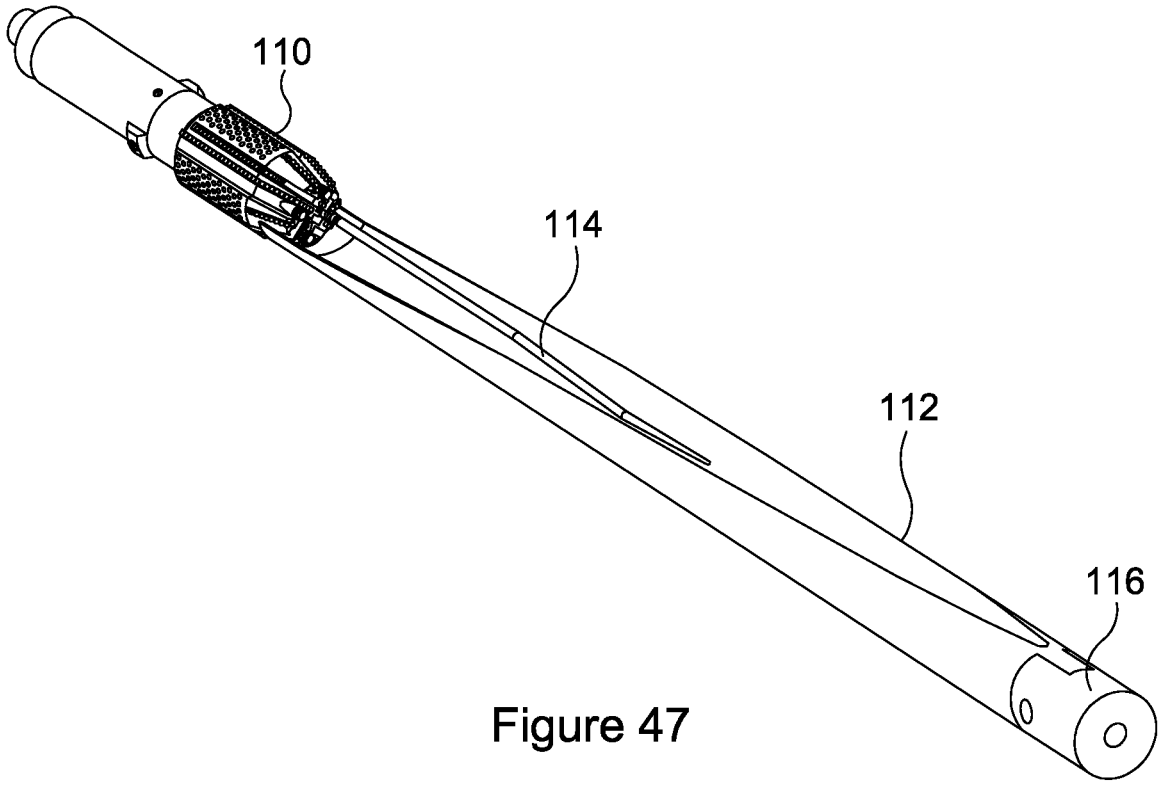
FIGS. 47 to 49 are views of a whipstock milling system comprising a drill bit according to the disclosure.
Figure 48:
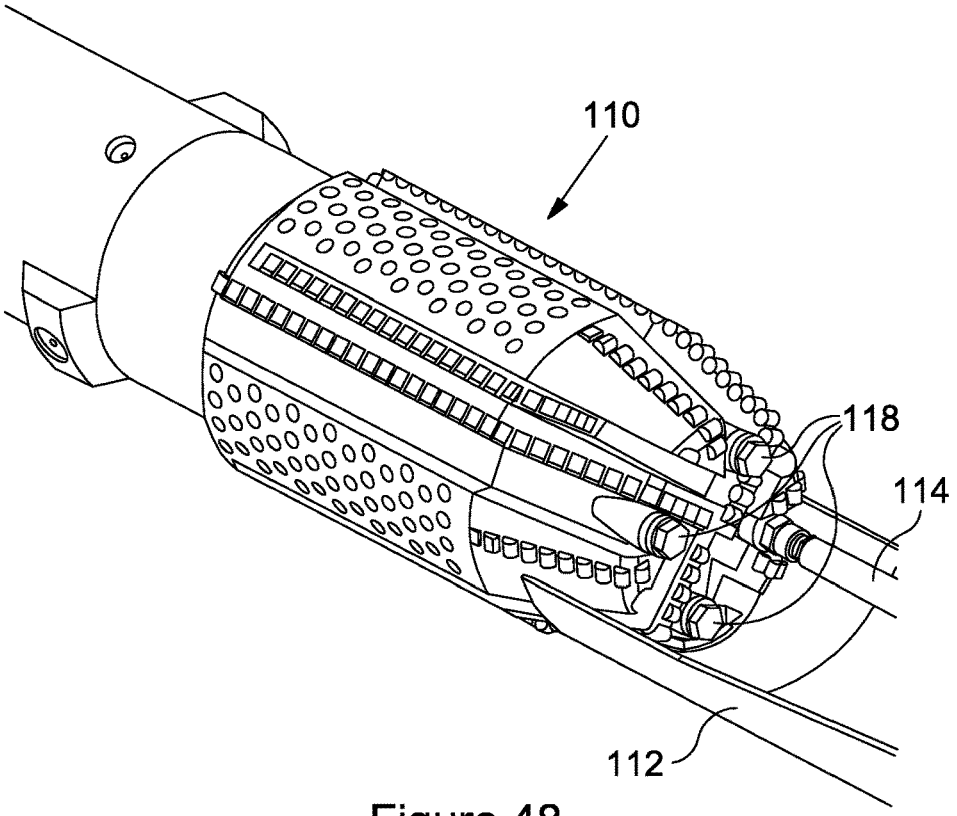
Figure 49:
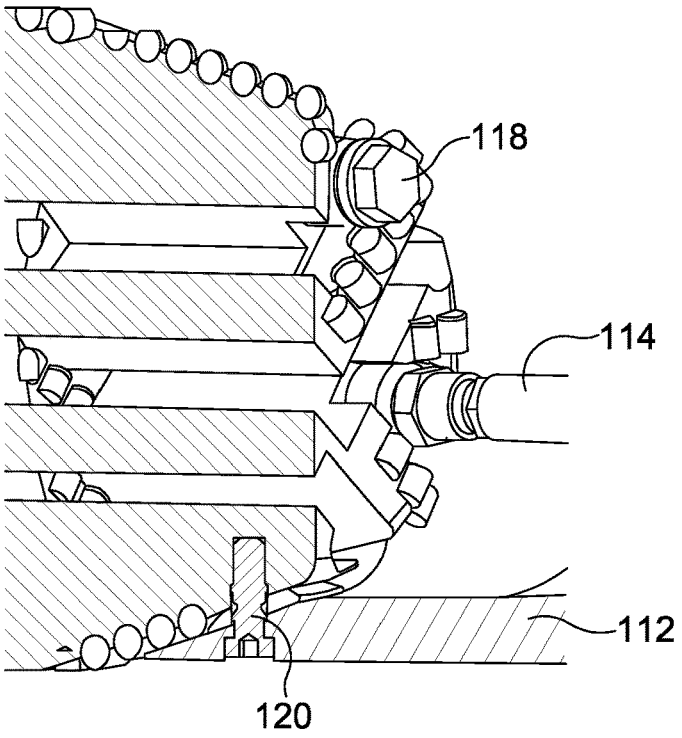

FIGS. 47 to 49 show a whipstock milling system according to the disclosure. The whipstock drilling system operates in a similar manner to the one described above. The whipstock milling system comprises a drill bit 110 connected to a whipstock 112 by a shearable bolt 120. A hose 114 extends from an outlet of the drill bit 110, through a hole in the whipstock 112 and connects to an anchor-packer 116 at the end of the whipstock 112. Knock-off plugs 118 seal the other outlets. Once drilling operations between, the knock-off plugs are knocked off from the outlets through interaction with the casing or rock face and drilling fluid flows therethrough.

Figure 50:
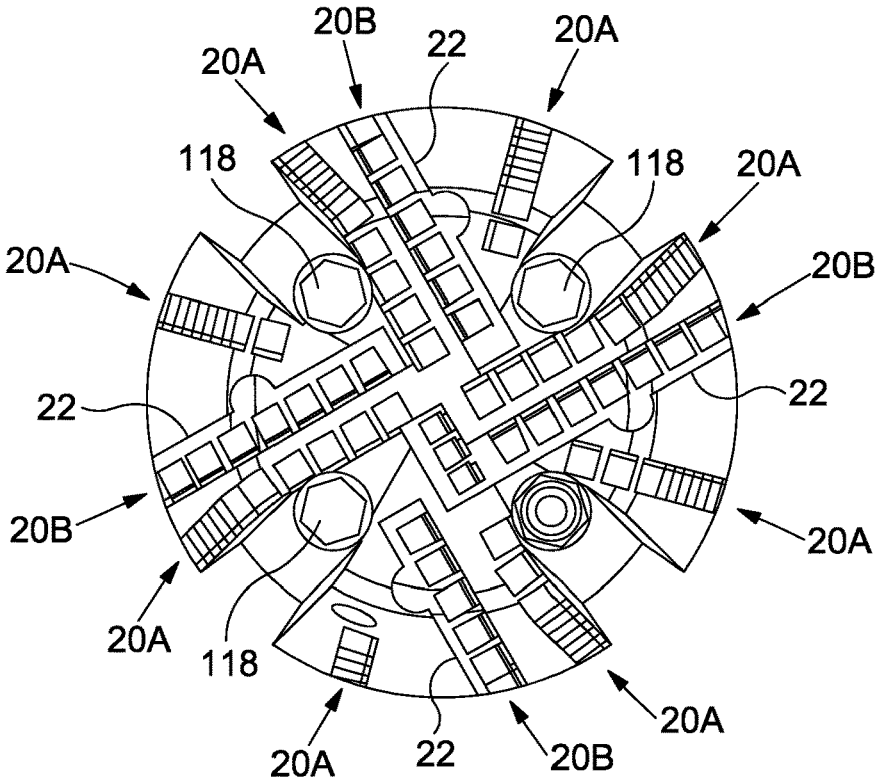
FIGS. 50 and 51 are end views of a drill bit according to the disclosure for use in a whipstock milling system.
Figure 51:
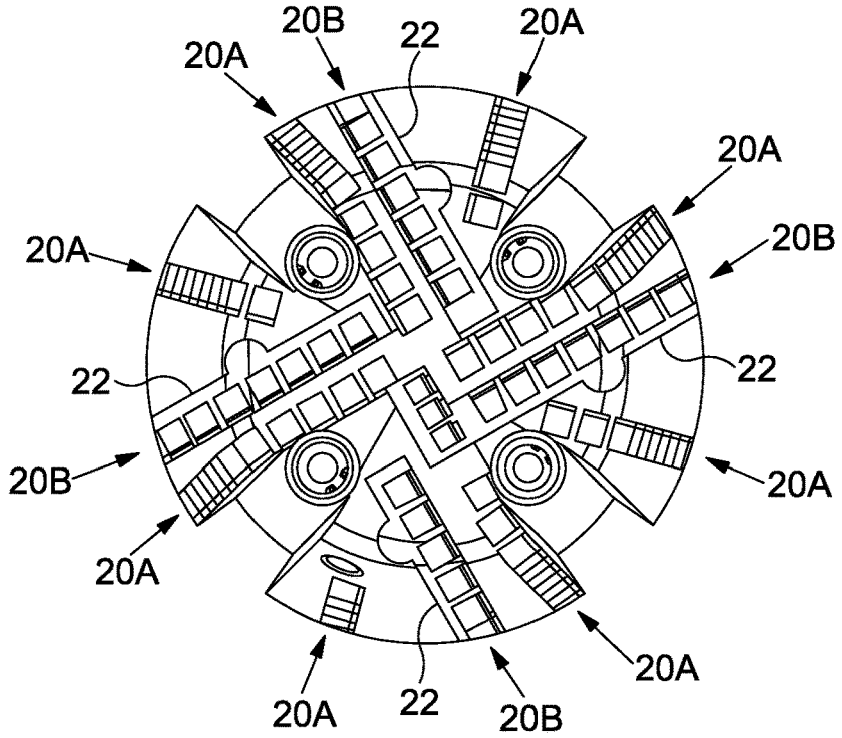

FIGS. 50 and 51 show an end face of the drill bit of a whipstock milling system before and after drilling operation has started. In FIG. 50 the knock-off plugs 118 are present. In FIG. 51, after drilling operations have begun, the knock-off plugs 118 have been knocked off and the outlets are open for drilling fluid flow.

The drill bit for use with a whipstock milling system is largely similar to the other drill bits described above. As can be seen from FIGS. 50 to 60 (and subsequent figures), the drill bit comprises corresponding features to the drill bits described above and operates in an analogous manner. The dimensions and profile of the drill bit for use with a whipstock milling system may be different to that of the drill bits described above, for example the length of the drill bit for use with a whipstock milling system may be longer than that of the previously-described drill bits. The operation and functions carried out by equivalent parts in the drill bit for the whipstock milling system and the above-described drill bits are equivalent. Accordingly, only a brief description of the drill bit will be provided below. It is to be understood that any description made above in relation to features corresponding to those shown in the following figures, applies to the features shown in the following figures, where appropriate and adapted as appropriate.

Figure 52:
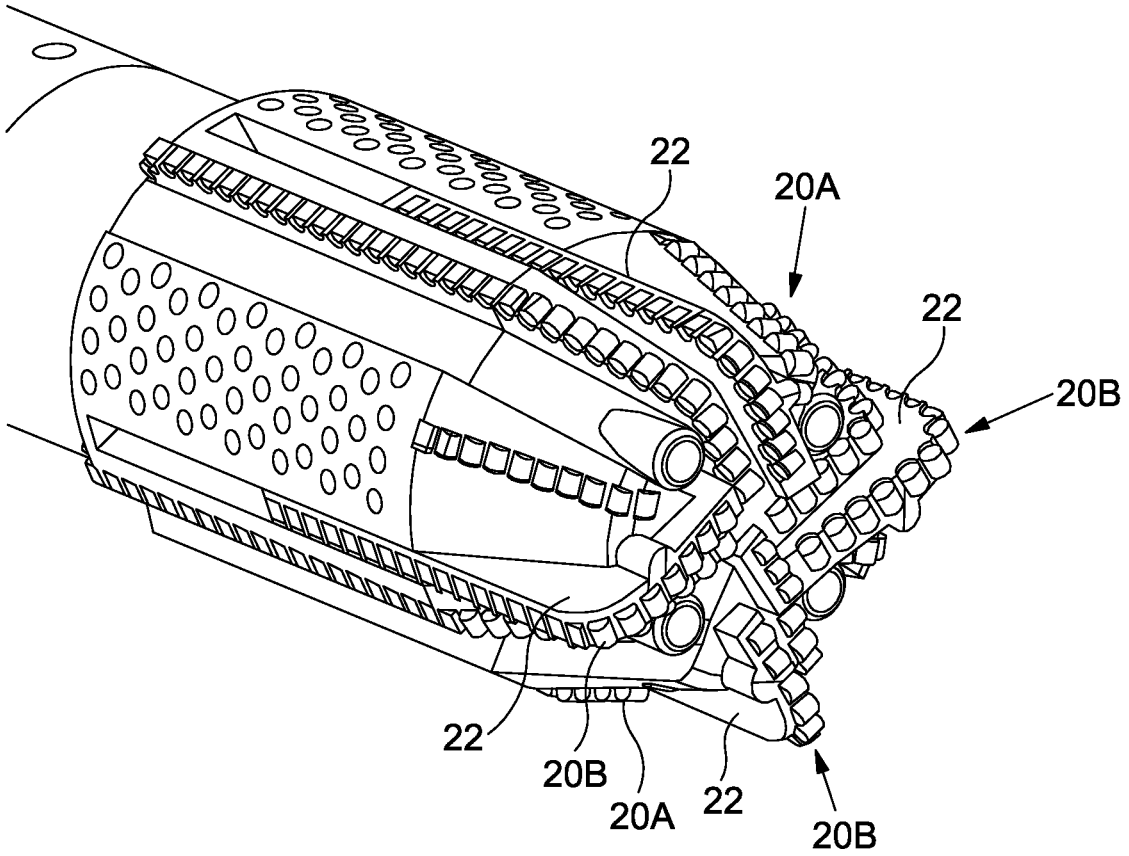
FIG. 52 is a perspective view of a drill bit according to the disclosure for use in a whipstock milling system in a second arrangement.
Figure 53:
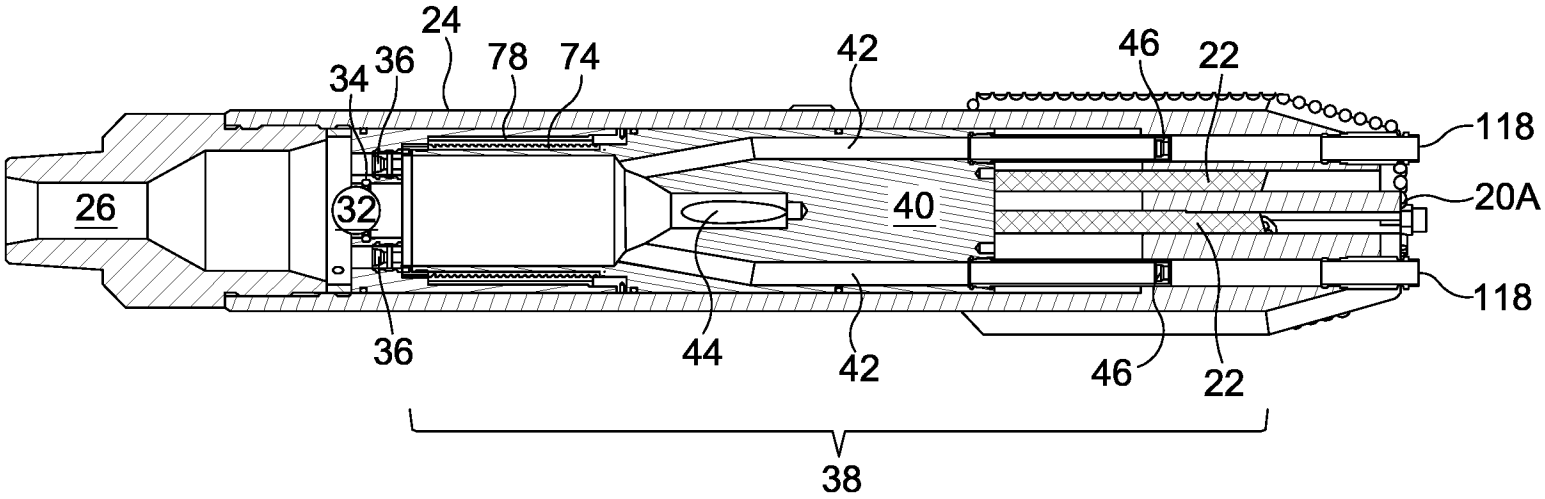
FIG. 53 is a cross-section of a further drill bit according to the disclosure in a first arrangement.
Figure 54:
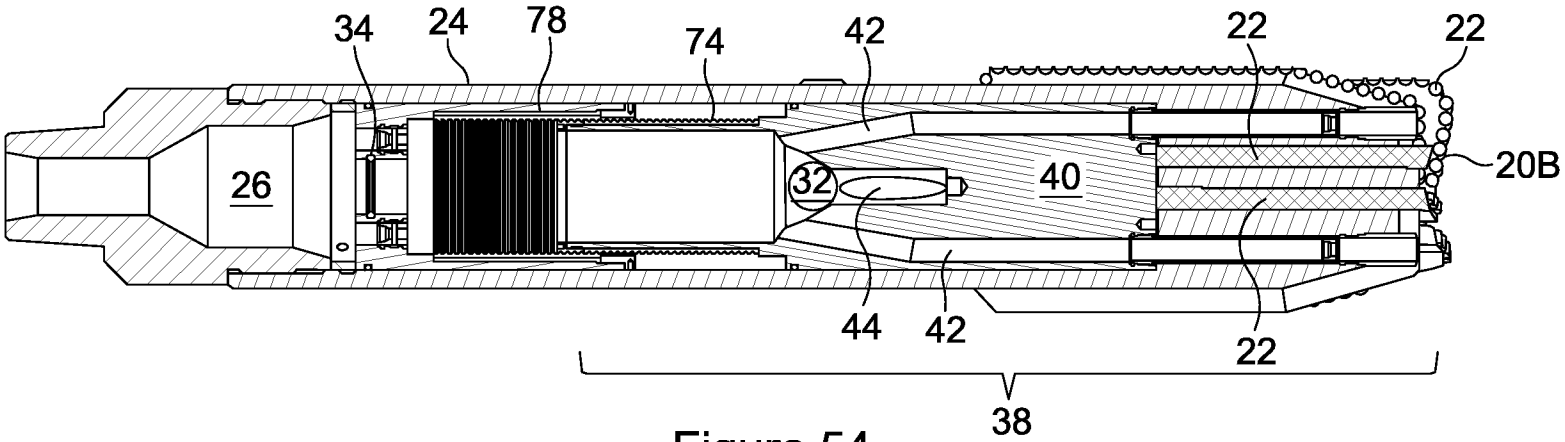
FIG. 54 is a cross-section of the drill bit of FIG. 53 in a second arrangement.
Figure 55:
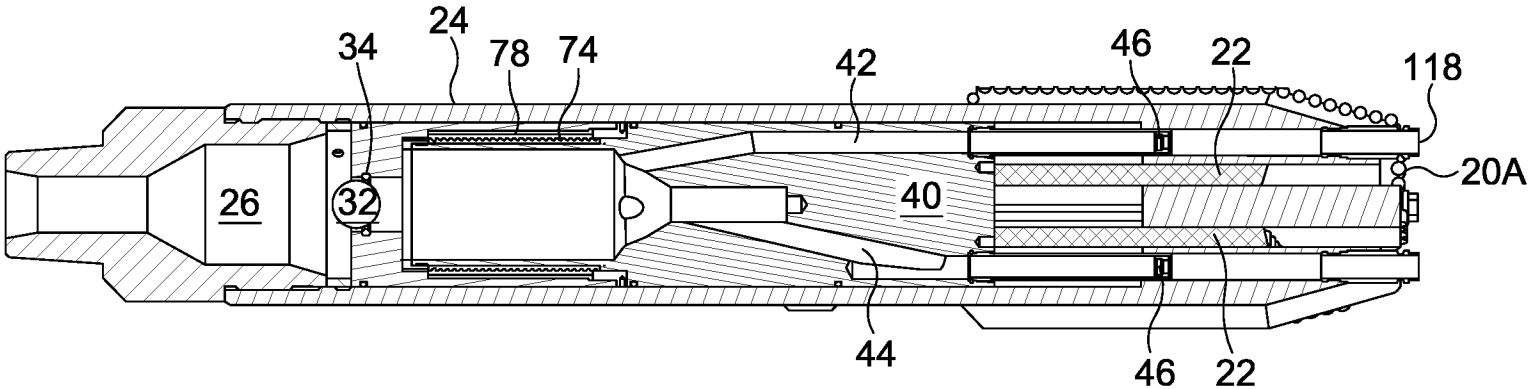
FIG. 55 is a further cross-section of the drill bit of FIG. 53 in a first arrangement.
Figure 56:
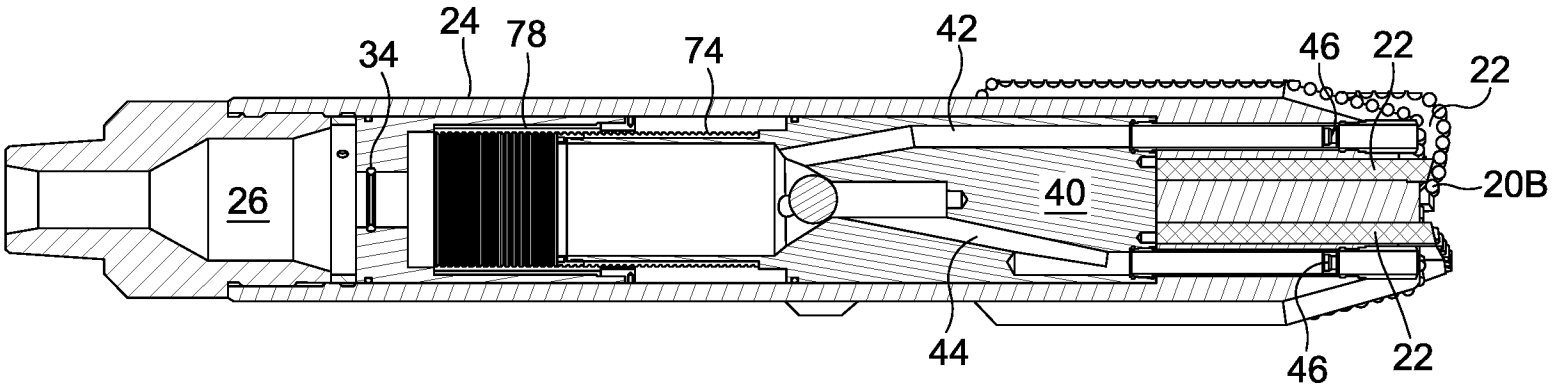
FIG. 56 is a further cross-section of the drill bit of FIG. 53 in a second arrangement.
Figure 57:
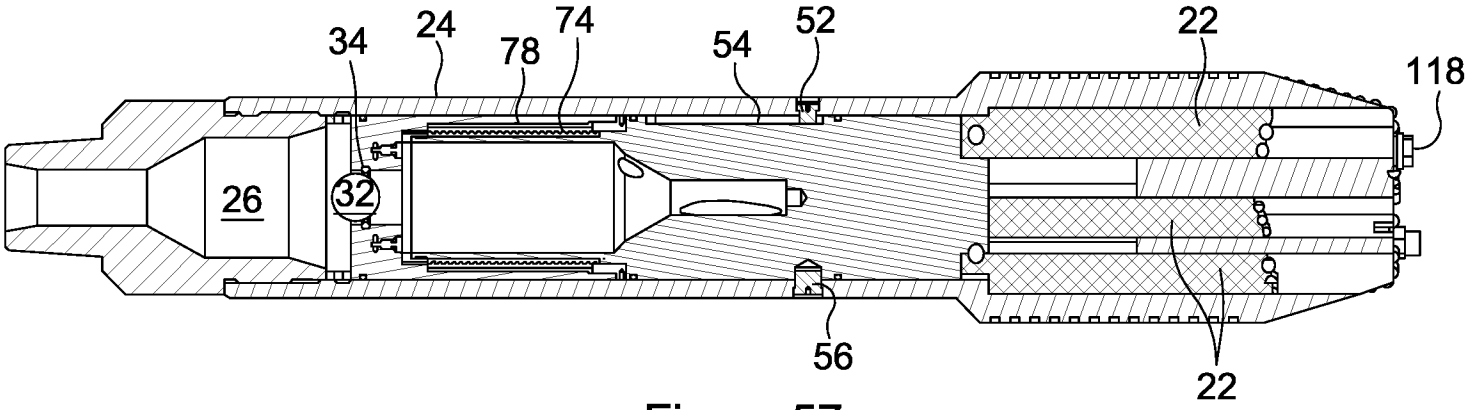
FIG. 57 is a further cross-section of the drill bit of FIG. 53 in a first arrangement.
Figure 58:
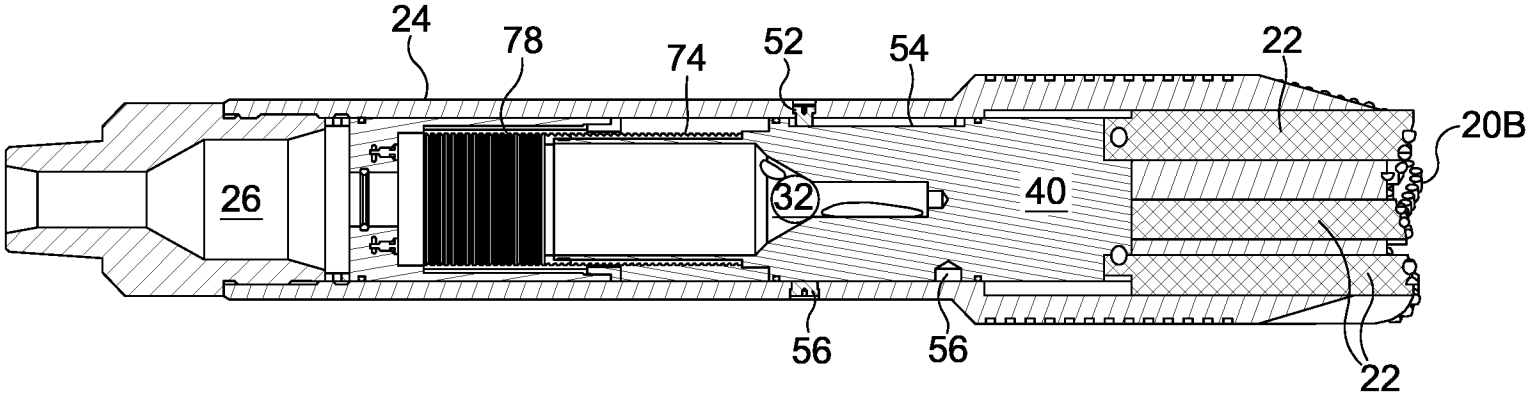
FIG. 58 is a further cross-section of the drill bit of FIG. 53 in a second arrangement.
Figure 59:
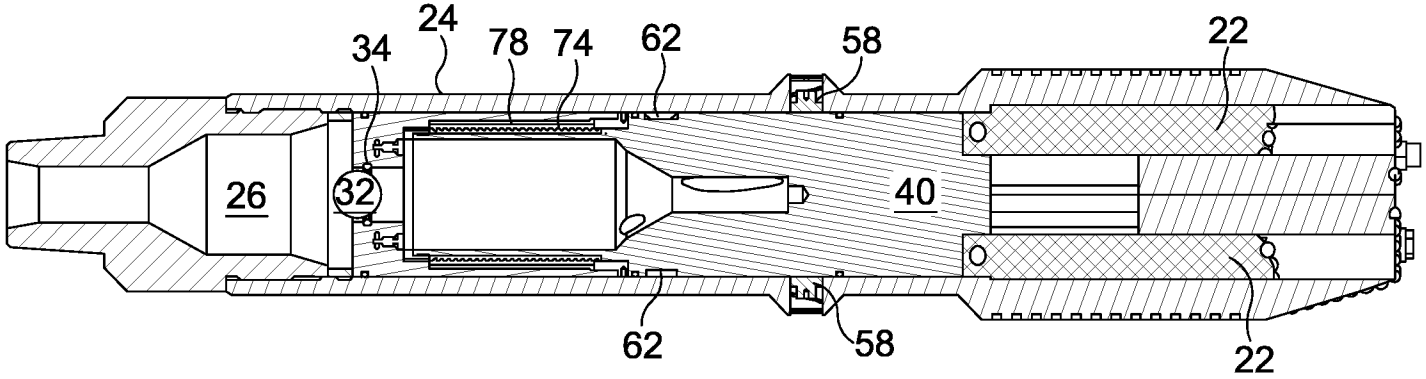
FIG. 59 is a further cross-section of the drill bit of FIG. 53 in a first arrangement.
Figure 60:
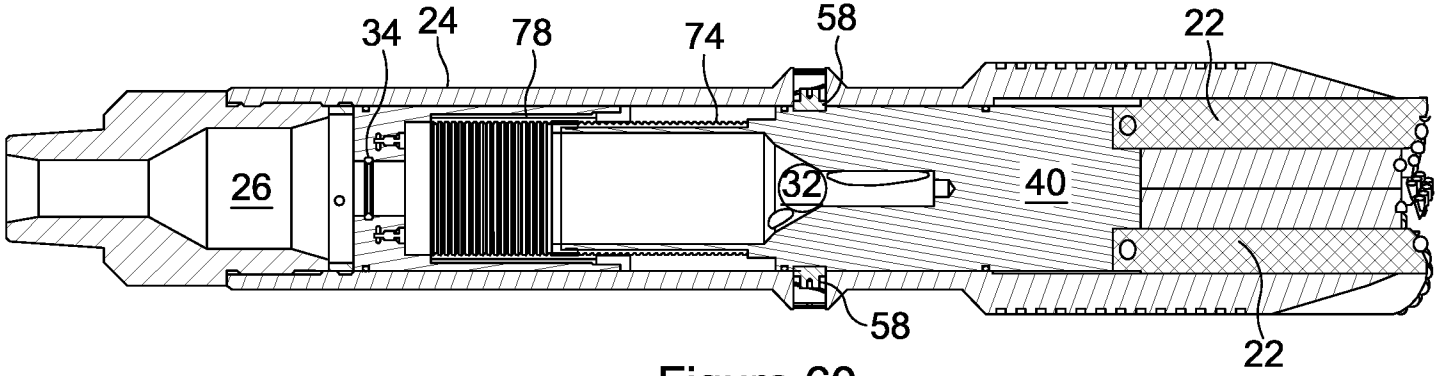
FIG. 60 is a further cross-section of the drill bit of FIG. 53 in a second arrangement.

As can be seen in FIGS. 50 to 52, the drill bit comprises a primary cutting structure 18 comprising a plurality of rows of cutting inserts 20A. The drill bit also comprises blades 22 as part of a deployable blade assembly 38, each of which comprises a row of cutting inserts 20B which can form a deployable cutting structure. FIG. 52 illustrates the blades 22 protruding from the primary cutting structure to provide a deployable cutting structure.

In a drill bit for use with a whipstock milling system, the cutting inserts 20A of the primary cutting structure 18 are made of a material which is suitable for drilling through steel casing located in a wellbore. The cutting inserts 20A in the primary cutting structure may therefore be tungsten carbide milling cutting inserts, for example. The cutting inserts 20B of the deployable cutting structure, attached to the blades 22, may be suitable for drilling formation. The cutting inserts 20B attached to the blades 22 may, therefore, be PDC cutting inserts, for example. This arrangement provides an advantageous system in which cutting inserts suited to the operation at hand are used at all times. Tungsten carbide cutting inserts—well suited to cutting through steel casing—can be used to mill a hole through the steel casing. Once a hole has been drilled through the steel casing, the drill bit can be activated such that the deployable blade assembly 38 moves to the second position and the deployable cutting structure is exposed. The deployable cutting structure utilises PDC cutting inserts and the drill bit is therefore now well suited to cutting through formation. The drill bit therefore has an element of adaptability. Once operations are complete, the drill string and drill bit can be drawn through the hole in the formation and steel casing, since the bores of the primary cutting structure 18 and deployable cutting structure are equal.

As with the drill bits described above, the primary cutting structure 18 and the deployable cutting structure define a bore with the same diameter. Accordingly, the bore of the hole through the steel casing is the same as that through the formation behind it and the drill bit can easily be withdrawn through the formation and casing, back to the surface.

FIGS. 53 to 60 are cross-sections of the drill bit. As with the drill bits described above, drilling fluid enters the drill bit by means of drilling fluid inlet 26 and, when the deployable blade assembly 38 is in the first position, the fluid flows around the outside of the blocking assembly comprising ball 32 and annular ring 34 using nozzles 36. The drilling fluid then flows through the piston 40 and out of the drill bit by means of the flow paths 42 44.

When the flow rate increases a pressure gradient across the ball 32 reaches a threshold value and the ball 32 moves through the annular ring 34 and locates on the seat 48 in the piston 40, thus blocking off a flow path 44. This then causes an increase in pressure gradient across the deployable blade assembly 38 and, once the pressure differential reaches the deployment value, a shear pin 56 is broken (see FIGS. 57 and 58) and the deployable blade assembly 38 moves from the first to the second position causing the cutting inserts 20B on the edges of blades 22 to protrude from the primary cutting structure 18 and thus providing a second, deployable cutting structure. As with the drill bit of FIG. 5, a guide pin 52 assists in guiding the movement of the piston 40 and a pair of locking pins 58 engage locking recesses 62 in the piston 40 when the piston 40 is in the second position (see FIGS. 59 and 60).

In a 311.15 mm (12.25 inch) drill bit for use with a whipstock milling system, the deployable blocking assembly moves about 187.3 mm (7.375 inches) from the first position to the second position.

The drill bit of FIGS. 53 to 60 also comprises a ratchet ring sub-assembly. The ratchet ring sub-assembly is located between the outer housing and the deployable blade assembly 38, namely the piston 40. The ratchet ring sub-assembly is configured to allow movement of the deployable blade assembly 38 towards the second position and prevent movement of the deployable blade assembly 38 away from the second position—that is the ratchet is configured to only allow movement of the piston 40 towards the right in FIGS. 53 to 60.

The ratchet ring sub-assembly comprises an inner 74 and outer serrated sleeve 78. The inner serrated sleeve 74 is fixed relative to the piston 40 with the serrations facing outwards. The outer serrated sleeve 78 is fixed relative to the outer housing 24 with the serrations facing inwards. The inner and outer serrated sleeves 74 78 are arranged such that the serrations engage when the piston 40 is located inside the outer housing 24.

The serrations have a first face at an oblique angle (e.g. about 45 degrees) to the longitudinal axis of the drill bit and a second face substantially perpendicular to the longitudinal axis of the drill bit. When the deployable blade assembly 38 is moving from the first position to the second position (that is, to the right in FIGS. 53 to 60), the angled surfaces of the two sleeves 74 78 engage and the inner sleeve 74 is able to slide relative to the outer sleeve 78. When the deployable blade assembly 38 is trying to move in the direction of the first position from the second (that is, to the left in FIGS. 53 to 60), the perpendicular faces of the two sleeves 74 78 abut and prevent movement of inner sleeve 74 relative to the outer sleeve 78 and hence prevent movement of the movably blade assembly 38 towards the first position.

Figure 61:
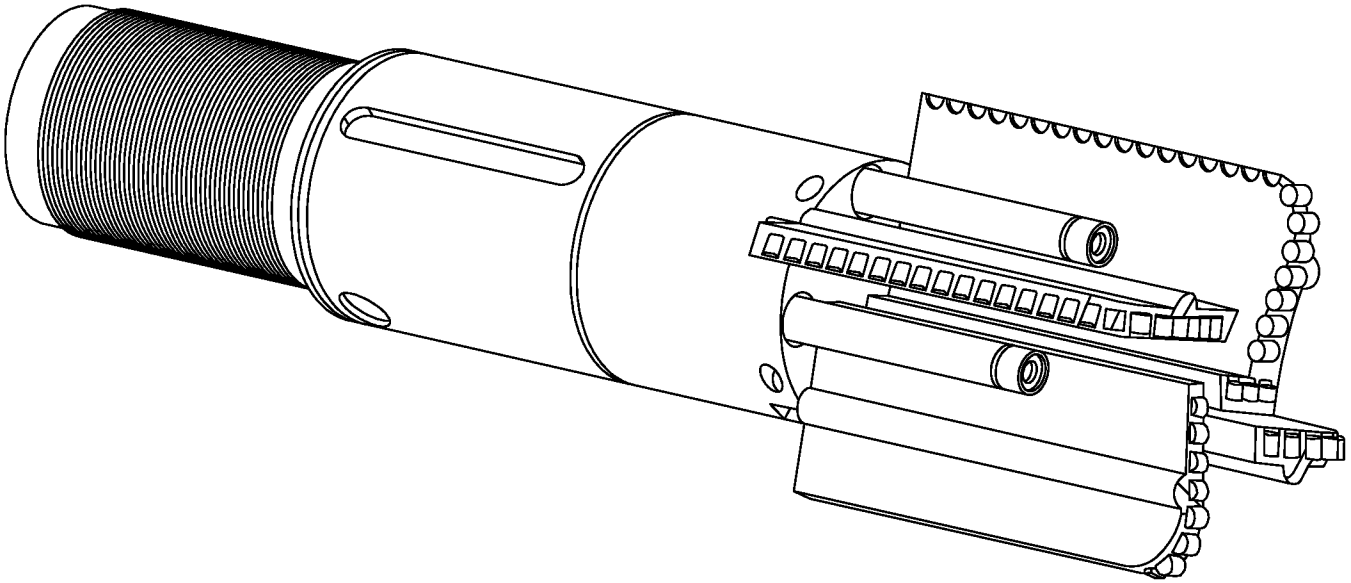
FIG. 61 is a perspective view of a deployable blade assembly for use with the drill bit of FIG. 53.

FIG. 61 shows a deployable blade assembly 38 of the drill bit, showing the piston 40 and blades 22.

Figure 62:
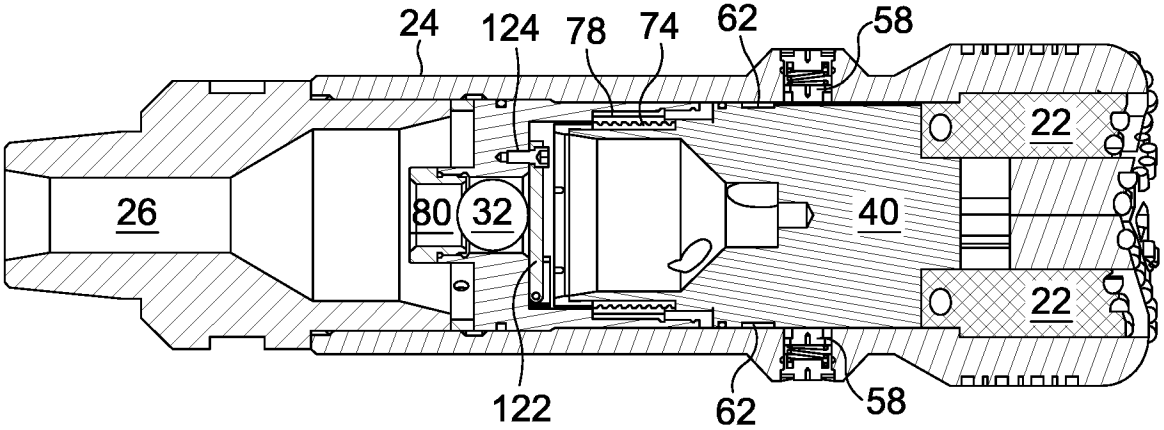
FIG. 62 is a cross-section of a further drill bit according to the disclosure in a first arrangement.
Figure 63:
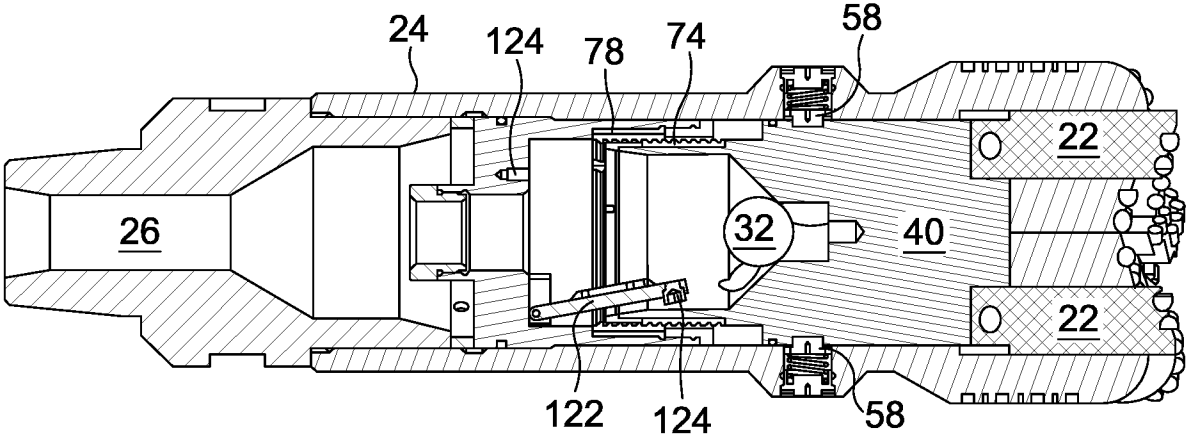
FIG. 63 is a cross-section of the drill bit of FIG. 62 in a second arrangement.
Figure 64:
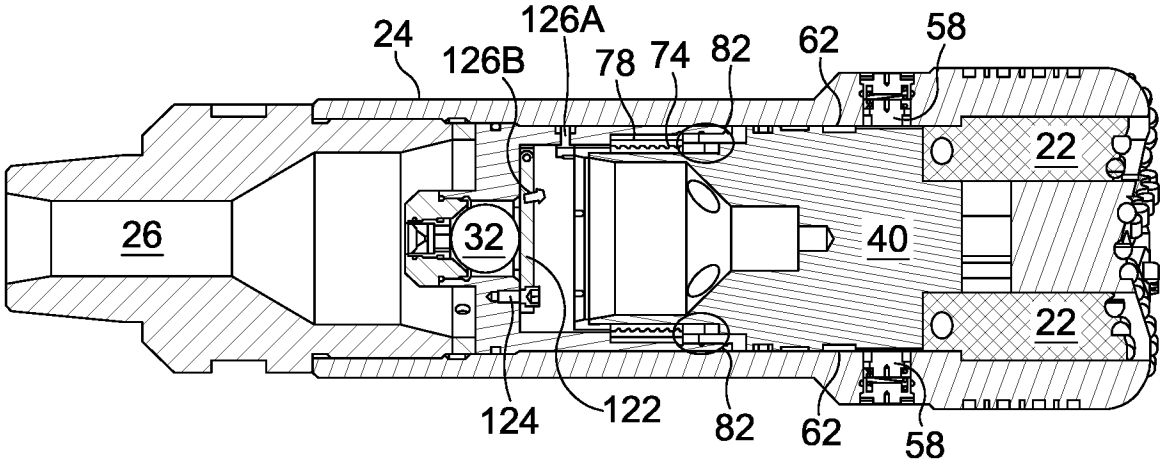
FIG. 64 is a cross-section of a further drill bit according to the disclosure in a first arrangement.

Drill bits according to the disclosure may comprise blocking assemblies which vary from that described above. FIGS. 62 and 63 depict a drill bit with an outer housing 24, deployable blade assembly 39, ratchet ring sub-assembly and lock pin 58—among other features—as described above. However, the restraint of the blocking assembly comprises a hinged gate 122 and a shearable screw 124. When the blocking assembly is in a first arrangement, as shown in FIG. 62, the hinged gate 122 is in a closed position—preventing the ball 32 from passing through the central passageway 80. The hinged gate 122 is held in the closed position by a fastener, specifically a shearable screw 124, which is fixed with respect to both the hinged gate 122 and the outer housing 24.

Shearable screw 124 is configured to shear when a certain force is applied to it. As such, as the flow rate through the drill bit increases, the pressure differential across the ball 32 and hinged gate 122 increases, creating a resultant force on the hinged gate 122 which is supported by the shearable screw 124. When the pressure gradient across the ball 32 and gate 122 reaches a threshold value, the shearable screw 124 fails, the hinged gate 122 opens, the ball 32 moves towards the piston and the blocking assembly moves to the second arrangement.

Once the ball 32 is released, the drill bit operates in an analogous manner to the drill bits described above. The ball 32 locates in the seat 48 in the piston 40 and blocks off a flow path 44. This causes an increase in the pressure differential across the deployable blade assembly 38 and, when the pressure differential reaches a certain value—the deployment value—a shearable member (e.g. a shear pin) breaks and the deployable blade assembly moves to the second position, exposing the deployable cutting structure, as shown in FIG. 63.

Example data for a 215.9 mm (8.5 inch) drill bit as described above is as follows.

Ultimate load to break the shear pin holding the deployable blade assembly in the first position: diameter: about 20.5 mm (0.808 INS); area: about 329 $mm^2$ (0.51 square inches); material: brass; ultimate shear strength: about 241320 kPa (35,000 psi); LOAD: about 8100 kg (17,850 LBS).

Required pressure differential across the movable blade assembly to shear the shear pin holding the deployable blade assembly in the first position: bore diameter: about 142.9 mm (5.625 inches); piston area: about 0.016 $m^2$ (24.9 SQ INS); pressure: about 4940 kPa (717 PSI).

Figure 65:
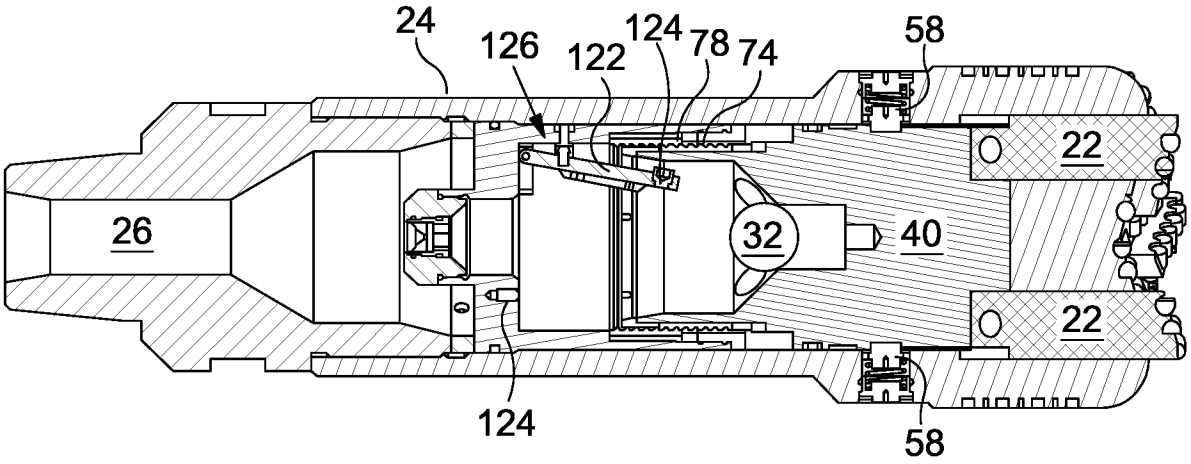
FIG. 65 is a cross-section of the drill bit of FIG. 64 in a second arrangement.
Figure 66:
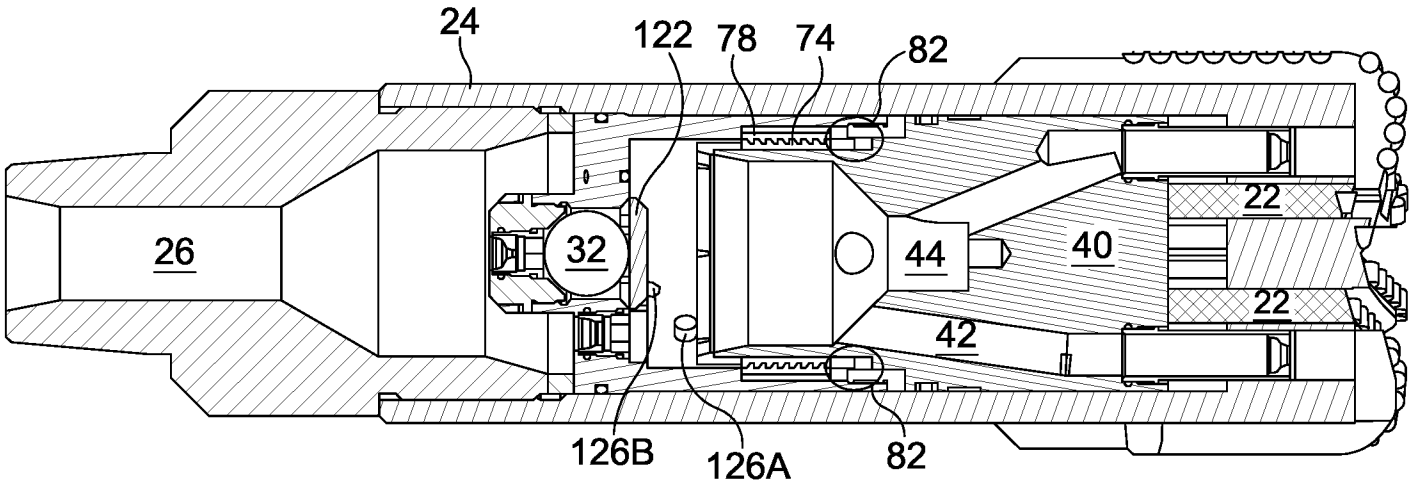
FIG. 66 is a further cross-section of the drill bit of FIG. 64 in a first arrangement.
Figure 67:
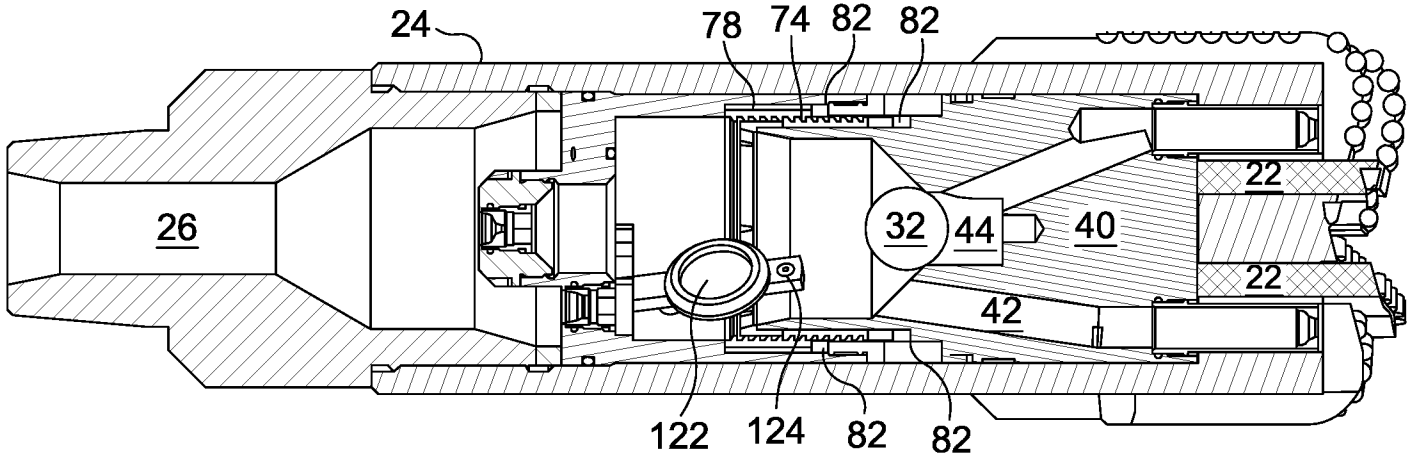
FIG. 67 is a further cross-section of the drill bit of FIG. 64 in a second arrangement.

FIGS. 64 to 67 illustrate a further example of a blocking assembly. As before, features not forming part of the blocking assembly are as described above and comments made above relating to these features apply, where appropriate and adapted as appropriate. Similarly to the drill bit of FIG. 62, the blocking assembly of the drill bit of FIG. 64 includes a ball 32 and a gate 122 held in the first arrangement by shearable screw 124. The operation of the ball 32, gate 122 and shearable screw 124 is as previously described. Additionally, the blocking assembly of the drill bit of FIG. 64 also includes a latch 126 to hold the gate in the second arrangement once it has been released by the shearable screw 124. The latch 126 comprises an outer-housing mounted component 126A and a gate-mounted component 126B. When the gate is fully opened, the gate mounted component 126B is received by the outer housing mounted component 126A and retained, thus holding the gate 122 in the second position (i.e. open), as shown in FIGS. 65 and 67.

Figure 68:
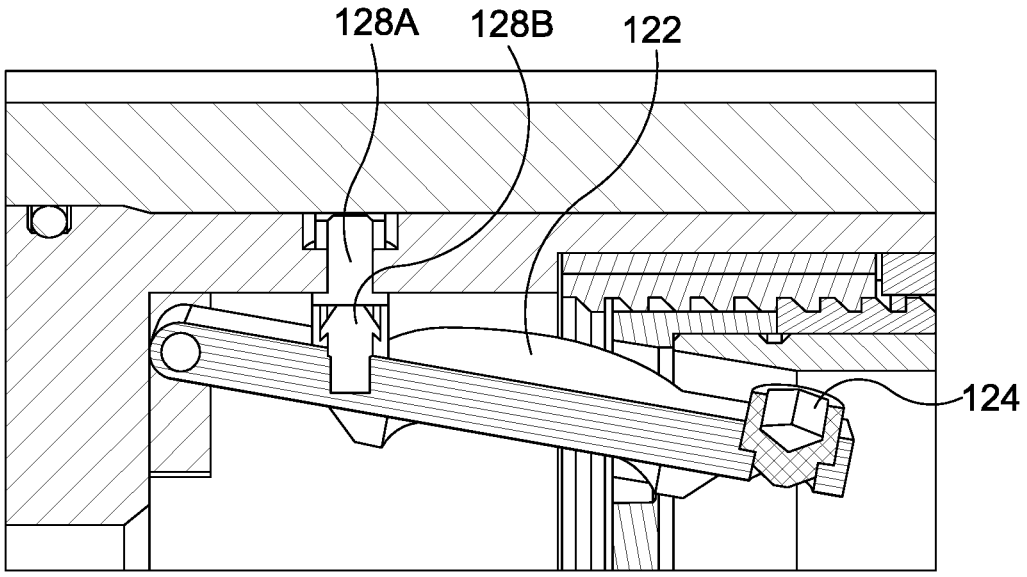
FIG. 68 is a cross-section of part of a blocking assembly.
Figure 69:
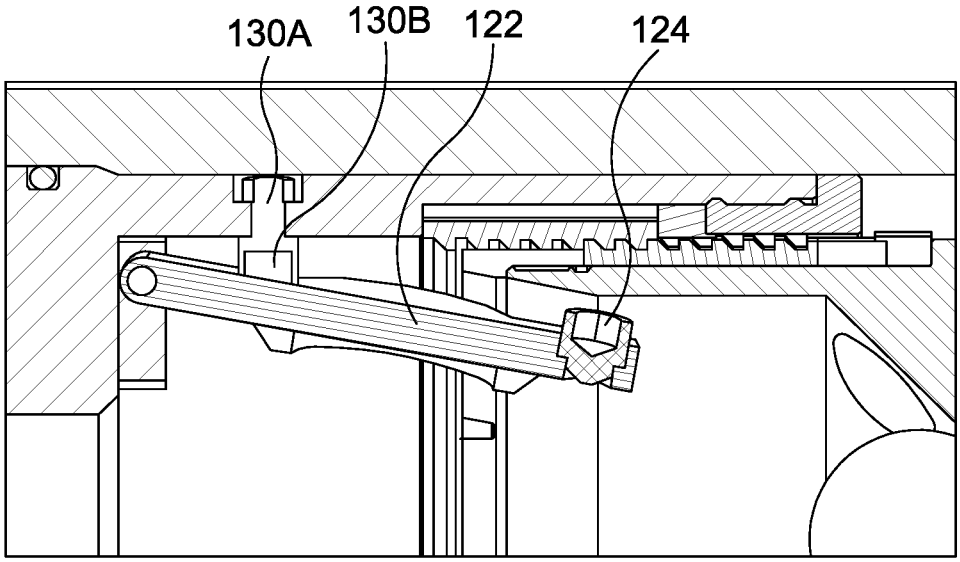
FIG. 69 is a cross-section of part of a further blocking assembly.

FIGS. 68 and 69 illustrate different types of latch.

In FIG. 68, the latch comprises a collet-catcher. The outer housing mounted component 128A comprises a catcher with a radially-inwardly protruding flange, arranged to receive and capture a radially-outwardly protruding flange on the gate mounted component 128B when the gate opens.

In FIG. 69, the latch comprises a magnet. At least one of the outer housing mounted component 130A and the gate mounted component 130B comprises a magnet and the other of the outer housing mounted component 130A and the gate mounted component 130B comprises either a magnet or magnetic material. Accordingly, the magnetic attraction holds the gate mounted component in contact with the outer housing mounted component when the gate is open.

Figure 70:
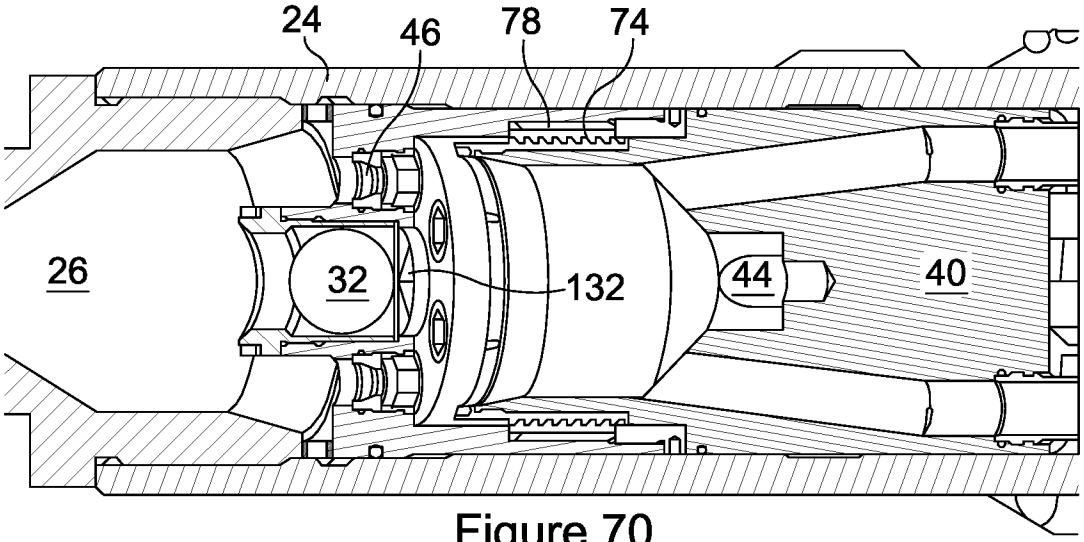
FIG. 70 is a perspective view of a further drill bit according to the disclosure in a first arrangement.
Figure 71:
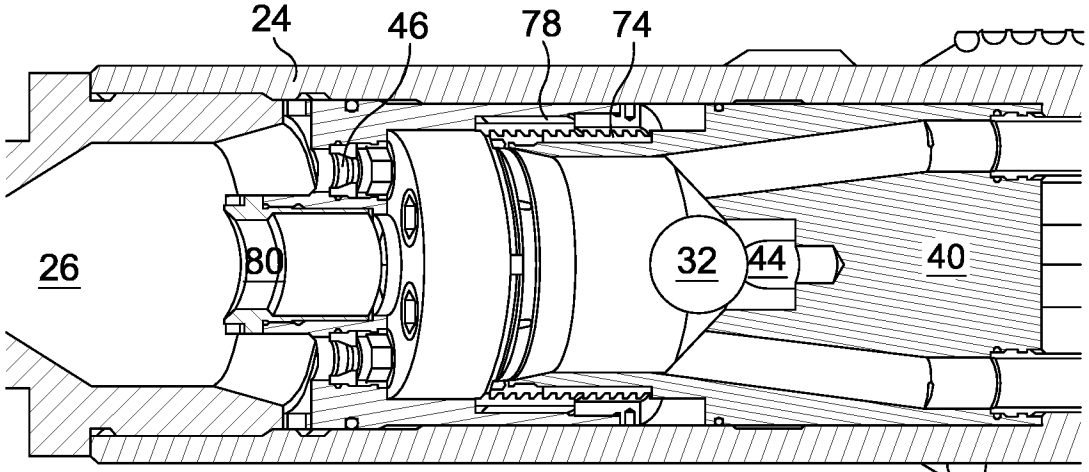
FIG. 71 is a perspective cross-section of the drill bit of FIG. 64 in a second arrangement.
Figure 72:
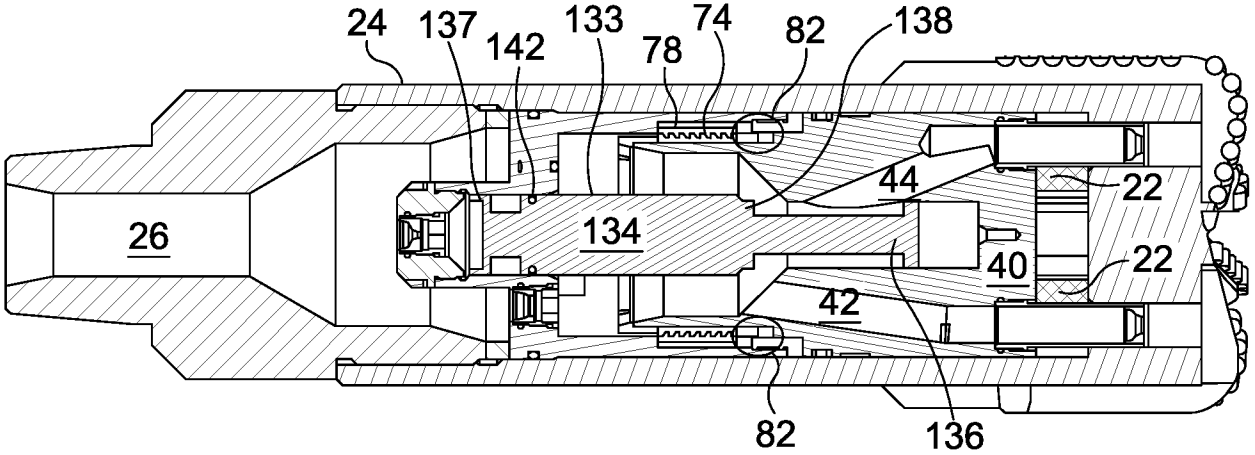
FIG. 72 is a cross-section of a further drill bit according to the disclosure in a first arrangement.

FIGS. 70 and 71 illustrate a further example of a blocking assembly. As before, features not forming part of the blocking assembly are as described above and comments made above relating to these features apply, where appropriate and adapted as appropriate. In the drill bit of FIGS. 70 and 71, the blocking assembly comprises a ball 32 and a frangible screen 132. Frangible screen 132 is located in a central passageway through the drill bit, analogous to the location of the annular ring 34 in previous examples. The frangible ring 132 holds the ball 32 in the passageway 80 and prevents flow of drilling fluid therethrough. When the flow rate is increased and the pressure differential across the ball 32 and the frangible screen 132 increases to a threshold value, the axial force on the frangible screen 132 will cause it to break apart, releasing the ball 32 to move to the second position as in previous examples. The frangible screen 132 may be made from any material suitable for breaking apart when the pressure differential across the ball and frangible screen 132 reaches the threshold value. Suitable materials may include rubbers or plastic, for example PEEK. The frangible screen includes scores in order to encourage breakage.

FIGS. 72 to 77 illustrate a further example of a drill bit. As before, the majority of features present in the drill bit of FIGS. 72 to 77 are equivalent to those in earlier-described embodiments and where a feature is not explicitly described below, it is to be assumed that the comments made above in relation to that feature apply, where appropriate and adapted as appropriate.

In the drill bit of FIGS. 72 to 77, the blocking assembly comprises an occluding rod 133 and a deformable fastening—in this case a shearable screw 140. The occluding rod comprises a cylindrical body section 134 connected to a first support arm 136 and second support arm 137. The occluding rod extends substantially axially within the outer housing 24. The second support arm 137 is located on an upstream end of the cylindrical body 134 and is located in a drilling fluid passageway of the outer housing. The second support arm 137 provides a sliding engagement with a cylindrical section of the outer housing 24. A seal 142 is located between the occluding rod 133 and the cylindrical section defined by the outer housing 24 in order to prevent drilling fluid from passing between these components and reducing a pressure gradient.

The first support arm 136 is located on the downstream end of the body section 134 and extends into the deployable blade assembly 38. The first support arm 136 provides a sliding engagement with a cylindrical section of the flow path (defined by the piston 40). As such, the occluding member is restricted to axial movement within the outer housing 24.

A shoulder 138 is defined by a reduction in diameter of the occluding rod 133, between the cylindrical body section 134 and the first support arm 136

The first support arm 136 is shaped such that, when the blocking assembly is in the first arrangement, fluid can flow around the occluding rod 133 and through all of the flow paths 42 44.

Figure 73:
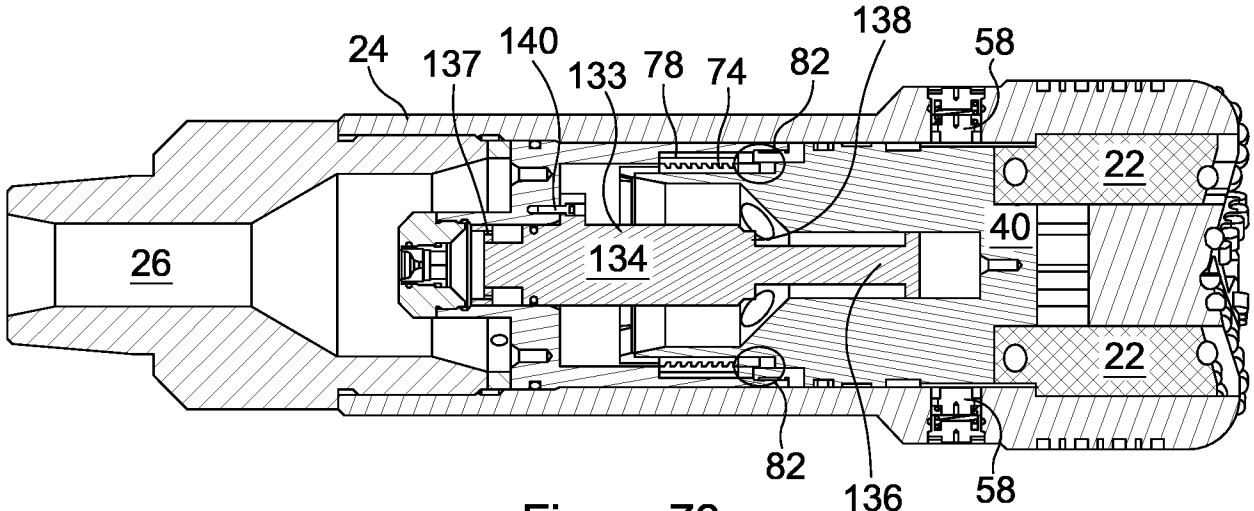
FIG. 73 is a further cross-section of the drill bit of FIG. 72 in a first arrangement.

Turning now to FIG. 73, a tab protrudes from the side of the cylindrical body section 134 of the occluding rod 133. When the occluding rod 133 is in the first arrangement (i.e. a non-occluding position), a shearable screw 140 extends through the tab and into a part of the outer housing 24, holding the occluding rod 133 in position. When the flow rate through the drill bit is increased and the pressure drop across the occluding rod 134 increases to a threshold value, the axial force exerted on the sharable screw 140 will cause it to fail and break, releasing the occluding rod 133 to move to the second arrangement—that is an occluding position. As the occluding rod 133 is restricted to axial movement within the outer housing 24 and the shearable screw 140 connects directly to the occluding rod 133 and the outer housing, all of the force exerted on the occluding rod 133 is transferred through the shearable screw 140. As such, the increase in tensile force exerted on the screw for a given increase in drilling fluid flow rate is larger in the drill bit of FIG. 72 than for an equivalent increase in flow rate in a drill bit as described with reference to FIG. 62.

Figure 74:
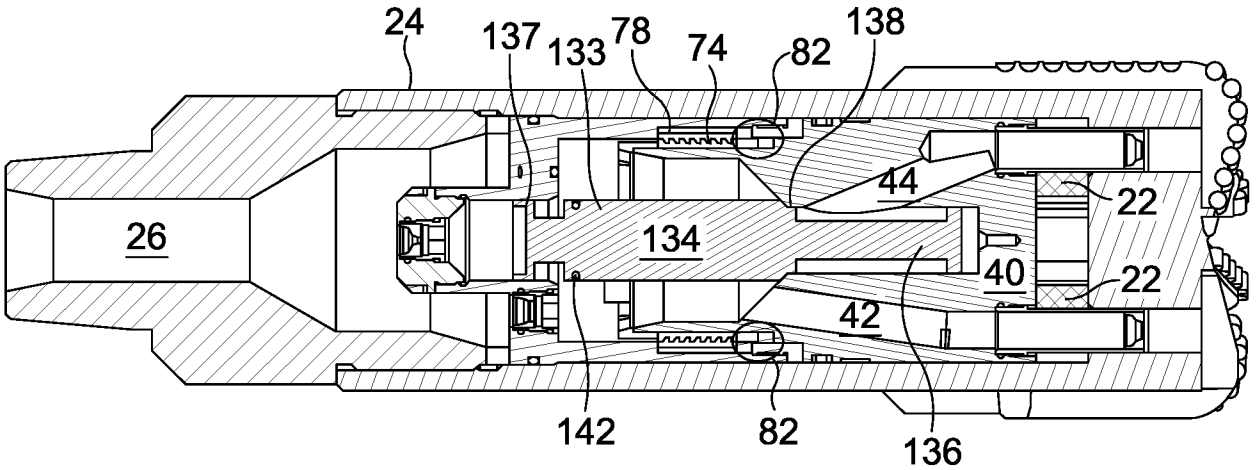
FIG. 74 is a further cross-section of the drill bit of FIG. 72.
Figure 75:
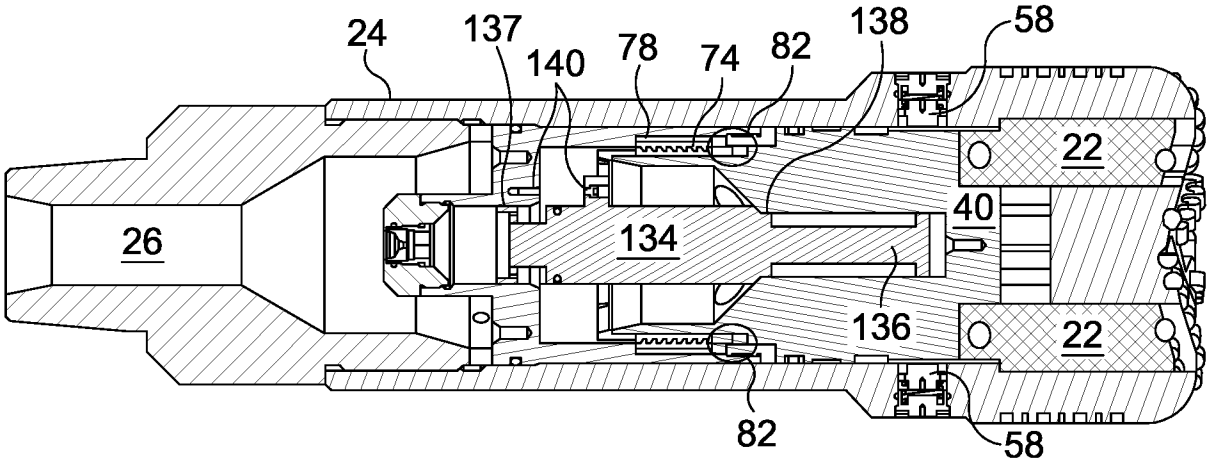
FIG. 75 is a further cross-section of the drill bit of FIG. 72.
Figure 77:
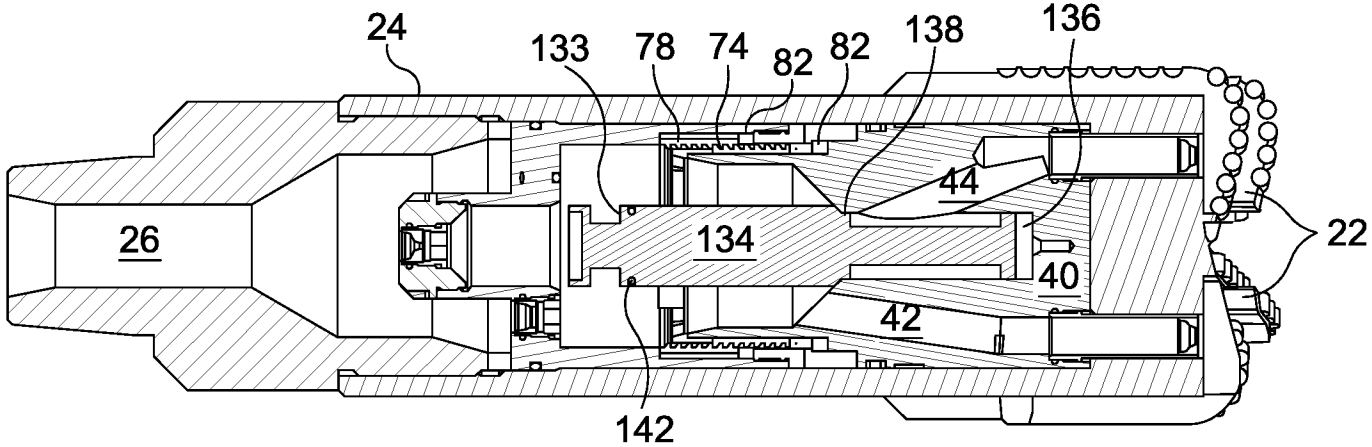
FIG. 77 is a further cross-section of the drill bit of FIG. 72 in a second arrangement.
Figure 78:
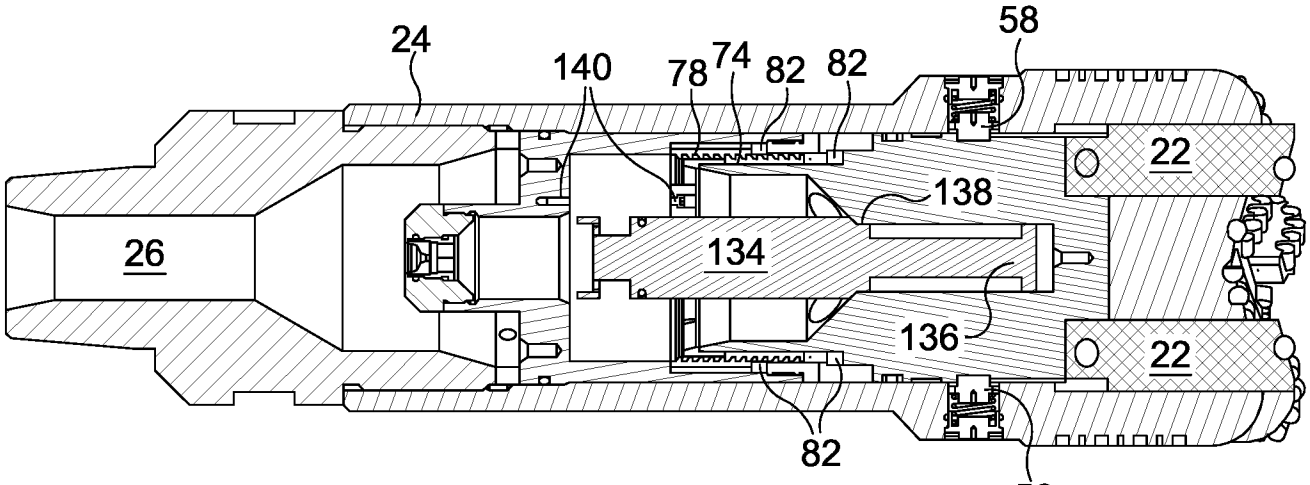
FIG. 78 is a further cross-section of the drill bit of FIG. 72 in a second arrangement.

Once the shearable screw 140 breaks, as illustrated in FIGS. 74 and 75, the occluding rod 133 moves axially within the outer housing 24 towards the deployable blade assembly 38, as in previous examples, until the occluding rod 133 abuts the piston 40. In the present embodiment, the shoulder 138 of the occluding rod abuts a seat defined by a tapered section of the flow path 44 (defined by the piston 40) and seals off that flow path 44. Once the flow path 44 is closed off, the pressure gradient across the deployable blade assembly 38 increases until a deployment value is reached, at which point the shear ring 82 fails and breaks, releasing the deployable blade assembly 38, which moves under the action of the drilling fluid into the second position, as shown in FIGS. 77 and 78.

Figure 76:
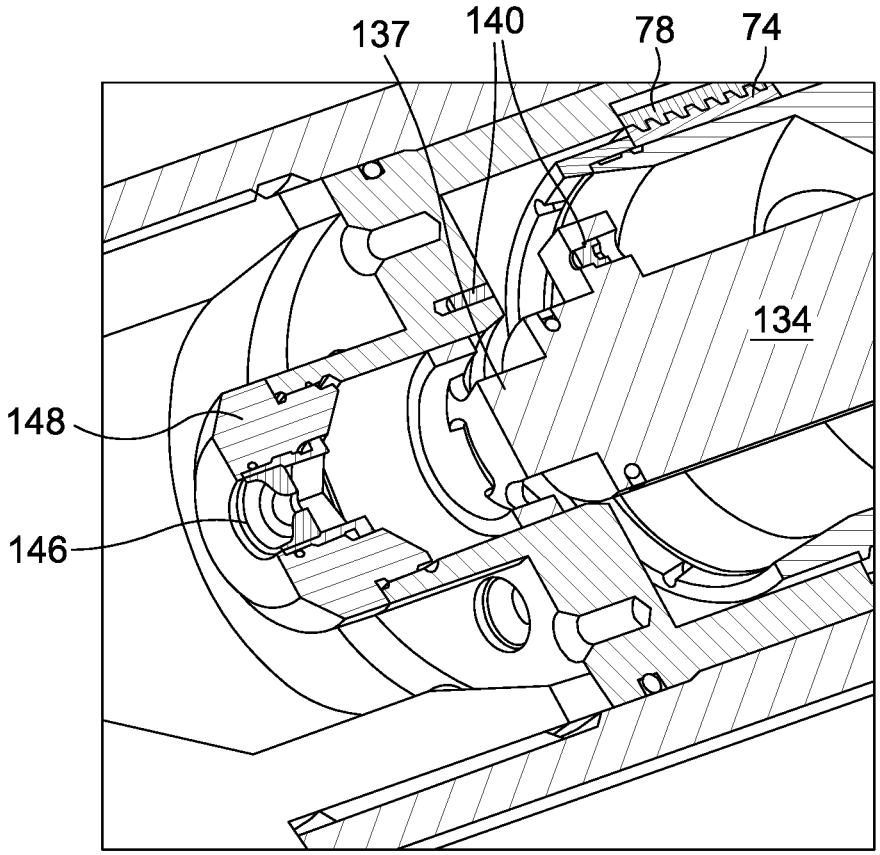
FIG. 76 is a perspective view of a cross-section of the drill bit of FIG. 72.

FIG. 76 illustrates the upstream end of the occluding rod 133, with the second support arm 137 slidably engaged with a drilling fluid passageway of the outer housing. In FIG. 76, the occluding rod 133 has moved from the first arrangement to engage the deployable blade assembly 38, but the deployable blade assembly 38 has not yet moved from the first to the second position. As such, FIG. 76 corresponds to the drill bit arrangement of FIGS. 74 and 75. The drilling fluid passageway in which the second support arm 137 is located comprises a cylindrical section along the axis of the drill bit with a plug member 148 supporting a nozzle 146. The nozzle 146 helps control the pressure felt by the upstream end of the occluding rod 133. A ring-shaped section around the circumference of the cylindrical section comprises a series of further nozzles which allow fluid to bypass the blocking assembly. These further nozzles ensure that drilling fluid can flow from the inlet to the outlet(s) of the drill bit when the drill bit is operating in a first arrangement.

Figure 79:
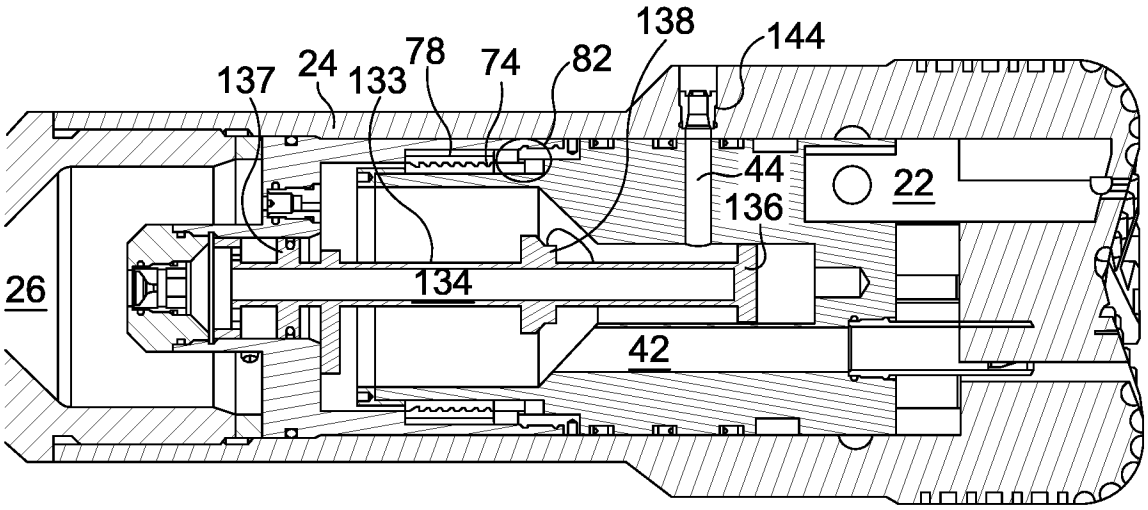
FIG. 79 is a cross-section of a further drill bit according to the disclosure in a first arrangement.
Figure 80:
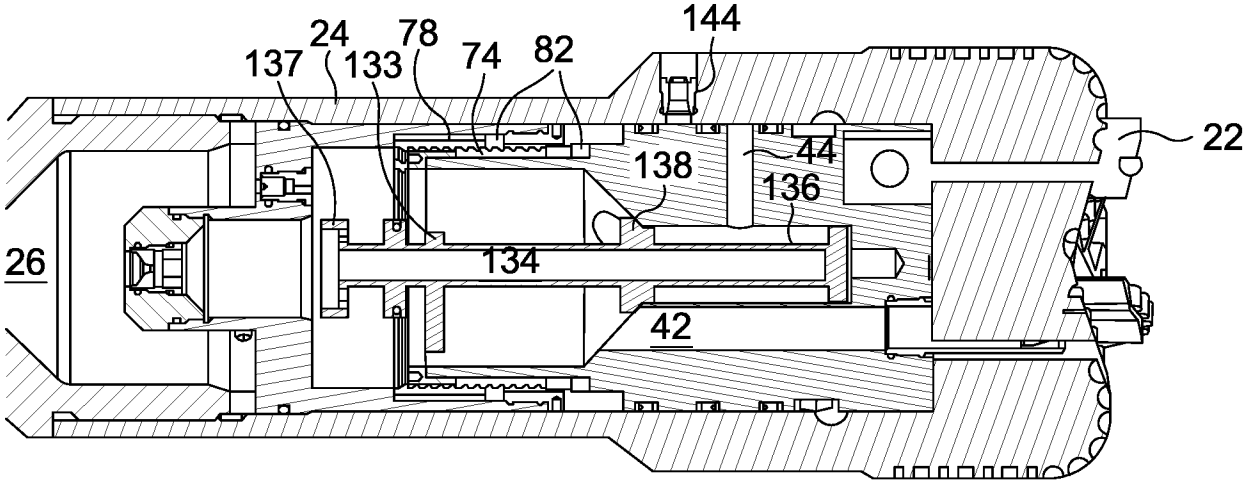
FIG. 80 is a further cross-section of the drill bit of FIG. 78 in a second arrangement.
Figure 81:
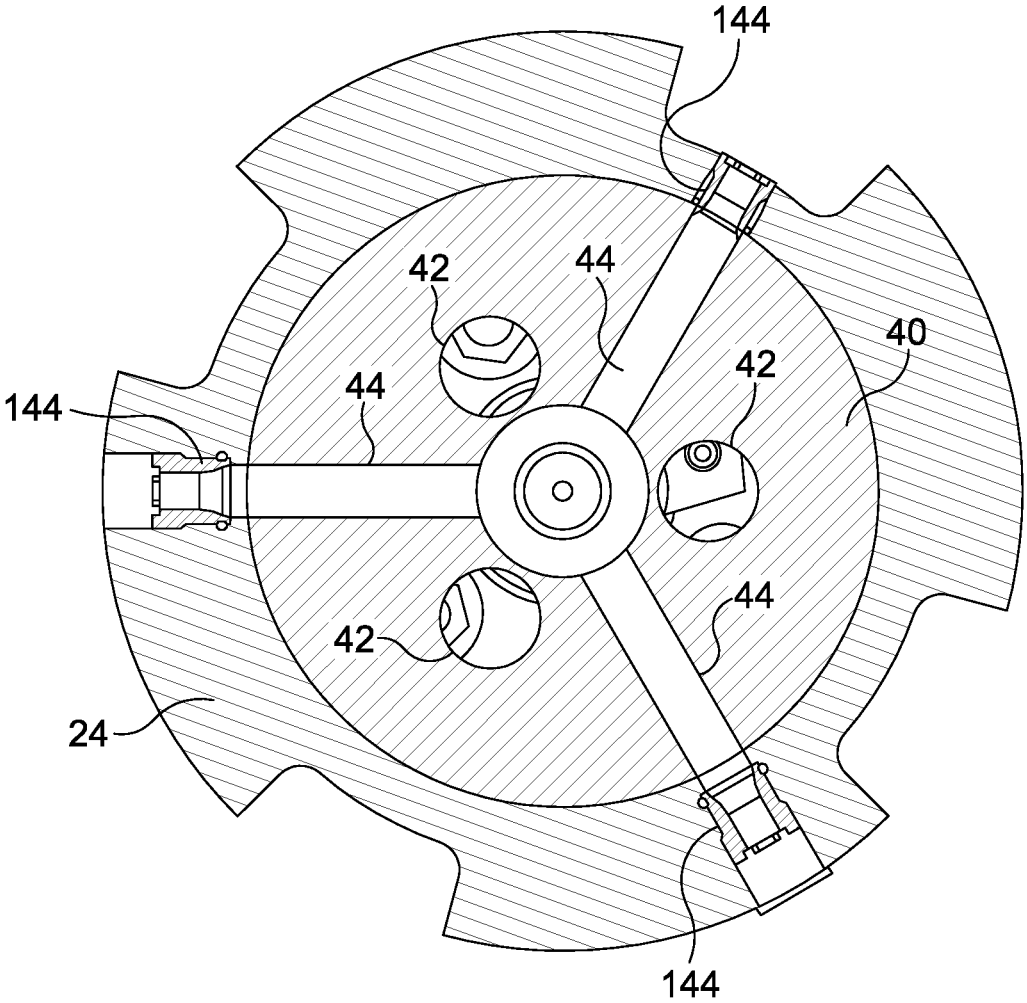
FIG. 81 is a cross-section viewed along the axis of the drill bit of FIG. 78.

FIGS. 79 to 81 illustrate a further example of a drill bit. As before, the majority of features present in the drill bit of FIGS. 78 to 80 are equivalent to those in earlier-described embodiments and where a feature is not explicitly described below, it is to be assumed that the comments made above in relation to that feature apply, where appropriate and adapted as appropriate.

In the drill bit of FIGS. 79 to 81, the occluding rod 133 has a different shape, with the cylindrical body section 134 having a smaller diameter and the shoulder 138 being formed by a radial flange protruding from the occluding rod 133 between the body section 133 and the first support arm 136.

Additionally, the flow path(s) 44 through which flow is restricted by the occluding rod 133 are arranged to extend radially out from the axis of the drill bit, through the curved side wall of the outer housing 24 via nozzles 144. Flow paths 42 which are not blocked by the occluding rod 133 extend axially and have outlets in the primary cutting structure—that is an axial end face of the drill bit. The inclusion of flow paths which with outlets in the curved side wall of the drill bit—i.e. outlets which are arranged remote from the primary and/or deployable cutting structure—allows a higher total number of flow paths to be implemented in the design. Higher drilling fluid flow rates can be used when flow paths with outlets remote from a drilling structure are present.

FIGS. 79 and 80 illustrate the drill bit in a first and second arrangement, respectively.

FIG. 81 is a view of a cross-section in a plane perpendicular to the axis of the drill bit through the flow paths 44 through which flow may be restricted by the occluding rod 133 ("blockable flow paths"). The flow paths 42 through which flow cannot be restricted by the occluding rod 133 ("open flow paths") can be seen extending axially within the drill bit (out of the plane of the page). Three "blockable flow paths" 44 are arranged at evenly spaced intervals of 120 degrees around the circumference of the drill bit. The flow paths 44 extend from a central flow path region radially out to the curved side wall of the piston 40. Nozzles 144 are located in the flow paths 44 within the side walls of the housing 24. The nozzles 144 allow a pressure drop between the flow paths 44 and the wellbore to be controlled.

FIGS. 82 to 89 illustrate a further example of a drill bit. As before, the majority of features present in the drill bit of FIGS. 72 to 77 are equivalent to those in earlier-described embodiments and where a feature is not explicitly described below, it is to be assumed that the comments made above in relation to that feature apply, where appropriate and adapted as appropriate.

The blocking assembly of the drill bit of FIGS. 82 to 89 comprises a ball 32, a gate 150, a fastener in the form of a shearable screw 154 and a guide 152.

As in embodiments described above, when in a first arrangement, the gate 150 is located in a fluid passageway in the outer housing and is arranged to prevent fluid flow through this passageway. The gate 150 comprises a seal 156 in this regard in order to prevent fluid from passing between the gate 150 and the passageway wall. The ball 32 is located on the upstream side of the gate 150 and is prevented from moving downstream, towards the deployable blade assembly by the gate 150.

The gate 150 is in sliding engagement with the guide 152, which comprises two axially-aligned rods protruding from the outer housing (only one of which is shown in FIGS. 82 to 87). A head on the end of each rod prevents the gate 150 disengaging the guide 152.

Figure 82:
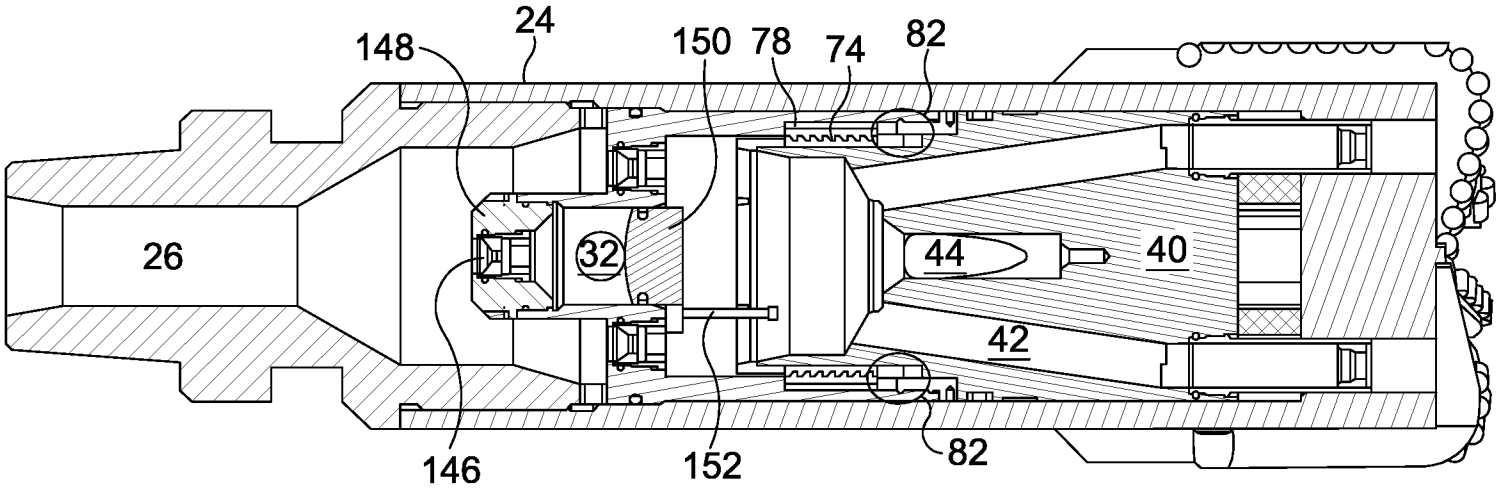
FIG. 82 is a cross-section of a further drill bit according to the disclosure in a first arrangement.
Figure 83:
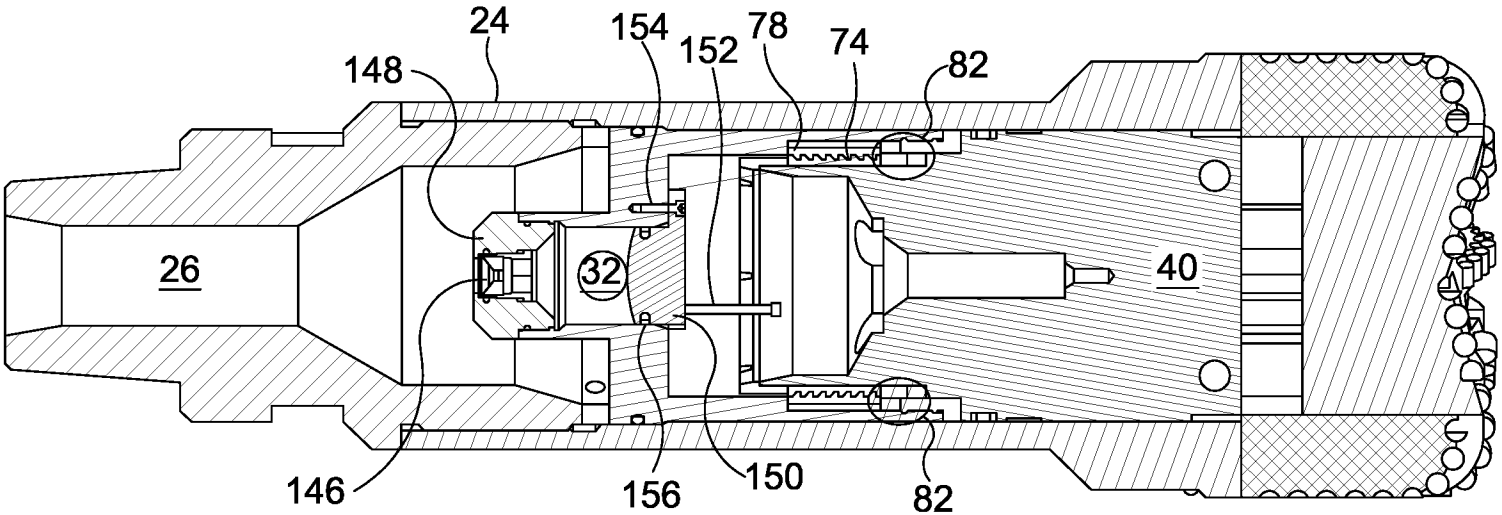
FIG. 83 is a further cross-section of the drill bit of FIG. 82 in a first arrangement.

When in the first arrangement, as illustrated in FIGS. 82 and 83, the gate 150 is held in the passageway (i.e. in a first position) by the shearable screw, which extends through a part of the gate 150 and into the surrounding housing/passageway.

As the flow through the drill bit increases, the pressure differential across the ball 32 and gate 150 increases and the ball 32 and gate 150 exert a force on the shearable screw 154 in the direction of the deployable blade assembly 38.

When the pressure gradient across the ball 32 and gate 150 reaches a threshold value, the shearable screw breaks such that the gate 150 is no longer held in the first arrangement. The gate 150 moves in a downstream direction under the action of drilling fluid flowing through the drill bit. The guide 152 guides the gate 150 such that the gate 150 moves axially within the drill bit and is held once the gate 150 engages the heads on the end of each guide 152.

Figure 84:
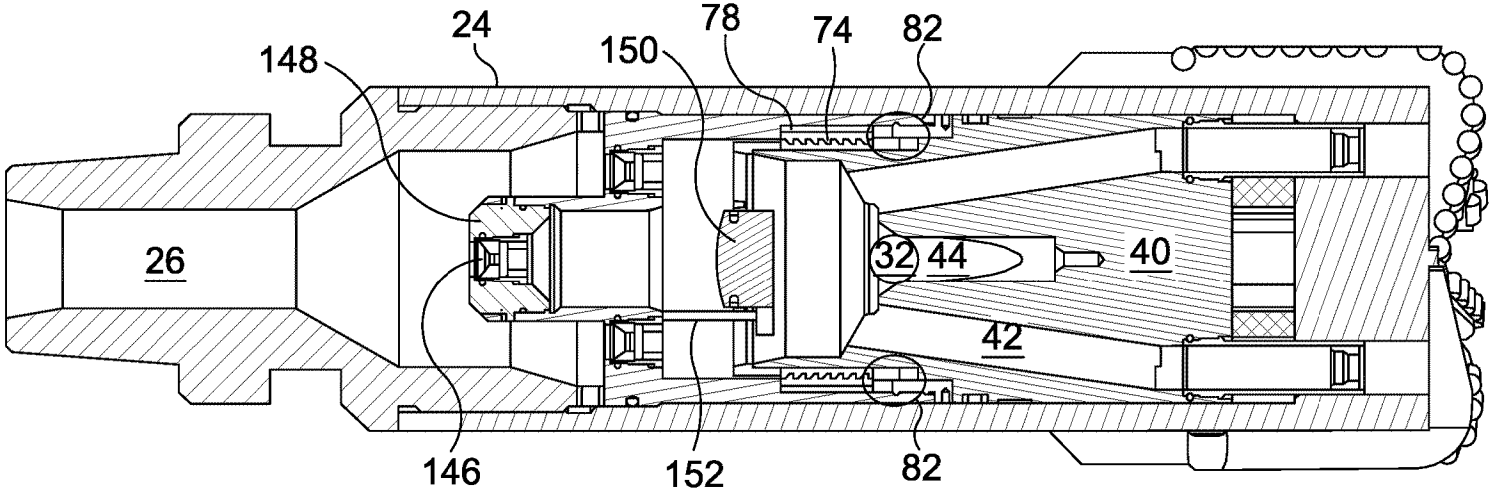
FIG. 84 is a further cross-section of the drill bit of FIG. 82.
Figure 85:
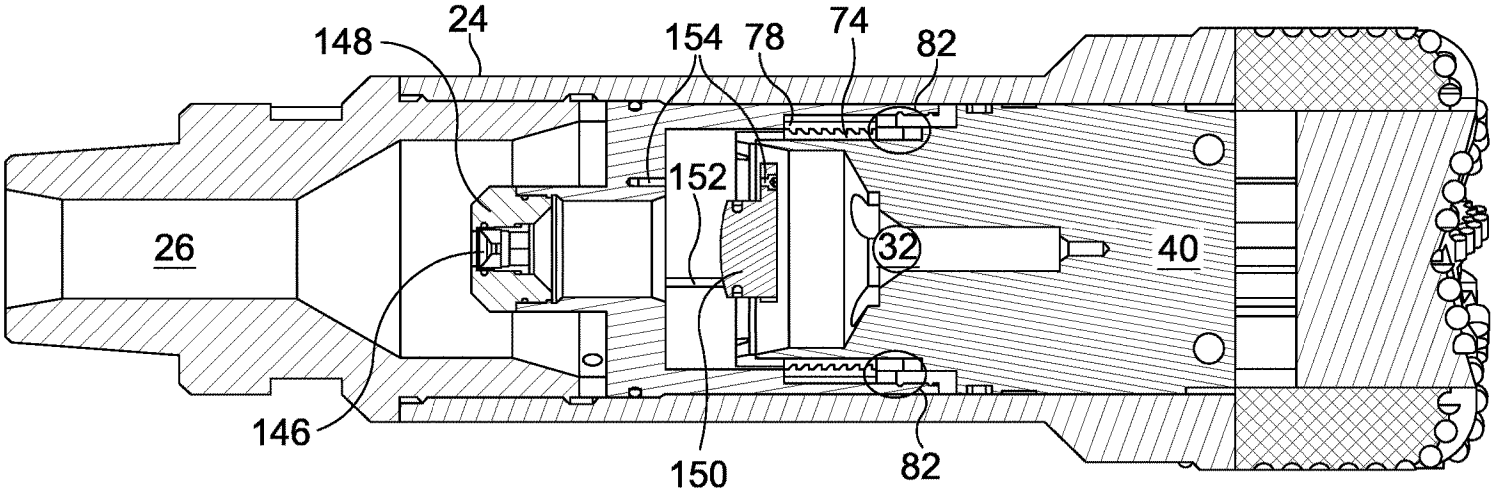
FIG. 85 is a further cross-section of the drill bit of FIG. 82.

The upstream side of the gate 150 (the one which is in contact with the ball 32 when in the first arrangement) has a convex surface. As such, once the gate 150 moves out of the passageway, the drilling fluid carries the ball 32 around the gate 150 and moves the ball into an occluding arrangement in the seat of the deployable blade assembly 38 as described in previous embodiments. FIGS. 84 and 85 illustrate the drill bit once the gate 150 and ball 32 have moved from the first arrangement; the ball 32 is in an occluding position, but the deployable blade assembly 38 has not yet moved from the first position.

Figure 86:
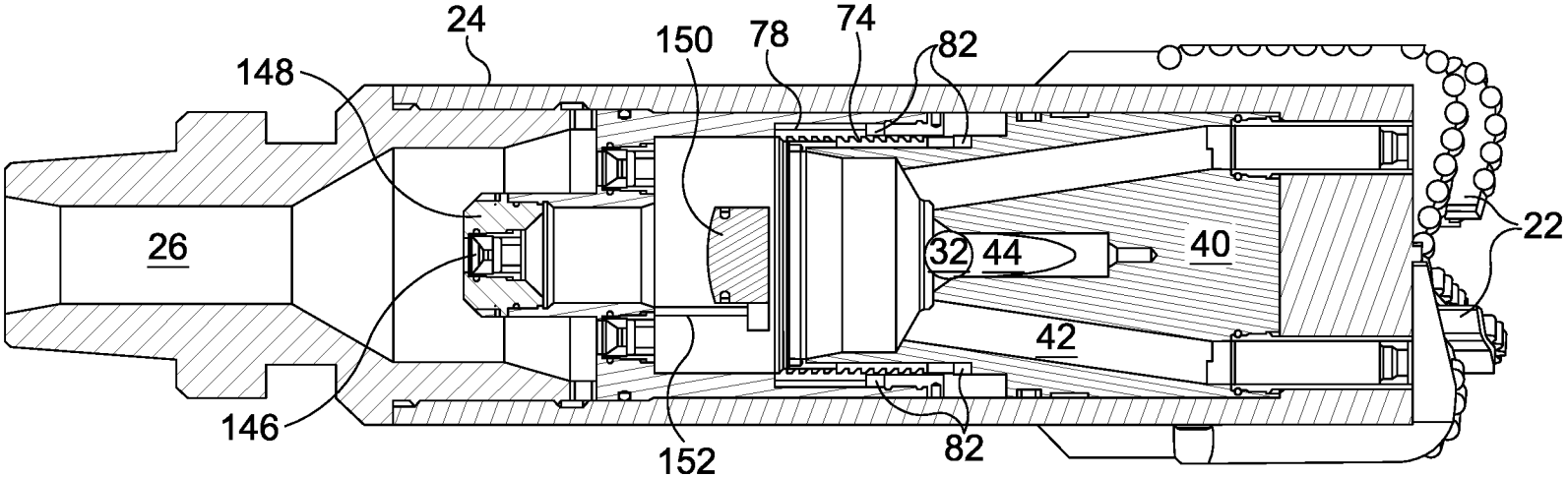
FIG. 86 is a further cross-section of the drill bit of FIG. 82 in a second arrangement.
Figure 87:
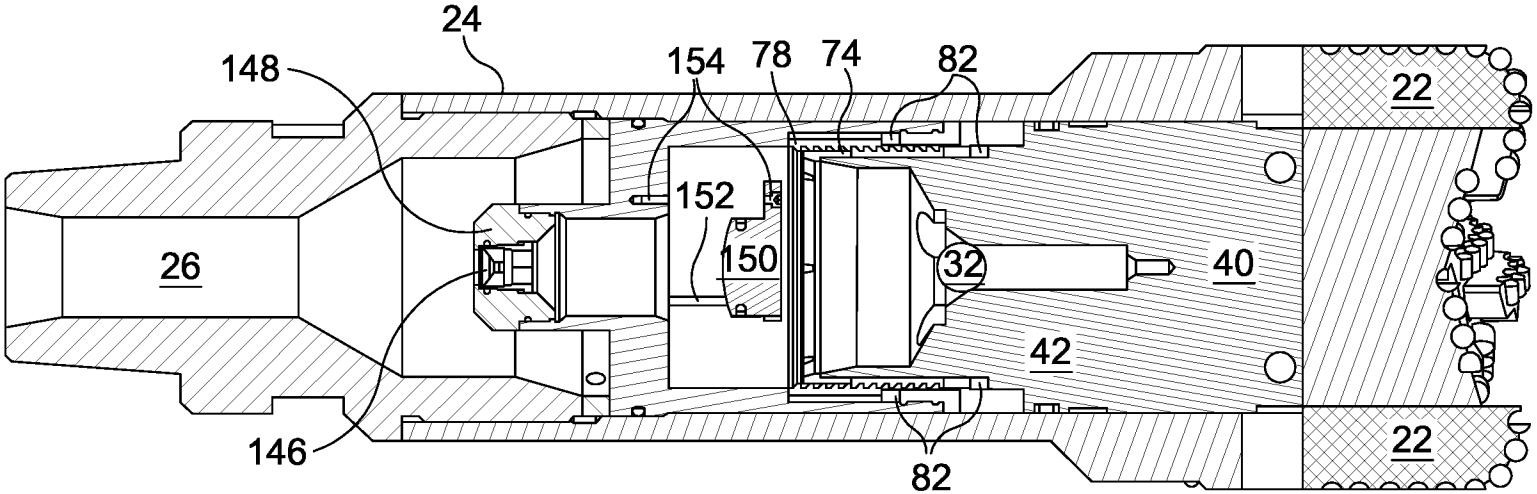
FIG. 87 is a further cross-section of the drill bit of FIG. 82 in a second arrangement.

As with previous embodiments, once the ball 32 is located in an occluding arrangement—restricting flow through a flow path 44 through the deployable blade assembly—the pressure differential across the deployable blade assembly 38 increases until a deployment value is reached, at which point the shear ring 82 fails and the deployable blade assembly 38 moves towards the second position. FIGS. 86 and 87 show the drill bit in the second arrangement with the blades 22 in a deployed position.

Figure 88:
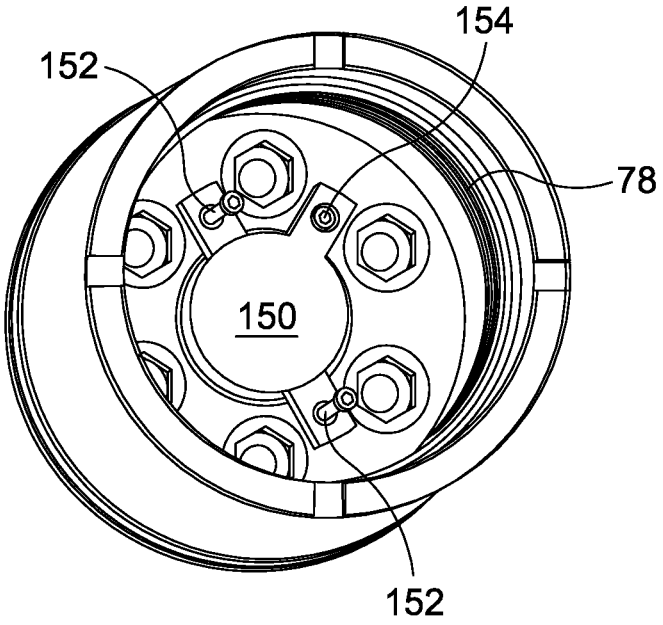
FIG. 88 is a perspective view of a part of the outer housing and blocking assembly in a first arrangement.
Figure 89:
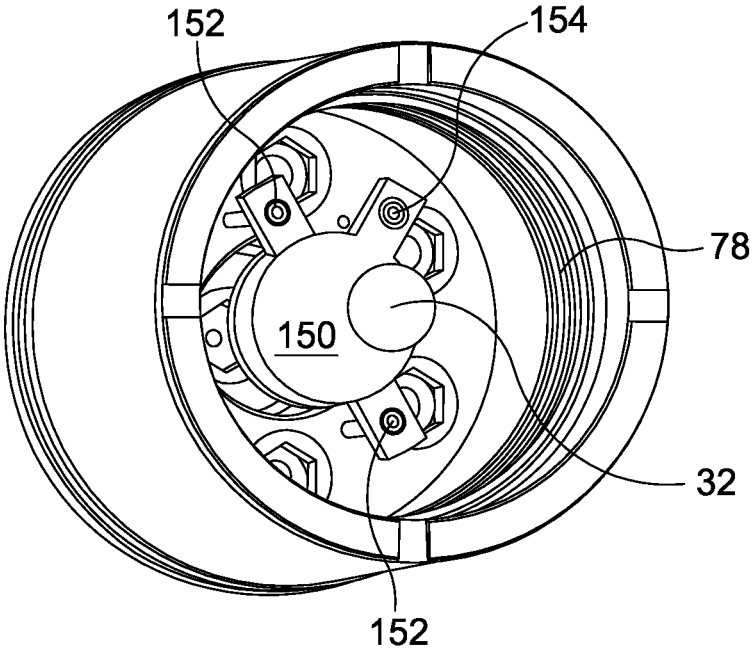
FIG. 89 is a further perspective view of a part of the outer housing and blocking assembly in a second arrangement.

FIGS. 88 and 89 show the blocking assembly in a first and second arrangement respectively. In the first arrangement, in FIG. 88, the gate 150 is located snugly in the passageway such that the ball 32 is prevented from passing. The shearable screw 154 is intact and is holding the gate 150 in the passageway against the force created by the pressure gradient. Other passageways through the housing can be seen circumferentially surrounding the gate 150, through which the drilling fluid may flow when the drill bit is operating in a first arrangement. The guide 152 comprising two cantilevered rods can be seen on either side of the gate 150.

FIG. 89 shows the blocking assembly in a second arrangement. In FIG. 89, the threshold pressure gradient has been reached and the shearable screw has failed and thus has sheared at a location between when it is attached to the gate 150 and fixed relative to the outer housing 24. The gate 150 is therefore free to move under the action of the drilling fluid, although its movement is restricted by the guide 152, which only permits axial movement. The gate 150 therefore travels along the guide from the first to a second position, at which point it abuts the heads on the guide rods. The gate 150 is held in this position by the flow of the drilling fluid. Once the gate 150 has left the central passageway, the ball 32 moves out and around the gate 150 and eventually locates in the piston 40 of the deployable blade assembly 38, as described above.

FIGS. 90 to 93C illustrate a further example of a drill bit. As before, the majority of features present in the drill bit of FIGS. 90 to 93C are equivalent to those in earlier-described embodiments and where a feature is not explicitly described below, it is to be assumed that the comments made above in relation to that feature apply where appropriate and adapted as appropriate.

Figure 90:
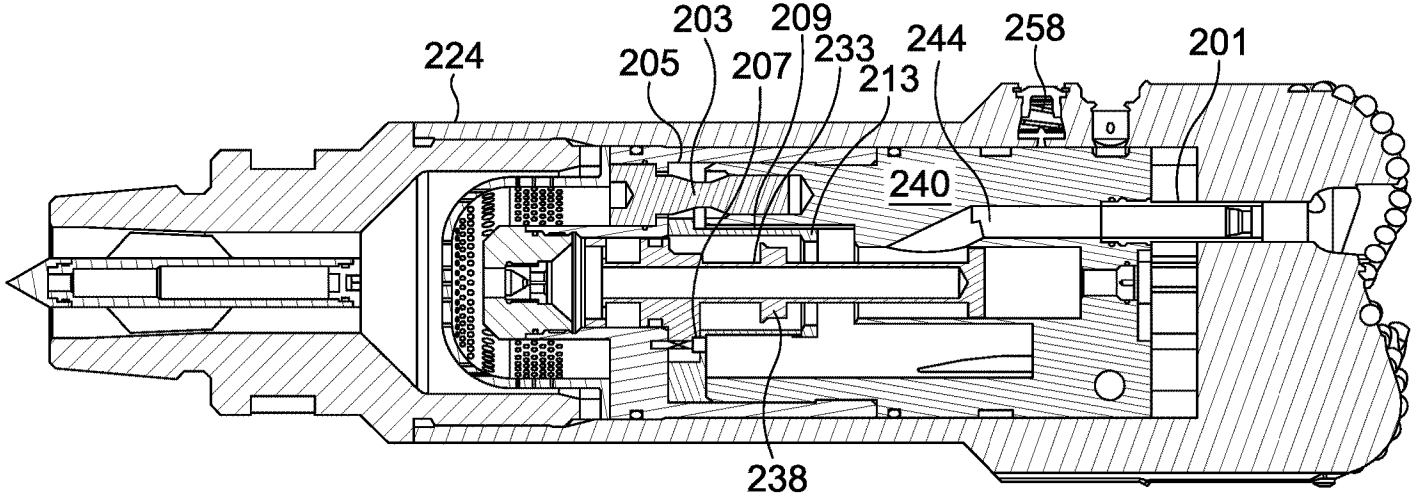
FIG. 90 is a cross-section of a further drill bit according to the disclosure in a first arrangement.
Figure 91:
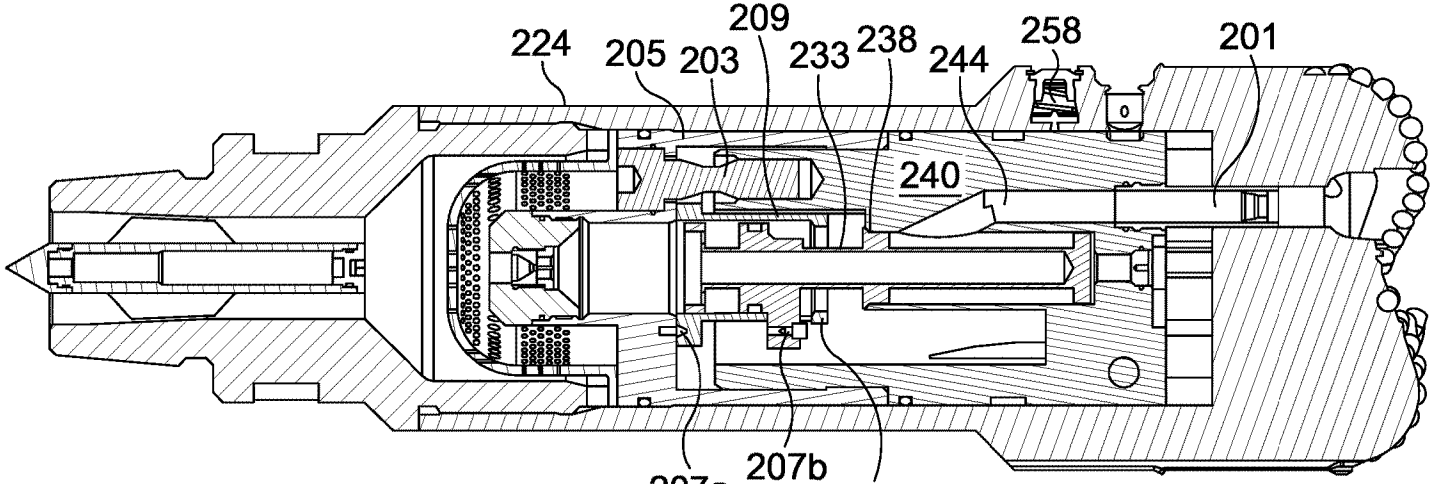
FIG. 91 is a further cross-section of the drill bit of FIG. 90.
Figure 92:
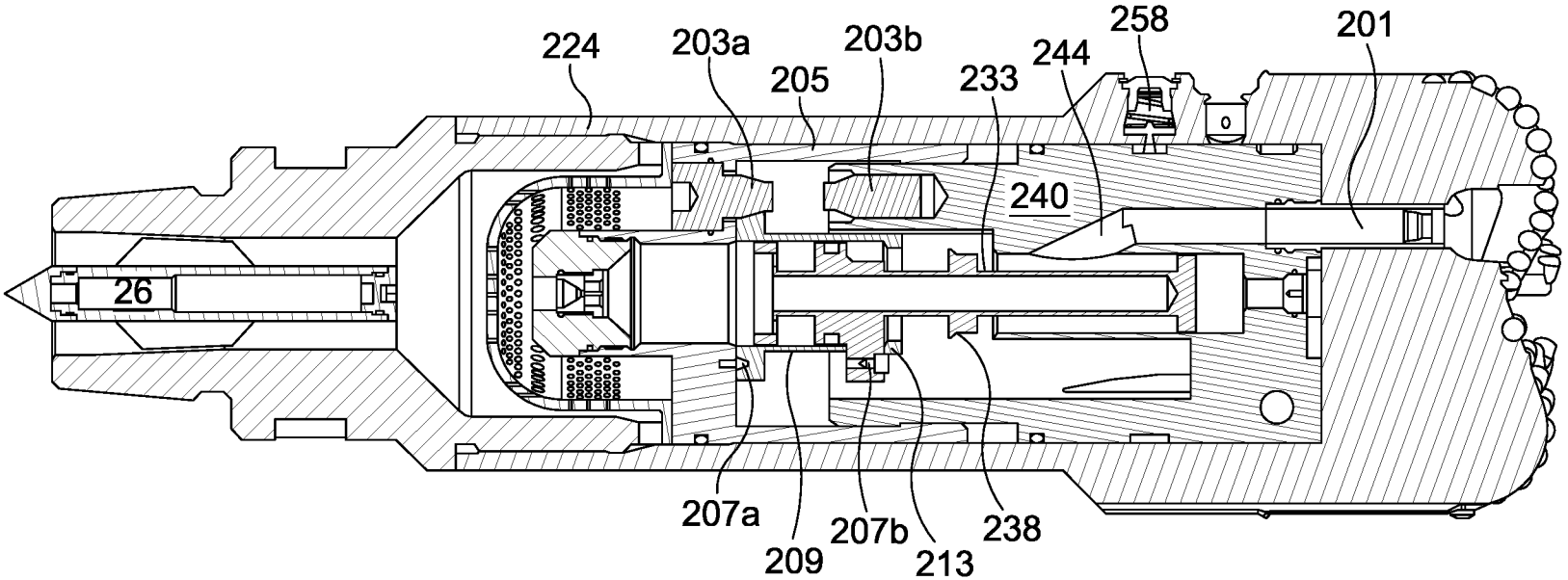
FIG. 92 is a further cross-section of the drill bit of FIG. 90 in a second arrangement.

FIG. 90 shows the drill bit with the deployable blade assembly in a first position, the drill blades 222 in a retracted position and the blocking assembly in a first arrangement (i.e. a non-blocking arrangement). FIG. 91 shows the drill bit once the blocking assembly has moved into a second arrangement (a blocking arrangement) with the deployable blade assembly still in the first position. FIG. 92 shows the drill bit once the deployable blade assembly has moved to a second position and the drill blades 222 are deployed.

Figure 95A:
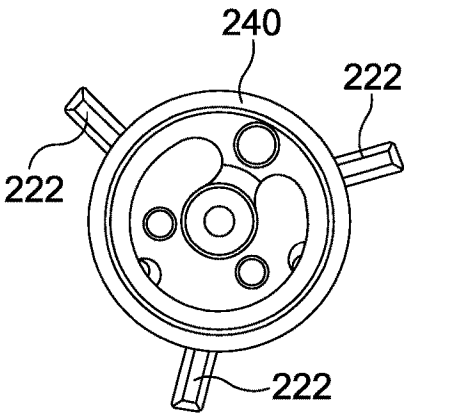
FIGS. 95A to 95C are a first end view, perspective and second end view of a deployable blade assembly for use in a drill bit.
Figure 95B:
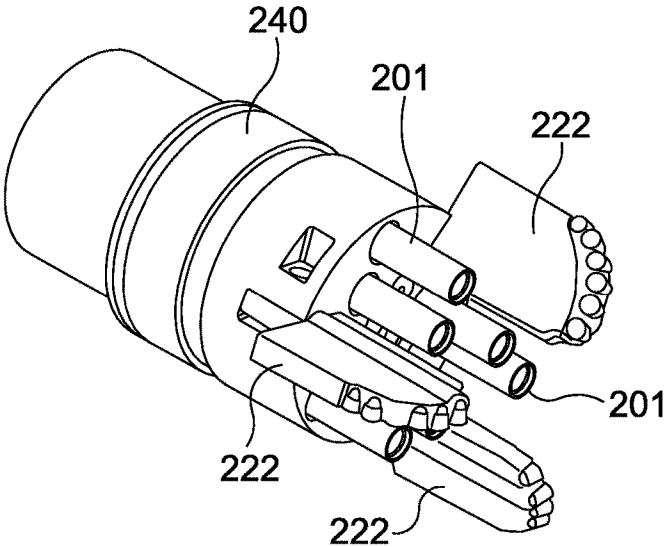
Figure 95C:
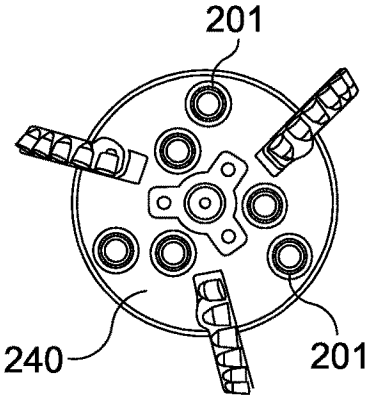

FIGS. 95A to 95C illustrate a deployable blade assembly suitable for use in the drill bit of FIGS. 90 to 93C. The deployable blade assembly comprises a piston 240, which can be located within the outer housing 224 of the drill bit. The piston 240 defines a plurality of flow paths therethrough. A plurality of nozzles 201 extend from the respective flow paths. The nozzles 201 are arranged to control the flow of drilling fluid out the face of the drill bit. The deployable blade assembly further comprises a plurality of blades 222 connected to the piston 240 and arranged to be extendable from the drill bit.

Turning now to FIGS. 90 and 91, it can be seen that the deployable blade assembly—and in particular the piston 240—is held in a first position by a deformable release which, in the drill bit of FIGS. 90 to 93C, is a shearable screw 203—i.e. a screw configured to break when a predetermined tension load is experienced. As seen in FIG. 92, one part of the blocking assembly shearable screw 203*a* (e.g. the head) is fixed with respect to the outer housing 224—for example by being threaded through a support cylinder 205 which is fixed with respect to the outer housing 224. The other part 203*b* (e.g. the end) is fixed with respect to the piston 240—for example by screwingly engaging the piston 240.

The support cylinder 205 (as shown in FIGS. 90 to 93C and in more detail in FIGS. 94A to 94C) is arranged to be fixed with respect to the outer housing 224. A plurality of axial ports 211 are arranged to allow fluid to pass from an upstream side of the support cylinder 205 and occluding member 233, to a downstream side, adjacent the deployable blade assembly piston 240, such that the fluid can pass through the flow paths arranged therein.

The blocking assembly of this drill bit comprises an occluding member 233 in the form of a rod and a restraint—in this case a shearable screw 207. The occluding member 233 extends substantially axially within the outer housing 224. Part of the occluding member 233 is arranged within the support cylinder 205. A further part of the occluding member 233 is arranged within the piston 240 of the deployable blade assembly. The occluding member 233 is arranged to move axially with respect to both the support cylinder 233 and the piston 240 of the deployable blade assembly.

As can be seen in FIG. 90, the blocking assembly shearable screw 207 (which may alternatively be replaced with any deformable or breakable fastening) is arranged to hold the occluding member 233 in a first arrangement. Once the blocking assembly shearable screw 207 has broken, the occluding member 233 is free to move axially under the action of fluid pressure and flow.

In the drill bit of FIGS. 90 to 93C, the occluding member 233 comprises a shoulder 238 in the form of a radial protrusion. As is illustrated in FIG. 91, the shoulder 238 is configured such that it can block at least one of the plurality of flow paths 244 through the piston 240 when the blocking assembly moves to the second arrangement.

In this example, a guide cylinder 209 is arranged concentrically within and fixed with respect to the support cylinder 205. The guide cylinder 209 is fixed relative to the outer housing 224. The guide cylinder 209 comprises an abutment 213 which is arranged to restrict the axial movement of the occluding member 233. As can be seen in FIG. 92, when the deployable blade assembly has moved to the second position, the abutment 213 is arranged to engage the occluding member 233 and prevent it from moving with the deployable blade assembly.

In use, the drill bit will typically initially operate in a first arrangement as shown in FIG. 90. In this arrangement the deployable blade assembly is in a first position and the drill blades 222 are retracted within the outer housing 224. Drilling fluid may flow from the surface, through the ports 211 in the support cylinder 205, through the flow paths defined by the deployable blade assembly piston 240 and out of the face of the drill bit. Initially, the occluding member 233 is held in the first arrangement by the shearable screw 207.

When it is desired to deploy the drill blades 222, the operator may increase the flow rate of drilling fluid through the drill bit. As the support cylinder 205 defines a restriction to the flow of drilling fluid, the increase in flow rate will increase the pressure gradient across the support cylinder 205. The pressure differential across the occluding member 233, which is arranged in parallel with the support cylinder 205, will also increase. The pressure gradient across the occluding member 233 imparts an axial force on the occluding member 233 in a downstream direction (i.e. to the right of FIGS. 90 to 93C). Once the pressure differential across the occluding member reaches a threshold value, the shearable screw 207 breaks, releasing the occluding member 233.

Once the shearable screw 207 has broken the occluding member 233 is axially moved under the action of fluid pressure from a first arrangement towards a second arrangement. The occluding member 233 moves towards the deployable blade assembly (to the right in FIGS. 90 to 93C). The occluding member 233 moves to the second arrangement and, when in the second arrangement, the occluding member shoulder 238 abuts a seat defined by the piston 240 around the entry to at least one of the flow paths 244 through the piston 240. This is shown in FIG. 91.

When the occluding member 233 is in the second arrangement it restricts fluid flow through the piston 240 of the deployable blade assembly (by blocking entry to at least one of the flow paths 244). This causes a sudden increase in the pressure gradient across the piston 240 and the deployable blade assembly as a whole.

The increase in the pressure gradient across the piston 240 urges the deployable blade assembly from the first to the second position, against the action of the deployable blade assembly shearable screw 203. When the pressure differential across the deployable blade assembly reaches a threshold value referred to herein as the deployment value, the deployable blade assembly shearable screw 203 breaks, releasing the deployable blade assembly. The deployable blade assembly moves from the first position to the second position, deploying the drill blades 222 out of the front of the drill bit, as shown in FIG. 92.

FIG. 92 shows the drill bit after the shearable screw 203 has broken and the deployable blade assembly has moved to the second position, deploying the drill blades. It can be seen that the abutment 213 of the guide cylinder 209 prevents the occluding member 233 from following the piston 240 and, as such, the flow paths 244 which were momentarily closed by the occluding member 233 are again open for drilling fluid to flow therethrough once the piston 240 has moved to the second position.

Figure 93A:
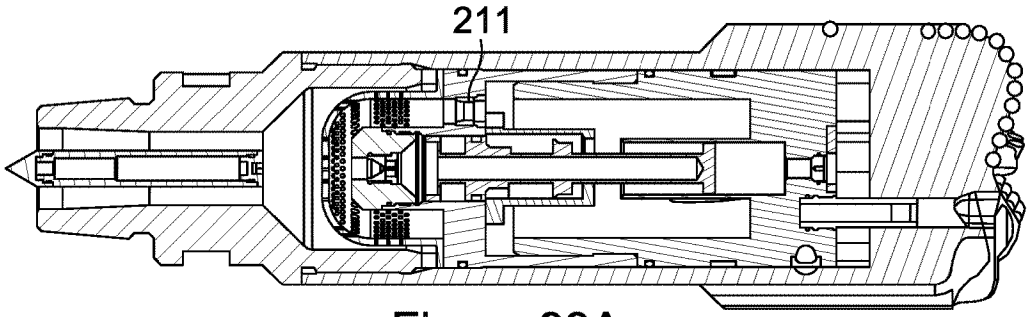
FIGS. 93A to 93C are rotationally-separated cross-sections through the drill bit of FIG. 90.
Figure 93B:
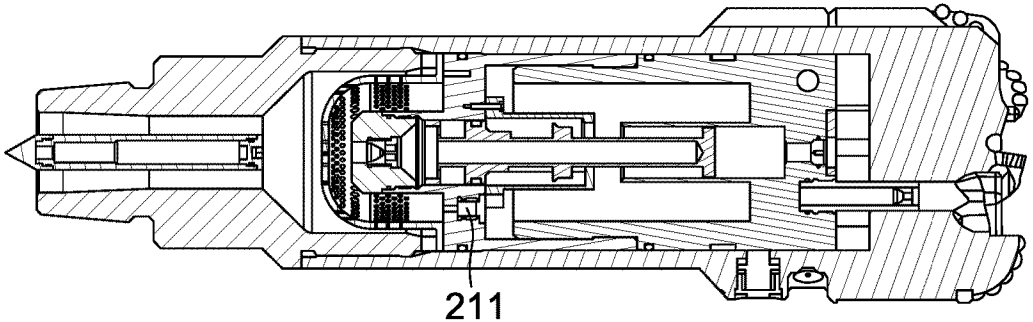
Figure 93C:
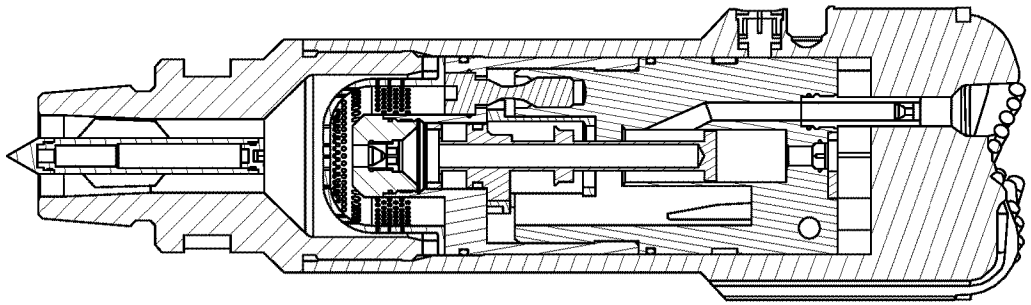
Figure 94A:
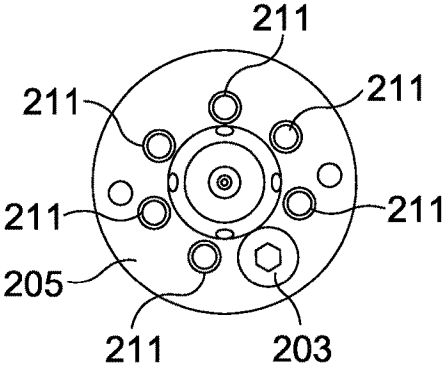
FIGS. 94A to 94C are a first end view, perspective and second end view respectively of part of a blocking assembly for use in a drill bit.
Figure 94B:
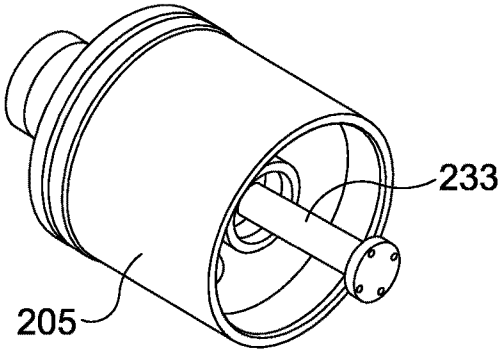
Figure 94C:
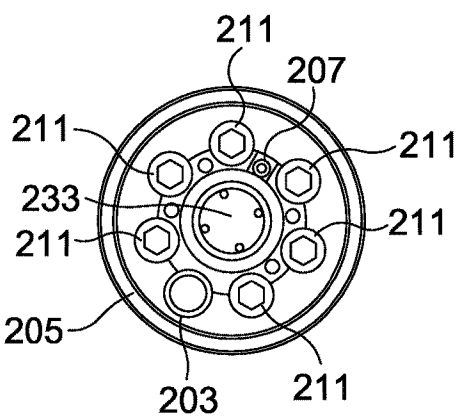

FIGS. 93A to 93C are cross-sections through the axis of the drill bit at three different angular rotations, thus showing different features of the support cylinder 205 and piston 240.

As in previous drill bits described herein, a plurality of lock pins 258 may be provided in the housing 224 around the circumference of the piston 240 and biased radially inwards towards the piston 240. These lock pins 258 are arranged to lock the piston 240—and hence deployable blade assembly—in the second (deployed) position by extending into recesses in the piston 240 when the deployable blade assembly enters the second position.

As will be understood by the reader, a plurality of seals are employed throughout the drill bit in order to prevent fluid leakage and to ensure proper operation of the moving components.

The disclosure set out above presents exemplary embodiments of the present invention, the invention being defined by the claims appended hereto below. Modifications from the disclosed exemplary embodiments may be made and fall within the scope of the claims. Furthermore, it is to be understood that the invention is in no way to be limited to the combination of features shown in the examples set out above. Features disclosed in relation to one example can be combined with features disclosed in relation to a further example.

The invention claimed is:

1. A drill bit for drilling a bore, the drill bit comprising:

an outer housing;

a primary cutting structure defining a cutting plane of a first diameter;

a flow path arranged to let drilling fluid flow through the drill bit; and a deployable blade assembly at least partially located within the outer housing, the deployable blade assembly comprising a deployable cutting structure and configured to be axially movable from a first position, in which the deployable cutting structure is recessed with respect to the primary cutting structure, towards the cutting plane, to a second position;

wherein the deployable blade assembly is configured such that, when the deployable blade assembly is in the second position, the deployable cutting structure defines a cutting diameter which is less than or equal to the first diameter, further comprising:

an actuation mechanism configured to cause the deployable blade assembly to move from the first position to the second position;

wherein the actuation mechanism is a blocking assembly configured to move from a first arrangement, in which the flow path is open and fluid can flow through the flow path, to a second arrangement, in which the blocking assembly is arranged to restrict fluid flow through the flow path, in response to a change in the flow of drilling fluid through the drill bit;

wherein the deployable blade assembly is configured to move from the first position to the second position under the action of fluid pressure in response to the blocking assembly moving to the second arrangement, wherein the blocking assembly comprises an occluding member and a restraint configured to hold the occluding member in the first arrangement and release the occluding member in response to the change in the flow of drilling fluid through the drill bit such that the occluding member can move from a non-occluding position in the first arrangement to an occluding position in the second arrangement in which the occluding member prevents fluid from flowing through the flow path.

2. The drill bit according to claim 1, wherein the change in the flow of drilling fluid through the drill bit increases a pressure differential across the blocking assembly to a threshold value.

3. The drill bit according to claim 1, wherein the change in the flow of drilling fluid through the drill bit is an increase in the drilling fluid flow rate.

4. The drill bit according to claim 1, further comprising a deformable release arranged between the outer housing and the deployable blade assembly;

wherein a first part of the deformable release is fixed with respect to the outer housing and a second part of the deformable release is fixed with respect to the deployable blade assembly, restraining the deployable blade assembly in the first position;

wherein the deformable release is configured to deform such that the deployable blade assembly can move with respect to the outer housing when a pressure differential across the deployable blade assembly reaches a deployment value.

5. The drill bit according to claim 4, wherein the deformable release is a threaded connector configured to break at a predetermined tensile load.

6. The drill bit according to claim 1, further comprising a lock arranged to hold the deployable blade assembly in the second position.

7. The drill bit according to claim 6, wherein the lock comprises:

an engagement member in one of the outer housing and the deployable blade assembly, biased towards the other of the outer housing and the deployable blade assembly; and a recess arranged on the other of the outer housing and the deployable blade assembly, arranged to receive the engagement member when the deployable blade assembly is in the second position.

8. The drill bit according to claim 1, wherein the deployable blade assembly comprises:

a piston located within the outer housing; and a blade connected to the piston.

9. The drill bit according to claim 8, wherein the piston and blade of the deployable blade assembly are arranged to move parallel to a longitudinal axis of the drill bit from the first position to the second position.

10. The drill bit according to claim 1, wherein the deployable cutting structure is level with, or extends out from, the primary cutting structure in an axial direction when the deployable blade assembly is in the second position.

11. The drill bit according to claim 1, wherein the occluding member is arranged to move parallel to the axis of the drill bit from the first arrangement to the second arrangement.

12. The drill bit according to claim 1, wherein the restraint comprises a breakable fastener.

13. The drill bit according to claim 12, wherein the restraint is a threaded connector configured to break at a predetermined tensile load.

14. The drill bit according to claim 1, wherein the occluding member is a rod.

15. The drill bit according to claim 1, wherein the restraint is configured to prevent the occluding member from escaping the outer housing.

16. A method of operating a drill bit, the method comprising:

deploying the drill bit into a wellbore, the deployed drill bit comprising an outer housing, a primary cutting structure defining a cutting plane of a first diameter, a flow path arranged to let drilling fluid flow through the drill bit, a deployable blade assembly at least partially located within the outer housing and comprising a deployable cutting structure, and an actuation mechanism configured to cause the deployable blade assembly to move, towards the cutting plane, from a first position to a second position;

operating the drill bit with the deployable blade assembly in the first position in which the deployable cutting structure is recessed with respect to the primary cutting structure to drill a bore with a first diameter;

operating the actuation mechanism to cause the deployable blade assembly to move, towards the cutting plane, from the first position to the second position;

wherein the actuation mechanism is a blocking assembly configured to move from a first arrangement, in which the flow path is open and fluid can flow through the flow path, to a second arrangement, in which the blocking assembly is arranged to restrict fluid flow through the flow path, in response to a change in the flow of drilling fluid through the drill bit;

holding an occluding member of the blocking assembly by a restraint of the blocking assembly in the first arrangement;

releasing the occluding member from the restraint in response to the change in the flow of drilling fluid through the drill bit such that the occluding member can move from a non-occluding position in the first arrangement to an occluding position in the second arrangement in which the occluding member prevents fluid from flowing through the flow path;

moving the deployable blade assembly from the first position to the second position under the action of fluid pressure in response to the blocking assembly moving to the second arrangement; and operating the drill bit with the deployable blade assembly in the second position to drill a bore with a diameter equal to or less than the first diameter.

17. The method of claim 16, wherein the blocking assembly is disposed in the outer housing when the drill bit is deployed into the wellbore.

18. The method of claim 16, wherein the restraint is configured to prevent the occluding member from escaping the outer housing.

19. A whipstock milling system comprising:

a whipstock;

an anchor-packer; and the drill bit according to claim 1.

* * * * *